US012808064B2

(12) United States Patent
Waldvogel et al.

(10) Patent No.: US 12,808,064 B2
(45) Date of Patent: Nov. 24, 2026

(54) ELECTROCHEMICAL SYNTHESIS OF PYRAZOLINES AND PYRAZOLES

(71) Applicant: Bayer AG, Leverkusen (DE)

(72) Inventors: Siegfried Waldvogel, Gau-Algesheim (DE); Martin Linden, Vallendar (DE); Silja Hofmann, Wiesbaden (DE); Robin Maximilian Bär, Bergisch Gladbach (DE); Mark James Ford, Oberreifenberg (DE); Sherif James Kaldas, Düsseldorf (DE)

(73) Assignee: BAYER AKTIENGESELLSCHAFT, Leverkusen (DE)

( * ) Notice: Subject to any disclaimer, the term of this patent is extended or adjusted under 35 U.S.C. 154(b) by 0 days.

(21) Appl. No.: 18/993,060

(22) PCT Filed: Jun. 14, 2023

(86) PCT No.: PCT/EP2023/065893

§ 371 (c)(1),
(2) Date: Jan. 10, 2025

(87) PCT Pub. No.: WO2024/012791

PCT Pub. Date: Jan. 18, 2024

(65) Prior Publication Data

US 2026/0009142 A1 Jan. 8, 2026

(30) Foreign Application Priority Data

Jul. 11, 2022 (EP) ..... 22184091

(51) Int. Cl.

| | |
|---|---|
| ***C25B 3/05*** | (2021.01) |
| ***C25B 3/09*** | (2021.01) |
| ***C25B 3/20*** | (2021.01) |
| ***C25B 9/17*** | (2021.01) |
| ***C25B 11/043*** | (2021.01) |

(52) U.S. Cl.

CPC ..... *C25B 3/05* (2021.01); *C25B 3/09* (2021.01); *C25B 3/20* (2021.01); *C25B 9/17* (2021.01); *C25B 11/043* (2021.01)

(58) Field of Classification Search

None

See application file for complete search history.

(56) References Cited

FOREIGN PATENT DOCUMENTS

WO 2010127855 A1 11/2010

OTHER PUBLICATIONS

Yang et al. J. Org. Chem. 2018, 83, 11963-11969 (Year: 2018).*
Chiba et al. J. Org. Chem. 1983, 48, 2968-2972 (Year: 1983).*
Chen D., et al., "Hypervalent Iodine in Synthesis: Oxidation of Aldeyde Hydrazones with Phenyliodine Diacetate: A New Method for the Generation of Nitrilimines", Synthetic Communications, vol. 25(11), 1995, pp. 1617-1626.
Ma C., et al., "Copper(I)-Catalyzed Synthesis of Pyrazoles from Phenylhydrazones and Dialkyl Ethlenedicarboxylates in the Presences of Bases", Synlett, No. 9, 2011, pp. 1321-1323.
Steckhan E., "Indirect electro-organic syntheses—a modern chapter in organic electrochemistry", Agnew. Chem, vol. 98, 1986, pp. 6810699.

* cited by examiner

*Primary Examiner* — Wojciech Haske
(74) *Attorney, Agent, or Firm* — Michael VanEngelen

(57) ABSTRACT

The present invention relates to an electrochemical process for the synthesis of pyrazolines and pyrazoles of the formula (I). The process can be used in particular for the synthesis of the herbicide safener mefenpyr-diethyl.

I

21 Claims, No Drawings

ELECTROCHEMICAL SYNTHESIS OF PYRAZOLINES AND PYRAZOLES

The present application is a 35 U.S.C. § 371 national phase entry of International Application No. PCT/EP2023/065893, filed on Jun. 14, 2023, which claims priority to EP patent application Ser. No. 22/184,091.1, filed Jul. 11, 2022, the contents of each of which are hereby incorporated by reference in their entirety.

TECHNICAL FIELD

The present invention relates to an electrochemical process for the synthesis of pyrazolines and pyrazoles. The process can be used in particular for the synthesis of the herbicide safener mefenpyr-diethyl.

PRIOR ART

Pyrazolines and pyrazoles are essential building blocks of complex agrochemical or pharmaceutical compounds and are therefore of high relevance for industrial applications.

Various methods for synthesizing pyrazolines and pyrazoles are described in the prior art. For example, preparation thereof by [3+2] cycloaddition starting from the corresponding hydrazonoyl halides using bases is known. However, the hydrazonoyl halides required for this have to be prepared in a complex manner, sometimes using toxic and expensive halogenating reagents (WO 2010/127855). In addition, α,β-unsaturated ketones can be reacted organocatalytically with hydrazines to give the corresponding pyrazolines, with the reaction having to be carried out in the absence of water and with use of complex catalyst systems and toxic halogenated solvents. Furthermore, some methods are known which enable the preparation of pyrazolines enantioselectively from alkyne components. These use expensive transition metal catalysts based on palladium, titanium, copper and iridium, some of which have complex ligand systems.

The known methods are characterized overall as disadvantageous by the use of expensive transition metals, superstoichiometric amounts of (auxiliary) reagents, complex substrate syntheses or multi-stage synthetic sequences, and the use of chemical halogenating agents, usually as an excess component. The increased material input and the use of toxic solvents result in increased reagent waste, which has to be disposed of in a complex and costly manner and is a barrier to economic efficiency of the methods.

There is therefore a need for synthetic processes for pyrazoles and pyrazolines which are less costly or material-intensive and time-consuming. Consequently, the object of the present invention is to provide new synthetic processes which do not have the disadvantages mentioned above.

BRIEF SUMMARY OF THE INVENTION

This object is at least partially achieved by a process for preparing compounds of the general formula (I)

I

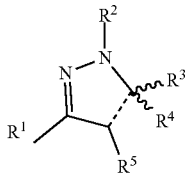

in which ⋰ is a single or double bond;

$R^1$ is alkyl, —C(O)O-alkyl, cycloalkyl, aryl, or heterocyclyl, in each case substituted or unsubstituted;

$R^2$ is alkyl, —C(O)O-alkyl, cycloalkyl, aryl, or heterocyclyl, in each case substituted or unsubstituted;

$R^3$ is alkyl, —C(O)O-alkyl, —C(O)O-aryl, —C(O)N-(alkyl)$_2$, —CN, —P(O)(O-alkyl)$_2$, cycloalkyl, aryl, or heterocyclyl, in each case substituted or unsubstituted, or H;

$R^4$ is present if ⋰ is a single bond and $R^4$ is alkyl, —C(O)O-alkyl, C(O)O-aryl, cycloalkyl, aryl, or heterocyclyl, in each case substituted or unsubstituted, or H;

or $R^3$ and $R^4$ together with the carbon atom in the compounds of the formula (I) linking $R^3$ and $R^4$ form a substituted or unsubstituted cycloalkyl or heterocyclyl;

$R^5$ is alkyl, —C(O)O-alkyl, cycloalkyl, aryl, or a heterocyclyl, in each case substituted or unsubstituted, or H;

or $R^4$ and $R^5$ together with the carbon atoms linking $R^4$ and $R^5$ with each other in the compounds of the formula (I) form a substituted or unsubstituted cycloalkyl or heterocyclyl;

or $R^1$ and $R^5$ together with the carbon atoms in the compounds of the formula (I) linking $R^1$ and $R^5$ form a substituted or unsubstituted cycloalkyl or heterocyclyl;

characterized in that compounds of the general formula (II)

II

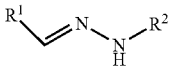

where $R^1$ and $R^2$ have the same definition as in the general formula (I) are reacted electrochemically in the presence of an iodide source with a compound of the formula (III) or (IV)

III

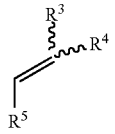

IV

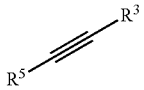

where $R^3$, $R^4$ and $R^5$ have the same definition as in the general formula (I).

Here, ⋰ represents a cis or trans isomer in compounds of formula (III), i.e. $R^3$ and $R^5$ may be in a cis or trans configuration to each other, or $R^4$ and $R^5$ are in a cis or trans configuration to each other.

In particular, the present invention relates to a process for preparing compounds of the general formula (I-a)

I-a

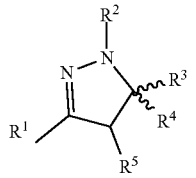

where $R^1$ is alkyl, —C(O)O-alkyl, cycloalkyl, aryl, or heterocyclyl, in each case substituted or unsubstituted;

$R^2$ is alkyl, —C(O)O-alkyl, cycloalkyl, aryl, or heterocyclyl, in each case substituted or unsubstituted;

$R^3$ is alkyl, —C(O)O-alkyl, —C(O)O-aryl, —C(O)N-(alkyl)$_2$, —CN, —P(O)(O-alkyl)$_2$, cycloalkyl, aryl, or heterocyclyl, in each case substituted or unsubstituted, or H;

$R^4$ is alkyl, —C(O)O-alkyl, —C(O)O-aryl, cycloalkyl, aryl, or heterocyclyl, in each case substituted or unsubstituted, or H;

or $R^3$ and $R^4$ together with the carbon atom in the compounds of the formula (I) linking $R^3$ and $R^4$ form a substituted or unsubstituted cycloalkyl or heterocyclyl;

$R^5$ is alkyl, —C(O)O-alkyl, cycloalkyl, aryl, or a heterocyclyl, in each case substituted or unsubstituted, or H;

or $R^4$ and $R^5$ together with the carbon atoms linking $R^4$ and $R^5$ with each other in the compounds of the formula (I) form a substituted or unsubstituted cycloalkyl or heterocyclyl;

or $R^1$ and $R^5$ together with the carbon atoms in the compounds of the formula (I) linking $R^1$ and R form a substituted or unsubstituted cycloalkyl or heterocyclyl;

characterized in that compounds of the general formula (II)

II

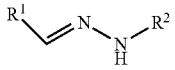

where $R^1$ and $R^2$ have the same definition as in the general formula (I-a) are reacted electrochemically in the presence of an iodide source with a compound of the formula (III)

III

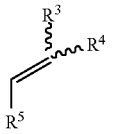

where $R^3$, $R^4$ and $R^5$ have the same definition as in the general formula (I).

The radicals alkyl, —C(O)O-alkyl, —C(O)N-(alkyl)$_2$, —C(O)O-aryl, cycloalkyl, aryl, or heterocyclyl for $R^1$ to $R^5$ may be each independently substituted with different substituents.

The present invention provides an electrochemical method for the direct synthesis of pyrazolines and pyrazoles from hydrazones and alkenes or alkynes. The substrates required for the reaction can be assembled from commodity chemicals by simple condensation reactions, creating a value addition chain that makes it possible to dispense with environmentally harmful transition metals and halogenating agents and also toxic solvents.

In this process, the iodide source is used efficiently in a dual function as conductive salt and mediator, so that hardly any costly reagent waste is produced. The products can be easily purified and the superstoichiometrically used reagents can be recycled, which further contributes to the economic efficiency and sustainability of the process. Accordingly, the present invention enables simple, efficient and sustainable electrochemical access to a library of synthetically relevant pyrazolines and pyrazoles.

Preferably, alone or in combination, $R^1$ is unsubstituted or substituted $C_1$-$C_6$-alkyl, unsubstituted or substituted —C(O)O($C_{1-8}$-alkyl), unsubstituted or substituted $C_3$-$C_{12}$-cycloalkyl, unsubstituted or substituted phenyl, unsubstituted or substituted naphthyl.

Preferably, alone or in combination, $R^2$ is unsubstituted or substituted $C_1$-$C_6$-alkyl, unsubstituted or substituted —C(O)O($C_{1-8}$-alkyl), unsubstituted or substituted $C_3$-$C_{12}$-cycloalkyl, unsubstituted or substituted phenyl.

Preferably, alone or in combination, $R^3$ is H, unsubstituted or substituted $C_1$-$C_6$-alkyl, unsubstituted or substituted —C(O)O($C_{1-8}$-alkyl), unsubstituted or substituted —C(O)O-phenyl, unsubstituted or substituted —C(O)O-benzyl, unsubstituted or substituted $C_3$-$C_{12}$-cycloalkyl, unsubstituted or substituted phenyl, unsubstituted or substituted naphthyl.

Preferably, if ⋰ is a single bond, alone or in combination, $R^4$ is H, unsubstituted or substituted $C_1$-$C_6$-alkyl, unsubstituted or substituted —C(O)O($C_{1-8}$-alkyl), unsubstituted or substituted —C(O)O-phenyl, unsubstituted or substituted —C(O)O-benzyl, unsubstituted or substituted $C_3$-$C_{12}$-cycloalkyl, unsubstituted or substituted phenyl.

Alternatively, $R^3$ and $R^4$ together with the carbon atom in the compounds of formula (I) linking $R^3$ and $R^4$ may preferably form a substituted $C_3$-$C_{12}$-cycloalkyl or heterocyclyl.

Preferably, alone or in combination, $R^5$ is H, unsubstituted or substituted $C_1$-$C_6$-alkyl, unsubstituted or substituted —C(O)O($C_{1-8}$-alkyl), $C_3$-$C_{12}$-cycloalkyl, substituted or unsubstituted phenyl.

Alternatively, $R^1$ and $R^5$ together with the carbon atoms in the compounds of formula (I) linking $R^3$ and $R^5$ may preferably form a substituted $C_3$-$C_{12}$-cycloalkyl or heterocyclyl.

Alternatively, $R^4$ and $R^5$ together with the carbon atoms linking $R^4$ and $R^5$ with each other preferably form a $C_3$-$C_{12}$ cycloalkyl or heterocyclyl.

If $R^1$ and $R^5$ form a ring system, preferably no ring system is formed by $R^3$ and $R^4$, and vice versa.

Further preferably, alone or in combination, $R^1$ is $C_1$-$C_4$-alkyl, —C(O)O($C_{1-4}$-alkyl), $C_3$-$C_8$-cycloalkyl, phenyl, phenyl mono- or polysubstituted by $C_1$-$C_4$-alkyl, phenyl mono- or polysubstituted by halogen, phenyl mono- or polysubstituted by nitro, phenyl mono- or polysubstituted by cyano, phenyl mono- or polysubstituted by —C(O)O($C_{1-4}$-alkyl), or naphthyl.

In particular, $R^1$ may be —C(O)OCH$_2$CH$_3$.

Further preferably, alone or in combination, $R^2$ is $C_1$-$C_4$-alkyl, —C(O)O($C_{1-4}$-alkyl), $C_3$-$C_8$-cycloalkyl, phenyl, phenyl mono- or polysubstituted by $C_1$-$C_4$-alkyl, phenyl mono- or polysubstituted by halogen, phenyl mono- or polysubstituted by nitro, phenyl mono- or polysubstituted by cyano, phenyl mono- or polysubstituted by —C(O)O($C_{1-4}$-alkyl), mono- or polysulfo-substituted phenyl, or naphthyl.

In particular, $R^2$ may be a dichlorophenyl.

Further preferably, alone or in combination, $R^3$ is $C_1$-$C_4$-alkyl, —C(O)O($C_{1-4}$-alkyl), $C_3$-$C_8$-cycloalkyl, phenyl, phenyl mono- or polysubstituted by $C_1$-$C_4$-alkyl, phenyl mono- or polysubstituted by halogen, phenyl mono- or polysubstituted by nitro, phenyl mono- or polysubstituted by cyano, phenyl mono- or polysubstituted by —C(O)O($C_{1-4}$-alkyl), or naphthyl.

In particular, $R^3$ may be $CH_3$.

Further preferably, if ⋰ is a single bond, alone or in combination, $R^4$ is H, $C_1$-$C_4$-alkyl, —C(O)O($C_{1-4}$-alkyl), —C(O)O-benzyl mono- or polysubstituted by $C_1$-$C_4$-alkyl, C(O)O-phenyl mono- or polysubstituted by $C_1$-$C_4$-alkyl, $C_3$-$C_8$-cycloalkyl, phenyl, phenyl mono- or polysubstituted by $C_1$-$C_4$-alkyl, phenyl mono- or polysubstituted by halogen, phenyl mono- or polysubtituted by nitro, phenyl mono- or polysubtituted by cyano, or phenyl mono- or polysubstituted by —C(O)O($C_{1-4}$-alkyl).

In particular, $R^4$ may be —C(O)O($C_{1-4}$-alkyl)), C(O)O-benzyl mono- or polysubstituted by $C_1$-$C_4$-alkyl, or C(O)O-phenyl mono- or polysubstituted by $C_1$-$C_4$-alkyl.

Further preferably, $R^4$ may be —C(O)OCH$_2$CH$_3$.

Further preferably, alone or in combination, $R^5$ is H, $C_1$-$C_4$-alkyl, —C(O)O($C_{1-4}$-alkyl), $C_3$-$C_{10}$-cycloalkyl, phenyl, phenyl mono- or polysubstituted by $C_1$-$C_4$-alkyl, phenyl mono- or polysubstituted by halogen, phenyl mono- or polysubstituted by nitro, phenyl mono- or polysubstituted by cyano, or phenyl mono- or polysubstituted by —C(O)O($C_{1-4}$-alkyl).

In particular, $R^5$ may be H.

The iodide source is preferably used in the form of sodium iodide, lithium iodide or potassium iodide or a mixture thereof.

The use of sodium iodide, lithium iodide or potassium iodide in the dual role of mediator and conductive salt conserves resources and enables efficient and simple recycling. In contrast, the electrochemical methods known in the prior art require a higher material input due to the separate roles of electrochemical mediator and conductive salt, which is a barrier to economic efficiency of the known methods.

Particular preference is given to sodium iodide.

The iodide source may be in aqueous solution, in an organic solvent, in a solvent mixture of two or more organic solvents, or in a biphasic mixture of an aqueous solution and an organic solvent or solvent mixture of two or more organic solvents.

In one embodiment of the present invention, the iodide source is present in a biphasic mixture of aqueous solution and an organic solvent or solvent mixture of two or more organic solvents. Here, the iodide source is used at a concentration of 0.2 to 2.0M, based on the aqueous solution; more preferably at a concentration of 0.5 to 1.4M, based on the aqueous solution; especially at a concentration of 0.8 to 1.4M, based on the aqueous solution. The organic solvent is preferably selected here from ethyl acetate, tert-butyl methyl ether, dichloromethane, chlorobenzene, 1,2-dichloroethane or mixtures thereof. Particular preference is given to ethyl acetate and/or tert-butyl methyl ether as organic solvent.

In an alternative embodiment, the iodide source is in aqueous solution without addition of an organic solvent. Here, the iodide source is used at a concentration of 0.2 to 2.0M, based on the aqueous solution; more preferably at a concentration of 0.5 to 1.4M, based on the aqueous solution; especially at a concentration of 0.8 to 1.4M, based on the aqueous solution.

In a further alternative embodiment, the iodide source is present in an organic solvent or a solvent mixture of two or more organic solvents without addition of water. Here, the iodide source is used at a concentration of 0.2 to 4.0M, based on the organic solvent or solvent mixture; more preferably at a concentration of 0.5 to 3.5M, based on the organic solvent or solvent mixture; especially at a concentration of 0.8 to 3.0M, based on the organic solvent or solvent mixture. The organic solvent is preferably selected here from ethanol, acetonitrile, ethyl acetate, tert-butyl methyl ether, dichloromethane, chlorobenzene, 1,2-dichloroethane or mixtures thereof. A mixture of ethanol and acetonitrile is particularly preferred as organic solvent mixture, preferably in a mixing ratio from 1:10 to 10:1, more preferably 1:5 to 5:1, particularly preferably 1:2 to 2:1 (vol/vol).

The compound (III) or (IV) is preferably used in amounts between 1.0 and 6.0 equivalents, based on the total amount of substance of the compounds of the formula (II) used, more preferably between 2.0 and 5.0 equivalents.

The reaction is preferably carried out in an undivided electrolytic cell.

Graphite electrodes are preferably used as anode and cathode.

The process according to the invention is therefore cost-effective with respect to the electrode material and the construction in a simple cell.

Preference is given to using isostatic graphite.

The process is preferably carried out at a current density of 20 to 50 mA/cm$^2$, preferably 30 to 40 mA/cm$^2$.

The process is preferably carried out until an applied amount of charge of 1 to 1° F., preferably 2 to 6F is reached.

The reaction is preferably carried out at a temperature of 10 to 50° C., preferably at 20 to 40° C.

These reaction conditions improve the yield of the pyrazole or pyrazoline.

Preferably, the aqueous phase, if used, is then separated and freeze dried to recover the iodide source.

Alternatively, the aqueous phase may be separated off and used without further processing for carrying out a further reaction step or process according to the present invention.

The recycling of the iodide source or the aqueous phase allows the compounds to be produced in a particularly environmentally friendly manner.

The compound (I) or (I-a) is preferably diethyl 1-(2,4-dichlorophenyl)-5-methyl-4,5-dihydro-1H-pyrazole-3,5-dicarboxylate (mefenpyr-diethyl), the compound (II) is ethyl 2-(2-(2,4-dichlorophenyl)hydrazono)acetate; and the compound (III) is ethyl methacrylate, where $R^1$ is —C(O)O-ethyl;

$R^2$ is 2,4-dichlorophenyl;

$R^3$ is $CH_3$;

$R^4$ is —C(O)O-ethyl;

$R^5$ is H.

Compounds of the formula (II) can generally be present as a racemate or as (E) or (Z) isomers, i.e.

II-a

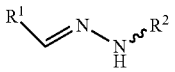

where ⁓ represents a cis or trans isomer.

One of the isomers can preferably be reacted in the process according to the invention. In this respect, in further configurations of the present invention, the yield of the synthesis can be increased by using one of the possible isomers of the general formula (II-a).

The compound (I) or (I-a) is particularly preferably diethyl 1-(2,4-dichlorophenyl)-5-methyl-4,5-dihydro-1H-pyrazole-3,5-dicarboxylate (mefenpyr-diethyl), the compound (II) is (Z)-ethyl glyoxylate 2,5-dichlorophenyl hydrazone; and the compound (III) is ethyl methacrylate, where $R^1$ is —C(O)O-ethyl;

$R^2$ is 2,4-dichlorophenyl;

$R^3$ is $CH_3$;

$R^4$ is —C(O)O-ethyl;

$R^5$ is H.

DETAILED DESCRIPTION OF THE INVENTION

The process according to the invention allows the reaction to proceed efficiently in a biphasic solvent system composed of water and an organic solvent. Here, an iodide source, preferably sodium iodide, is used on the one hand as a conductive salt and on the other hand as an electrochemical mediator.

Carrying out the reaction in an undivided electrolytic cell under galvanostatic operation with a simple cell structure (two-electrode arrangement) enables scalable reaction conditions. The possibility of recycling the mediator and the unreacted excess dipolarophile contributes to the sustainability and economic viability of the process.

In particular, high yields of the herbicide safener mefenpyr-diethyl of 73% could be achieved using the process according to the invention.

The terms used here are known to the person skilled in the art. Otherwise, the following definitions are used:

In the context of the present invention, the term "alkyl" encompasses saturated hydrocarbon radicals which may be branched or straight-chain and unsubstituted or at least monosubstituted. Examples of suitable alkyl radicals, which may be unsubstituted or mono- or polysubstituted, are methyl, ethyl, n-propyl, isopropyl, n-butyl, isobutyl, 2-butyl, tert-butyl, n-pentyl, 2-pentyl, 3-pentyl, isopentyl, neopentyl, n-hexyl, 2-hexyl, 3-hexyl, n-heptyl, n-octyl, —C(H)(C2H5)2, —C(H)(n-C3H7)2 and —CH2-CH2-C(H)(CH3)-(CH2)3-CH3.

The term "cycloalkyl" means an optionally substituted carbocyclic saturated ring system having preferably 3-12, more preferably 3-8 ring carbon atoms, for example cyclopropyl, cyclobutyl, cyclopentyl or cyclohexyl. In the case of optionally substituted cycloalkyl, cyclic systems with substituents are included, also including substituents with a double bond on the cycloalkyl radical, for example an alkylidene group such as methylidene. In the case of optionally substituted cycloalkyl, polycyclic aliphatic systems are also included, for example bicyclo[1.1.0]butan-1-yl, bicyclo[1.1.0]butan-2-yl, bicyclo[2.1.0]pentan-1-yl, bicyclo[2.1.0]pentan-2-yl, bicyclo[2.1.0]pentan-5-yl, bicyclo[2.2.1]hept-2-yl (norbornyl), bicyclo[2.2.2]octan-2-yl, adamantan-1-yl and adamantan-2-yl.

In the case of substituted cycloalkyl, spirocyclic aliphatic systems are also included, for example spiro[2.2]pent-1-yl, spiro[2.3]hex-1-yl, spiro[2.3]hex-4-yl, 3-spiro[2.3]hex-5-yl.

In the context of the present invention, the term "aryl" means a mono- or polycyclic, preferably a mono- or bicyclic, aromatic hydrocarbon radical having preferably 6, 10 or 14 carbon atoms. An aryl radical may be unsubstituted or monosubstituted or polysubstituted, by identical or different substituents. Examples of suitable aryl radicals are phenyl, 1-naphthyl, 2-naphthyl and anthracenyl.

In the context of the present invention, the term "heterocyclyl" means a mono- or polycyclic system having 3 to 20 ring atoms, preferably 3 to 14 ring atoms, particularly preferably 3 to 10 ring atoms, comprising carbon atoms and 1, 2, 3, 4 or 5 heteroatoms, in particular nitrogen, oxygen and/or sulfur, where the heteroatoms may be identical or different. The cyclic system may be saturated or mono- or polyunsaturated. The term "heterocyclyl" encompasses aliphatic and aromatic ring systems (heteroaryls) and combinations thereof, i.e. also those systems in which an aromatic ring is part of a bi- or polycyclic saturated, partially unsaturated and/or aromatic system.

Examples of suitable heterocycles are pyrrolidinyl, thiapyrrolidinyl, piperidinyl, piperazinyl, oxapiperazinyl, oxapiperidinyl, oxadiazolyl, tetrahydrofuryl, imidazolidinyl, thiazolidinyl, tetrahydropyranyl, morpholinyl, tetrahydrothiophenyl, dihydropyranyl.

Examples of suitable heteroaryl radicals include indolizinyl, benzimidazolyl, tetrazolyl, triazinyl, isoxazolyl, phthalazinyl, carbazolyl, carbolinyl, diazanaphthyl, thienyl, furyl, pyrrolyl, pyrazolyl, pyrazinyl, pyranyl, triazolyl, pyridinyl, imidazolyl, indolyl, isoindolyl, benzo[b]furanyl, benzo[b]thiophenyl, benzo[d]thiazolyl, benzodiazolyl, benzotriazolyl, benzoxazolyl, benzisoxazolyl, thiazolyl, thiadiazolyl, oxazolyl, oxadiazolyl, isoxazolyl, pyridazinyl, pyrimidinyl, indazolyl, quinoxalinyl, quinazolinyl, quinolinyl, naphthridinyl and isoquinolinyl.

Examples of aryl radicals that are fused with a mono- or bicyclic ring system and are also covered by the term "heterocycle" or "heterocyclyl" include (2,3)-dihydrobenzo[b]thiophenyl, (2,3)-dihydro-1H-indenyl, indolinyl, (2,3)-dihydrobenzofuranyl, (2,3)-dihydrobenzo[d]oxazolyl, benzo[d][1,3]dioxolyl, benzo[d][1,3]oxathiolyl, isoindolinyl, (1,3)-dihydroisobenzofuranyl, (1,3)-dihydrobenzo[c]thiophenyl, (1,2,3,4)-tetrahydronaphthyl, (1,2,3,4)-tetrahydroquinolinyl, chromanyl, thiochromanyl, (1,2,3,4)-tetrahydroisoquinolinyl, (1,2,3,4)-tetrahydroquinoxalinyl, (3,4)-dihydro-2H-benzo[b][1,4]oxazinyl, (3,4)-dihydro-2H-benzo[b][1,4]thiazinyl, (2,3)-dihydrobenzo[b][1,4]dioxinyl, (2,3)-dihydrobenzo[b][1,4]oxathiinyl, (6,7,8,9)-tetrahydro-5H-benzo[7]annulenyl, (2,3,4,5)-tetrahydro-1H-benzo[b]azepinyl and (2,3,4,5)-tetrahydro-1H-benzo[c]azepinyl.

If one of the aforementioned radicals is mono- or polysubstituted, suitable substituents are all those familiar to the person skilled in the art, preferably those which are each independently selected from the group consisting of F, Cl, Br, I, —$NO_2$, —CN, —OH, —SH, —$NH_2$, —O-alkyl, -phenyl, -benzyl, alkyl-substituted phenyl or benzyl, —N($C_{1-5}$-alkyl)$_2$, —N($C_{1-5}$-alkyl)(phenyl), —N($C_{1-5}$-alkyl)($CH_2$-phenyl), —N($C_{1-5}$-alkyl)($CH_2$—$CH_2$-phenyl), —NH—C(=O)—O—$C_{1-5}$-alkyl, —C(=O)—H, —C(=O)—$C_{1-5}$-alkyl, —C(=O)-phenyl, —C(=S)—$C_{1-5}$-alkyl, —C(=S)-phenyl, —C(=O)—OH, —C(=O)—

O—$C_{1-5}$-alkyl, —C(=O)—O-phenyl, —C(=O)—$NH_2$, —C(=O)—NH—$C_{1-5}$-alkyl, —C(=O)—N($C_{1-5}$-alkyl)$_2$, —S(=O)—$C_{1-5}$-alkyl, —S(=O)-phenyl, —S(=O)$_2$—$C_{1-5}$-alkyl, —S(=O)$_2$-phenyl, —S(=O)$_2$—$NH_2$, —$SO_3H$ and —Si($C_{1-5}$-alkyl).

EXAMPLES

The following examples illustrate the present invention, but without restricting it.

Starting Materials and Protocols:

Analytical grade chemicals were sourced from common suppliers such as TCI, Aldrich and Acros and used.

The hydrazones used in the electrosynthesis were prepared from the corresponding aldehydes and hydrazines or hydrazine hydrochlorides according to synthetic procedures known from the literature (P. G. Baraldi, S. Baraldi, G. Saponaro, M. Aghazadeh Tabrizi, R. Romagnoli, E. Ruggiero, F. Vincenzi, P A Borea, K Varani, Journal of Medicinal Chemistry 2015, 58, 5355-5360, W. Wu, X. Yuan, J. Hu, X. Wu, Y. Wei, Z. Liu, J. Lu, J. Ye, Organic Letters 2013, 15, 4524-4527).

Isostatic graphite (Cgr, Sigrafine™ V2100, SGL Carbon, Bonn, Germany) was used as electrode material. Before carrying out any experiment, these were treated with sandpaper (grain size 1000+1200, Bosch, Stuttgart, Germany) and the surface was then cleaned with a paper towel.

Liquid chromatography was carried out on silica gel 60 M (40-63 m, Machery-Nagel GmbH & Co., Düren, Germany) using a Buchi Sepacore system and Buchi Control Unit C 620, Buchi UV photometer C 635, Buchi fraction collector C 660 and two Büchi Pump Modules C 605 (Büchi-Labortechnik GmbH, Essen, Germany) or using a PURIFLASH C18-HP 30 UM F0080 packed silica column (Interchim, Montlugon Cedex, France) with the Buchi Sepacore system described above.

High-performance liquid chromatography was carried out on a Shimadzu HPLC-MS with a SIL 20A HT autosampler, a CTO-20AC column oven, two LC-20AD pump modules for setting the eluent gradient, a diode array detector SPD-M20A, a CBM-20A system controller, and a Eurospher II 100-5 C18 column (150×4 mm, Knauer, Berlin). Mobile phase: acetonitrile/water or acetonitrile/water/formic acid (1% by volume).

NMR spectrometry of 1H-NMR, 13C-NMR, 15N-NMR, 19F-NMR and 31P-NMR spectra, and all 2D NMR spectra were recorded at 25° C. with a Bruker Avance II HD 300 or Bruker Avance III HD 400 (400 MHz, 5 mm BBFO head with z-gradient and ATM, SampleXPress 60 sample changer, Analytische Messtechnik, Karlsruhe, Germany) in CDCl3, DMSO-d6, CD2Cl2, CD3CN, (CD3)2CO or CD30D. 1H- and 13C-NMR spectra were referenced to the residual solvent signal.

Electrospray ionization (ESI+/−) or atmospheric pressure chemical ionization (APCI+/−) mass spectrometry were performed using an Agilant 6545 QTOF-MS (Agilant, Santa Clara (CA), USA).

The electrolyses were carried out in temperature-controllable double-jacketed glass cells (SynLectro™ Merck KGaA, Darmstadt, Germany) with a cross-shaped stirrer. Upscaling experiments were carried out in a 300 ml double-jacketed glass cell. Galvanostats from the TDK-Lambda Z+ series (TDK-Lambda UK Limited, Devon, UK) were used as current source.

Two synthetic methods according to the invention were used, variant A and B, which are elucidated below:

Synthetic Method Variant A

A hydrazone (3 mmol, 1 eq.) and the appropriate alkene or alkyne (8.1 mmol, 2.7 eq.) were initially charged in a 50 ml beaker electrolytic cell with a temperature-controlled jacket and a cross-shaped magnetic stirring bar. Ethyl acetate (5 ml) and 1M aqueous sodium iodide solution (20 ml) were added. Galvanostatic electrolysis at 35 mA/cm$^2$ was carried out on isostatic graphite (60×20×3 mm, immersion depth 2.7 cm, active electrode area 5.4 cm$^2$) as anode and cathode at 25° C. and a stirring speed of 1000 rpm until an applied amount of charge of 5F (1447C) was reached. The biphasic mixture was then transferred to a separating funnel and the phases were separated. The aqueous phase was extracted with ethyl acetate (1×30 ml), and the combined organic phases were dried over magnesium sulfate, filtered and freed from solvent under reduced pressure. Further purification was carried out by column chromatography.

Synthetic Method Variant B

A hydrazone (3.2 mmol, 1 eq.) and the appropriate alkene or alkyne (12.5 mmol, 3.9 eq.) were initially charged in a 50 ml beaker electrolytic cell with a temperature-controlled jacket and a cross-shaped magnetic stirring bar. Tert-butyl methyl ether (5 ml) and 1M aqueous sodium iodide solution (20 ml) were added. Galvanostatic electrolysis at 32.1 mA/cm$^2$ was carried out on isostatic graphite (60×20×3 mm, immersion depth 2.7 cm, active electrode area 5.4 cm$^2$) as anode and cathode at 32° C. and a stirring speed of 1000 rpm until an applied amount of charge of 2.58F (797C) was reached. The biphasic mixture was then transferred to a separating funnel and the phases were separated. The aqueous phase was extracted with ethyl acetate (1×30 ml), and the combined organic phases were dried over magnesium sulfate, filtered and freed from solvent under reduced pressure. Further purification was carried out by column chromatography.

Synthetic Products

In accordance with the synthetic method variant A according to the invention, the agrochemically relevant herbicide safener mefenpyr-diethyl was successfully produced in a very good yield of 73% (scheme 1).

Scheme 1: Preparation of mefenpyr diethyl.

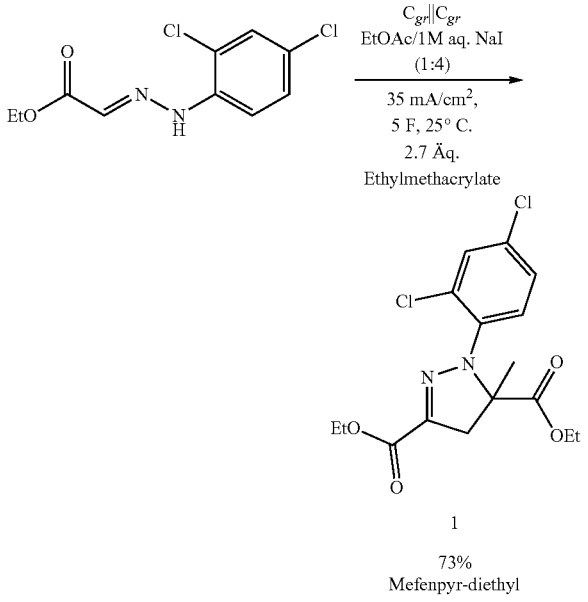

Also according to synthetic method variant A according to the invention, ethyl glyoxalate phenylhydrazone was reacted with various alkenes and alkynes to give the corresponding pyrazolines or pyrazoles (see scheme 2). In particular, polymerization-sensitive alkenes such as styrene (2), acrylates (12, 13, 14), acrylonitrile (15) and acrylamide (16) can be used in the process according to the invention. Also, silyl group-bearing alkenes (27) and vinylphosphonates (11), and also various cycloaliphatics (22-25) can be successfully reacted. Tolerance to halogens could also be demonstrated by derivative 29. The results are compiled in Scheme 2.

Analogously, various benzaldehyde-based hydrazones and derivatives of aliphatic aldehydes were converted to the corresponding pyrazoles and pyrazolines by synthetic method variant B according to the invention (Scheme 3). In particular, comparatively electron-deficient benzaldehyde derivatives could be obtained in good yields. The p-nitro derivative (44) could also be prepared in 53% yield. An intramolecular cyclization of a comparatively electron-rich derivative was also achieved in a good yield of 53%. In addition to various aromatic aldehydes, aliphatic aldehydes could also be converted. The corresponding pyrazolines were obtained in 23-38% yields. The results are compiled in Scheme 3.

Furthermore, the application of the reaction according to synthetic method variant A and B according to the invention was tested on hydrazones derived from various hydrazines with styrene as the dipolarophile (Scheme 4). Here, both electron-poor and electron-rich hydrazones could be converted in yields of up to 93% (Example 54). The results are compiled in Scheme 4.

Scheme 2:
Reaction of various dipolarophiles with ethyl glyoxalate phenylhydrazone.

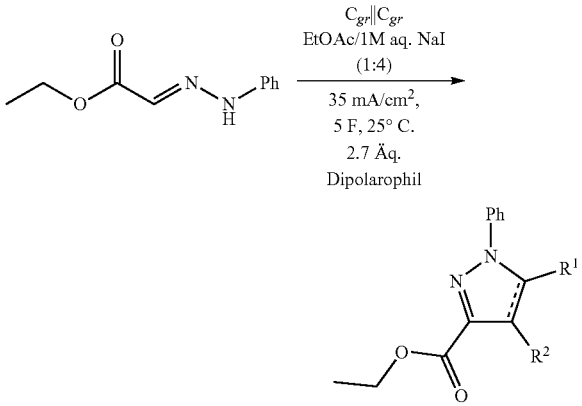

2

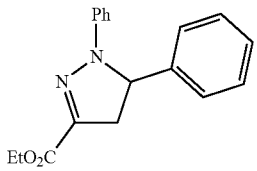

77%[a]

-continued

3

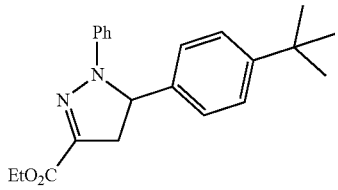

70%

4

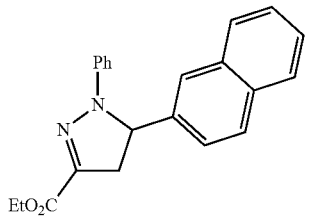

45%

5

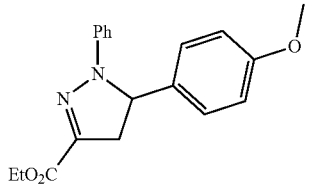

45%

6

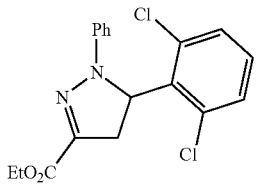

59%

7

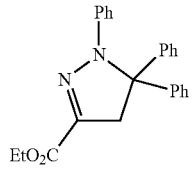

29%

8

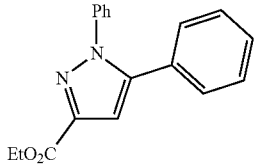

25%[a]

9

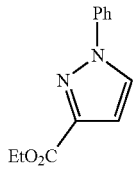

32%[b]

-continued
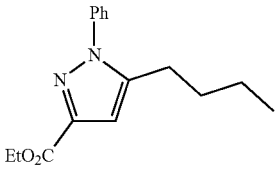
9%[c]
11
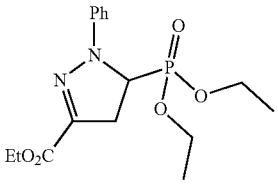
44%
12
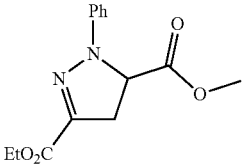
89%[a]
13
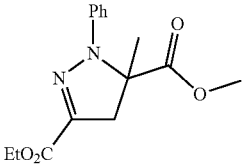
81%
14
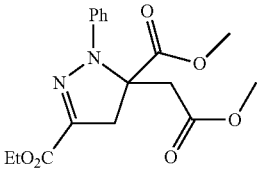
91%
15
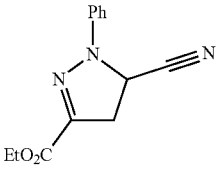
90%
16
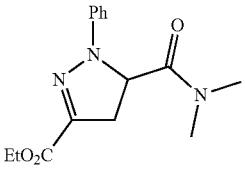
58%
-continued
17
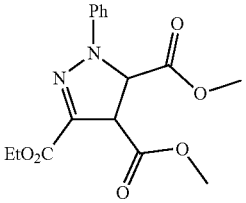
66%
cis/trans 1.9:1
18
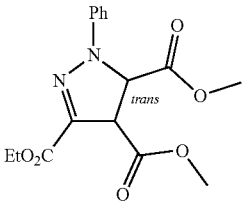
70%
19
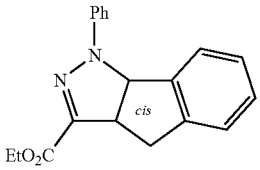
52%
20
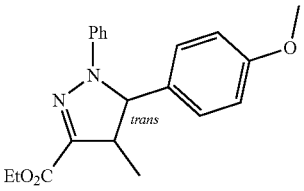
16%
21
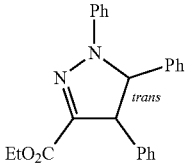
9%[a]
22
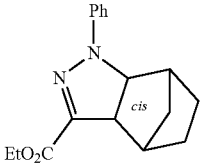
91%[a]

-continued
23
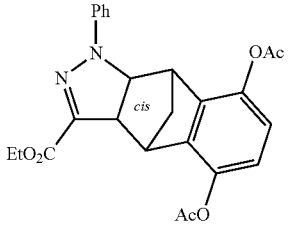
81%
24
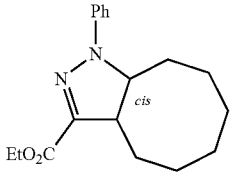
34%
25
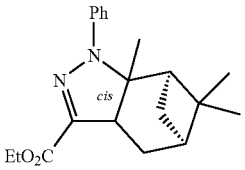
4%
26
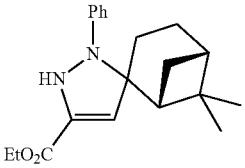
7%
27
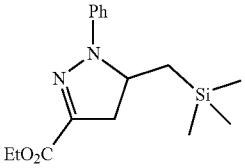
34%
28
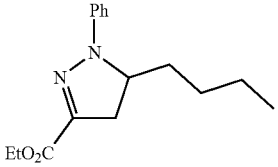
32%
29
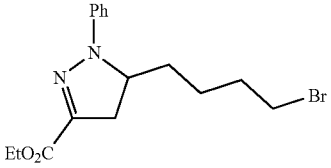
33%
-continued
30
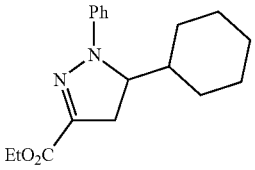
28%
31
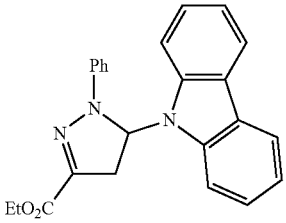
56%
Scheme 3:
Product range of the various benzaldehyde-based pyrazolines.
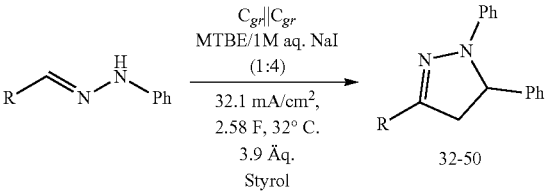
32
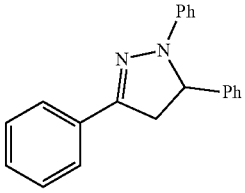
74%
33
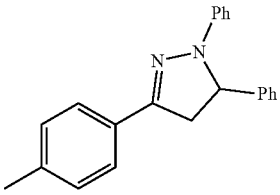
67%
34
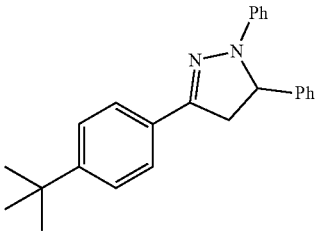
25%

-continued
35
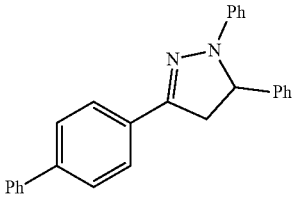
20%
36
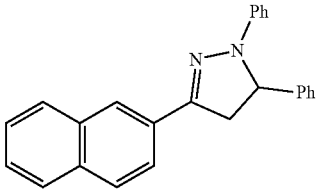
25%
37
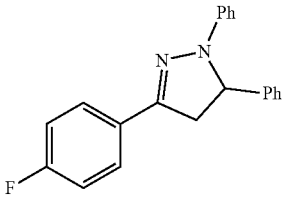
76%
38
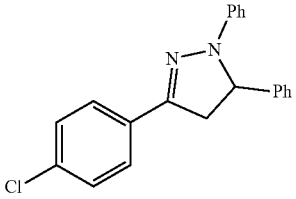
70%
39
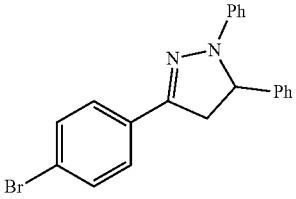
61%
40
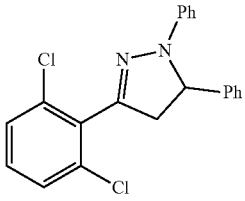
81%
-continued
41
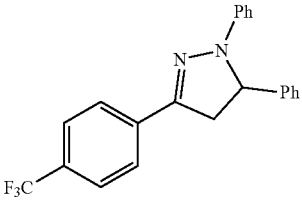
38%
42
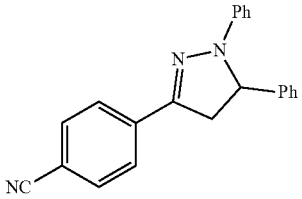
56%
43
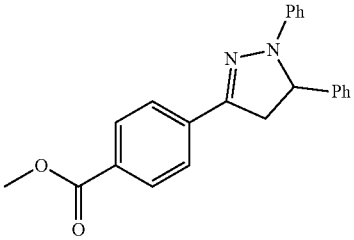
72%
44
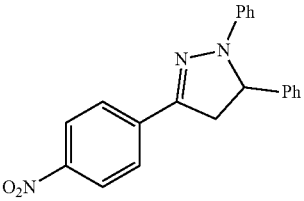
53%
45
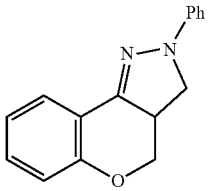
56%[a]
46
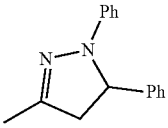
38%[b]

-continued
47
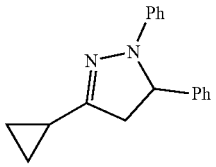
23%[c]
48
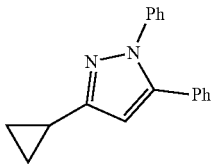
8%[c,d]
49
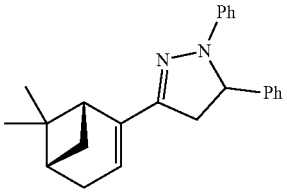
24%[e]
50
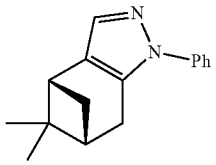
17%[e,f]
Scheme 4:
Product range of the various hydrazine derivatives.
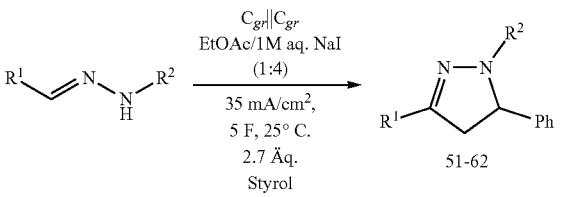
51
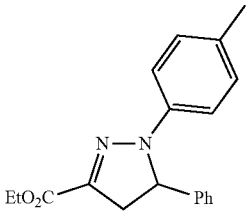
56%
-continued
52
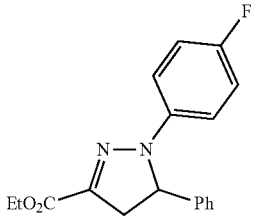
86%
53
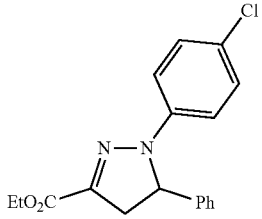
88%
54
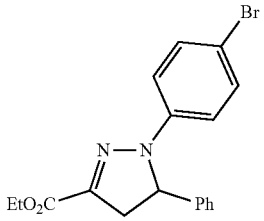
93%
55
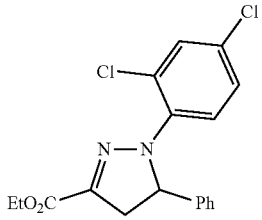
84%
56
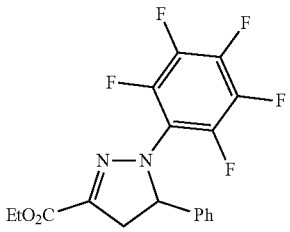
25%

-continued

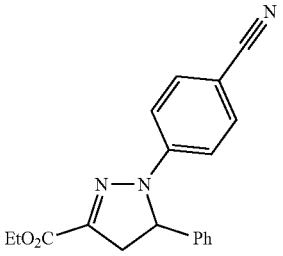

90%

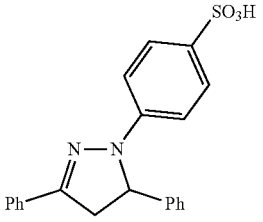

Spuren[a]

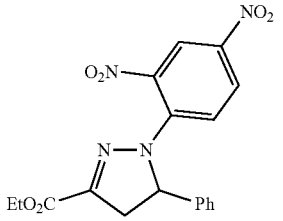

29%[b]

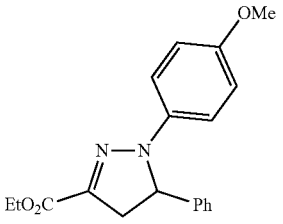

53%

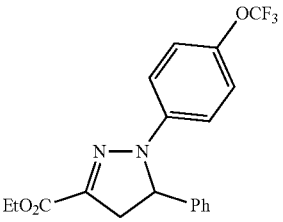

33%

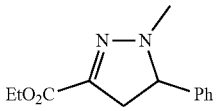

24%[a]

The individual syntheses of Schemes 1 to 4 are described in detail below.

Example 1: Diethyl 1-(2,4-dichlorphenyl)-5-methyl-4,5-dihydro-1H-pyrazole-3,5-dicarboxylate (mefenpyr-diethyl)

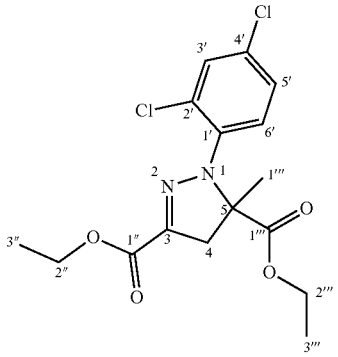

Synthesis according to synthetic method variant using ethyl 2-(2-(2,4-dichlorophenyl)hydrazono)acetate (3 mmol, 783 mg, 1 eq.) and ethyl methacrylate (8.1 mmol, 925 mg, 2.7 eq.). After flash column chromatography on silica with cyclohexane/ethyl acetate (0%-4% EtOAc), the pyrazoline was obtained as an orange oil (2.28 mmol, 820 mg, 73%).

$^{1}$H-NMR (400 MHz, $CDCl_3$), δ/ppm: 7.41 (d, J=2.1 Hz, 1H, H-3'), 7.25-7.19 (m, 2H, H-5', H-6'), 4.33 (qd, J=7.2, 1.7 Hz, 2H, H-2''), 4.19 (q, J=7.2 Hz, 2H, H-2'''), 3.73 (d, J=17.7 Hz, 1H, (H-4)'), 3.12 (d, J=17.7 Hz, 1H, (H-4)''), 1.46 (s, 3H, H-1''''), 1.35 (t, J=7.1 Hz, 3H, H-3''), 1.24 (t, J=7.1 Hz, 3H, H-3''').

$^{13}$C-NMR (101 MHz, $CDCl_3$), δ/ppm: 171.5, 162.3, 140.1, 138.0, 133.6, 133.4, 130.5, 130.2, 127.5, 73.6, 62.3, 61.5, 45.1, 22.1, 14.5, 14.1.

HRMS (ESI+), m/z: calculated for $[C_{16}H_{18}{}^{35}Cl_2N_2O_4+H]^+$ 373.0716, found 373.0718; calculated for $[C_{16}H_{18}{}^{53}Cl^{37}ClN_2O_4+H]^+$ 375.0690, found 375.0692; calculated for $[C_{16}H_{18}{}^{37}Cl_2N_2O_4+H]^+$ 377.0669, found 377.0674.

Example 2: Ethyl 1,5-diphenyl-4,5-dihydro-1H-pyrazole-3-carboxylate

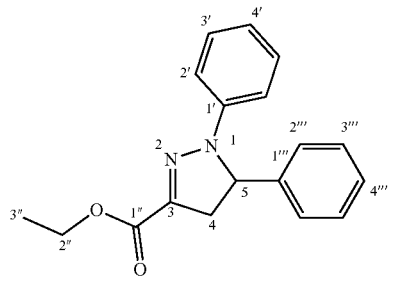

Synthesis according to synthetic method variant A using ethyl 2-(2-phenylhydrazono)acetate (3.9 mmol, 750 mg, 1 eq.) and styrene (10.5 mmol, 1097 mg, 2.7 eq.). A charge of 5.4F (2032C) was applied. After flash column chromatography on silica with cyclohexane/ethyl acetate (0%→3% EtOAc), the pyrazoline was obtained as a yellow solid (3.02 mmol, 890 mg, 77%).

$^{1}$H-NMR (400 MHz, $CDCl_3$), δ/ppm: 7.35-7.16 (m, 7H, H-3', H-2''', H-3''', H-4'''), 7.10 (dt, J=7.9, 1.3 Hz, 2H, H-2'), 6.87 (tt, J=7.2, 1.2 Hz, 1H, H-4'), 5.42 (dd, J=13.3, 7.0 Hz, 1H, H-5), 4.34 (q, J=7.1 Hz, 2H, H-2''), 3.72 (dd, J=18.0, 13.3 Hz, 1H, (H-4)'), 3.05 (dd, J=18.0, 7.0 Hz, 1H, (H-4)''), 1.37 (t, J=7.1 Hz, 3H, H-3'').

$^{13}$C-NMR (101 MHz, $CDCl_3$), δ/ppm: 162.9, 142.7, 141.3, 138.3, 129.4, 129.1, 128.1, 125.8, 121.4, 114.7, 65.5, 61.4, 42.4, 14.5.

HRMS (APCI+), m/z: calculated for $[C_{18}H_{18}N_2O_2+H]^+$ 295.1441, found 295.1447.

Recycling of Sodium Iodide:

Synthesis according to synthetic method variant A using ethyl 2-(2-phenylhydrazono)acetate (3 mmol, 577 mg, 1 eq.) and styrene (8.1 mmol, 844 mg, 2.7 eq.). Sodium iodide recovered from the reaction mixture of the synthesis of pyrazoline 32 by freeze-drying the aqueous phase was used. After flash column chromatography on silica with cyclohexane/ethyl acetate (0%-3% EtOAc), the pyrazoline was obtained as a yellow solid (2.40 mmol, 707 mg, 80%).

Scale-up (47 mmol):

Analogously to synthetic method variant A, ethyl 2-(2-phenylhydrazono)acetate (46.8 mmol, 9.0 g, 1 eq.) and styrene (126.3 mmol, 13.16 g, 2.7 eq.) were initially charged in a 300 ml beaker cell with temperature control jacket and a magnetic stirring bar with stabilization ring. Ethyl acetate (60 ml) and 1 M aqueous sodium iodide solution (240 ml) were added. Galvanostatic electrolysis at 35 mA/cm$^2$ was carried out on a bipolar electrode stack composed of four sheets of isostatic graphite (each 100×50×5 mm, immersion depth 7 cm, active electrode area 105 cm$^2$ in total) at 25° C. and a stirring speed of 750 rpm until an applied amount of charge of 5.4 F was reached (24 488 C). The biphasic mixture was transferred to a separating funnel, the phases were separated and the aqueous phase was extracted with ethyl acetate (1×100 ml). The combined organic phases were dried over magnesium sulfate, filtered and freed from solvent under reduced pressure. After flash column chromatography on silica with cyclohexane/ethyl acetate (0%→3% EtOAc), the pyrazoline was obtained as a yellow solid (36.0 mmol, 10.6 g, 77%).

Example 3: Ethyl 5-(4-(tert-butyl)phenyl)-1-phenyl-4,5-dihydro-1H-pyrazole-3-carboxylate

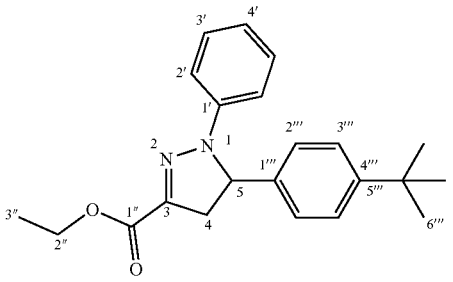

Synthesis according to synthetic method variant A using ethyl 2-(2-phenylhydrazono)acetate (3 mmol, 577 mg, 1 eq.) and 4-tert-butylstyrene (8.1 mmol, 1298 mg, 2.7 eq.). After flash column chromatography on silica with cyclohexane/ethyl acetate (0%→3% EtOAc), the pyrazoline was obtained as a yellow solid (2.10 mmol, 735 mg, 70%).

$^{1}$H-NMR (400 MHz, $CDCl_3$), δ/ppm: 7.36-7.33 (m, 2H, H-2'''), 7.21-7.12 (m, 6H, H-2', H-3', H-3'''), 6.88 (tt, J=7.1, 1.3 Hz, 1H, H-4'), 5.40 (dd, J=13.2, 6.9 Hz, 1H, H-5), 4.34 (q, J=7.1 Hz, 2H, H-2''), 3.70 (dd, J=18.0, 13.3 Hz, 1H, (H-4)'), 3.05 (dd, J=18.0, 6.9 Hz, 1H, (H-4)''), 1.38 (t, J=7.1 Hz, 3H, H-3''), 1.30 (s, 9H, H-6''').

$^{13}$C-NMR (101 MHz, $CDCl_3$), δ/ppm: 162.8, 150.9, 142.7, 138.2, 138.2, 129.0, 126.2, 125.3, 121.2, 114.6, 65.1, 61.2, 42.3, 34.6, 31.4, 14.5.

HRMS (APCI+), m/z: calculated for $[C_{22}H_{26}N_2O_2+H]^+$ 351.2067, found 351.2058.

Example 4: Ethyl 5-(naphth-2-yl)-1-phenyl-4,5-dihydro-1H-pyrazole-3-carboxylate

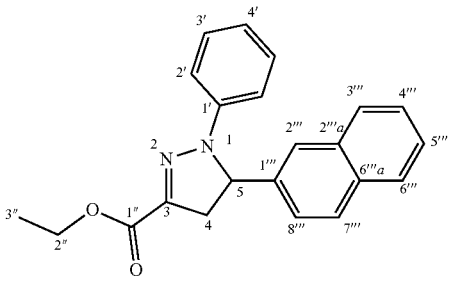

Synthesis according to synthetic method variant A using ethyl 2-(2-phenylhydrazono)acetate (3 mmol, 577 mg, 1 eq.) and 2-vinylnaphthalene (8.1 mmol, 1249 mg, 2.7 eq.). After flash column chromatography on silica with cyclohexane/ethyl acetate (0%→3% EtOAc), the pyrazoline was obtained as a yellow solid (1.34 mmol, 462 mg, 45%).

$^{1}$H-NMR (400 MHz, $CDCl_3$), δ/ppm: 7.87-7.75 (m, 3H, H-3''', H-6''', H-7'''), 7.70 (d, J=1.7 Hz, 1H, H-2'''), 7.51-7.45 (m, 2H, H-4''', H-5'''), 7.34 (dd, J=8.5, 1.8 Hz, 1H, H-8'''), 7.18-7.14 (m, 4H, H-2', H-3'), 6.88-6.84 (m, 1H, H-4'), 5.58 (dd, J=13.2, 7.1 Hz, 1H, H-5), 4.35 (q, J=7.1 Hz, 2H, H-2''), 3.79 (dd, J=18.0, 13.3 Hz 1H, (H-4)'), 3.12 (dd, J=18.1, 7.1 Hz 1H, (H-4)''), 1.38 (t, J=7.1 Hz, 3H, H-3'').

$^{13}$C-NMR (101 MHz, $CDCl_3$), δ/ppm: 162.8, 142.7, 138.7, 138.3, 133.5, 133.1, 129.7, 129.1, 128.1, 127.9, 126.7, 126.4, 124.7, 123.5, 121.4, 114.7, 65.7, 61.4, 42.4, 14.5.

HRMS (ESI+), m/z: calculated for $[C_{22}H_{20}N_2O_2+H]^+$ 345.1598, found 345.1598.

Example 5: Ethyl 5-(4-methoxyphenyl)-1-phenyl-4,5-dihydro-1H-pyrazole-3-carboxylate

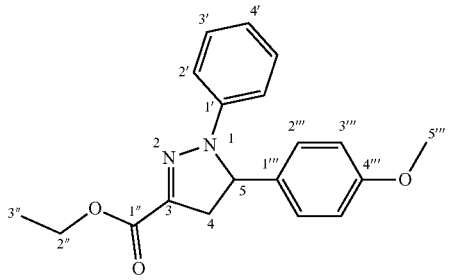

Synthesis according to synthetic method variant A using ethyl 2-(2-phenylhydrazono)acetate (3 mmol, 577 mg, 1 eq.) and 4-methoxystyrene (8.1 mmol, 1087 mg, 2.7 eq.). After flash column chromatography on silica with cyclohexane/ethyl acetate (0%→3% EtOAc), the pyrazoline was obtained as a yellow solid (1.34 mmol, 433 mg, 45%).

$^{1}$H-NMR (400 MHz, $CDCl_3$), δ/ppm: 7.20-7.08 (m, 6H, H-2', H-3', H-2'''), 6.90-6.82 (m, 3H, H-4', H-3'''), 5.37 (dd, J=13.2, 7.0 Hz, 1H, H-5), 4.34 (q, J=7.1 Hz, 2H, H-2''), 3.77 (s, 3H, H-5'''), 3.69 (dd, J=13.2, 7.0 Hz, 1H, (H-4)'), 3.02 (dd, J=18.0, 7.0 Hz, 1H, (H-4)''), 1.37 (t, J=7.1 Hz, 3H, H-3'').

$^{13}$C-NMR (101 MHz, $CDCl_3$), δ/ppm: 162.9, 159.3, 142.7, 138.2, 133.4, 129.0, 127.0, 121.3, 114.7, 114.7, 65.0, 61.3, 55.4, 42.4, 14.5.

HRMS (ESI+), m/z: calculated for $[C_{19}H_{20}N_2O_3+H]^+$ 325.1547, found 325.1544.

Example 6: Ethyl 5-(2,6-dichlorophenyl)-1-phenyl-4,5-dihydro-1H-pyrazole-3-carboxylate

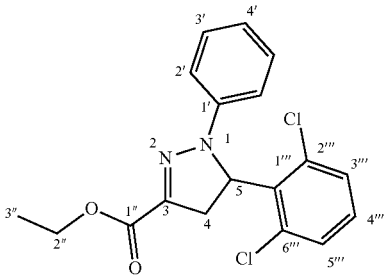

Synthesis according to synthetic method variant A using ethyl 2-(2-phenylhydrazono)acetate (3 mmol, 577 mg, 1 eq.) and 2,6-dichlorostyrene (8.1 mmol, 1402 mg, 2.7 eq.). After flash column chromatography on silica with cyclohexane/ethyl acetate (0%→3% EtOAc), the pyrazoline was obtained as a yellow solid (1.77 mmol, 643 mg, 59%).

$^{1}$H-NMR (400 MHz, $CDCl_3$), δ/ppm: 7.38 (dd, J=8.0, 1.4 Hz, 1H, H-3'''), 7.24 (dd, J=8.1, 1.4 Hz, 1H, H-5''), 7.20-7.14 (m, 3H, H-3', H-4'''), 7.06-7.02 (m, 2H, H-2'), 6.87 (tt, J=7.3, 1.0 Hz, 1H, H-4'), 6.22 (dd, J=14.6, 10.3 Hz, 1H, H-5), 4.37 (qd, J=7.1, 3.0 Hz, 2H, H-2''), 3.66 (dd, J=18.1, 14.6 Hz, 1H, (H-4)'), 3.20 (dd, J=18.1, 10.3 Hz, 1H, (H-4)''), 1.39 (t, J=7.1 Hz, 3H, H-3'').

$^{13}$C-NMR (101 MHz, $CDCl_3$), δ/ppm: 162.8, 142.3, 138.1, 135.1, 135.0, 134.6, 130.9, 129.8, 129.1, 128.6, 121.6, 114.6, 61.3, 61.0, 38.7, 14.5.

HRMS (ESI+), m/z: calculated for $[C_{18}H_{16}{}^{37}Cl_2N_2O_2+Na]^+$385.0481, found 385.0486; calculated for $[C_{18}H_{16}{}^{35}C^{37}ClN_2O_2+Na]^+$387.0455, found 387.0460; calculated for $[C_{18}H_{16}{}^{37}Cl_2N_2O_2+Na]^+$389.0434, found 389.0454.

Example 7: Ethyl 1,5,5-triphenyl-4,5-dihydro-1H-pyrazole-3-carboxylate

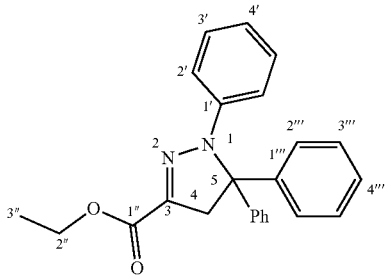

Synthesis according to synthetic method variant A using ethyl 2-(2-phenylhydrazono)acetate (3 mmol, 577 mg, 1 eq.) and 1,1-diphenylethene (8.1 mmol, 1460 mg, 2.7 eq.). After flash column chromatography on silica with cyclohexane/ethyl acetate (0%→3% EtOAc), the pyrazoline was obtained as a yellow oil (0.87 mmol, 323 mg, 29%).

$^{1}$H-NMR (400 MHz, $CDCl_3$), δ/ppm: 7.46-7.41 (m, 4H, H-2'''), 7.41-7.23 (m, 6H, H-3''', H-4'''), 7.06-6.98 (m, 4H, H-2', H-3'), 6.82-6.76 (m, 1H, H-4'), 4.34 (q, J=7.1 Hz, 2H, H-2''), 3.94 (s, 2H, H-4), 1.37 (t, J=7.1 Hz, 3H, H-3'').

$^{13}$C-NMR (101 MHz, $CDCl_3$), δ/ppm: 162.9, 142.3, 142.2, 137.2, 128.6, 128.3, 128.2, 127.8, 121.5, 117.0, 79.1, 61.3, 56.2, 14.5.

HRMS (ESI+), m/z: calculated for $[C_{24}H_{22}N_2O_2+H]^+$ 371.1754, found 371.1753.

Example 8: Ethyl 1,5-diphenyl-1H-pyrazole-3-carboxylate

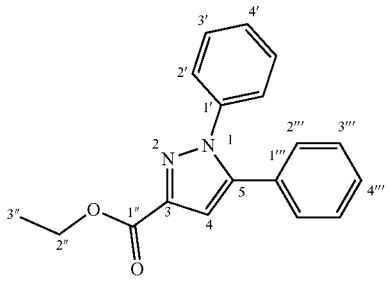

Synthesis according to synthetic method variant A using ethyl 2-(2-phenylhydrazono)acetate (3.9 mmol, 750 mg, 1 eq.) and phenylacetylene (10.5 mmol, 1070 mg, 2.7 eq.). A charge of 5.4 F was applied. After flash column chromatography on silica with cyclohexane/ethyl acetate (0%→3% EtOAc), the pyrazoline was obtained as a yellow oil (0.99 mmol, 288 mg, 25%).

$^{1}$H-NMR (400 MHz, $CDCl_3$), δ/ppm: 7.36-7.28 (m, 8H, H-2', H-3', H-2''', H-3'''), 7.23-7.20 (m, 2H, H-4', H-4'''), 7.05 (s, 1H, H-4), 4.46 (q, J=7.1 Hz, 2H, H-2''), 1.43 (t, J=7.1 Hz, 3H, H-3'').

$^{13}$C-NMR (101 MHz, $CDCl_3$), δ/ppm: 162.6, 144.8, 144.5, 139.7, 129.7, 129.1, 128.9, 128.8, 128.7, 128.5, 125.9, 110.1, 61.3, 14.6.

HRMS (APCI+), m/z: calculated for $[C_{18}H_{16}N_2O_2+H]^+$ 293.1285, found 293.1290.

Example 9: Ethyl 1-phenyl-1H-pyrazole-3-carboxylate

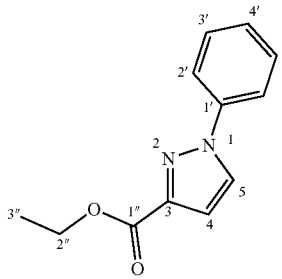

Synthesis according to synthetic method variant A using ethyl 2-(2-phenylhydrazono)acetate (3 mmol, 577 mg, 1 eq.) and vinyl acetate (8.1 mmol, 697 mg, 2.7 eq.). After flash column chromatography on silica with cyclohexane/ethyl acetate (0%→10% EtOAc), the pyrazole was obtained as a yellow solid (0.96 mmol, 208 mg, 32%).

In this case, the initially formed acetylated pyrazole deacetylates spontaneously to give the compound ethyl 1-phenyl-1H-pyrazole-3-carboxylate.

$^{1}$H-NMR (400 MHz, $CDCl_3$), δ/ppm: 7.93 (d, J=2.5 Hz, 1H, H-5), 7.78-7.70 (m, 2H, H-2'), 7.53-7.42 (m, 2H, H-3'), 7.40-7.30 (m, 1H, H-4'), 6.99 (d, J=2.5 Hz, 1H, H-4), 4.44 (q, J=7.1 Hz, 2H, H-2"), 1.42 (t, J=7.1 Hz, 3H, H-3").

$^{13}$C-NMR (101 MHz, $CDCl_3$), δ/ppm: 162.4, 145.4, 139.8, 129.6, 128.5, 127.8, 120.3, 110.5, 61.3, 14.5.

HRMS (APCI+), m/z: calculated for $[C_{12}H_{12}N_2O_2+H]^+$ 217.0972, found 217.0986.

Example 10: Ethyl 5-butyl-1-phenyl-1H-pyrazole-3-carboxylate

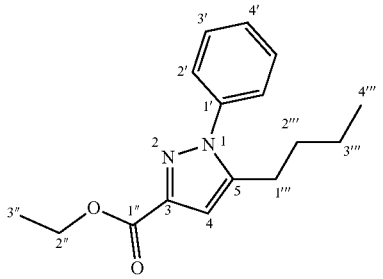

Synthesis according to synthetic method variant A using ethyl 2-(2-phenylhydrazono)acetate (3 mmol, 577 mg, 1 eq.) and 1-hexyne (8.1 mmol, 665 mg, 2.7 eq.). The electrolysis was carried out at 50° C. After flash column chromatography on silica with cyclohexane/ethyl acetate (0%→3% EtOAc), the pyrazoline was obtained as a dark yellow oil (0.26 mmol, 71 mg, 9%).

$^{1}$H-NMR (400 MHz, $CDCl_3$), δ/ppm: 7.51-7.37 (m, 5H, H-2', H-3', H-4'), 6.75 (s, 1H, H-4), 4.40 (q, J=7.1 Hz, 2H, H-2"), 2.60 (t, J=7.7 Hz, 2H, H-1'''), 1.56 (tt, J=7.6, 7.6 Hz, 2H, H-2'''), 1.39 (t, J=7.1 Hz, 3H, H-3"), 1.30 (qt, J=7.4, 7.4 Hz, 2H, H-3'''), 0.85 (t, J=7.3 Hz, 3H, H-4''').

$^{13}$C-NMR (101 MHz, $CDCl_3$), δ/ppm: 162.8, 145.8, 144.0, 139.4, 129.2, 128.8, 126.1, 107.9, 61.0, 30.8, 25.9, 22.2, 14.5, 13.8.

HRMS (ESI+), m/z: calculated for $[C_{16}H_{20}N_2O_2+H]^+$ 273.1598, found 273.1598.

Example 11: Ethyl 5-(diethoxyphosphoryl)-1-phenyl-4,5-dihydro-1H-pyrazole-3-carboxylate

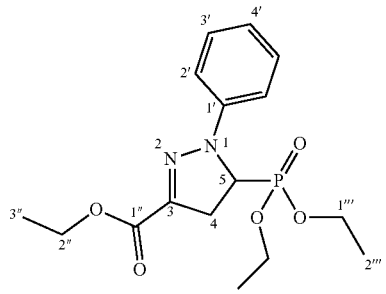

Synthesis according to synthetic method variant A using ethyl 2-(2-phenylhydrazono)acetate (3 mmol, 577 mg, 1 eq.) and diethyl vinylphosphonate (8.1 mmol, 1330 mg, 2.7 eq.). After flash column chromatography on silica with cyclohexane/ethyl acetate (5%→30% EtOAc) and reversed phase flash column chromatography on C-18 silica with acetonitrile/water (25%→60% acetonitrile), the pyrazoline was obtained as a yellow oil (1.32 mmol, 469 mg, 44%).

$^{1}$H-NMR (400 MHz, $CDCl_3$), δ/ppm: 7.44-7.36 (m, 2H, H-2'), 7.32-7.27 (m, 2H, H-3'), 6.98 (tt, J=7.3, 1.1 Hz, 1H, H-4'), 4.69 (dd, J=13.7, 7.2 Hz, 1H, H-5), 4.34 (qd, J=7.1, 0.7 Hz, 2H, H-2"), 4.19-3.95 (m, 4H, H-1'''), 3.67-3.39 (m, 2H, H-4), 1.37 (t, J=7.1 Hz, 3H, H-3"), 1.24 (dt, J=9.8, 7.1 Hz, 6H, H-2''').

$^{13}$C-NMR (101 MHz, $CDCl_3$), δ/ppm: 162.3, 143.4, 140.3 (d, J=5.5 Hz), 129.0, 122.2, 115.9, 63.5 (d, J=7.3 Hz), 63.0 (d, J=7.0 Hz), 61.5, 58.3 (d, J=164.0 Hz), 35.4 (d, J=3.3 Hz), 16.6 (d, J=5.5 Hz), 16.5 (d, J=5.5 Hz), 14.5. $^{31}$P-NMR (162 MHz, $CDCl_3$), δ/ppm: 19.69.

HRMS (ESI+), m/z: calculated for $[C_{16}H_{23}N_2O_5P+H]^+$ 355.1417, found 355.1421.

Example 12: 3-Ethyl 5-methyl 1-phenyl-4,5-dihydro-1H-pyrazole-3,5-dicarboxylate

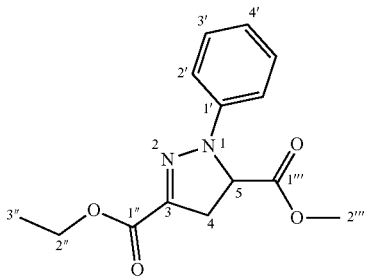

Synthesis according to synthetic method variant A using ethyl 2-(2-phenylhydrazono)acetate (3.9 mmol, 750 mg, 1 eq.) and methyl acrylate (10.5 mmol, 904 mg, 2.7 eq.). An amount of charge of 5.4 F was applied. After flash column chromatography on silica with cyclohexane/ethyl acetate (0%-5% EtOAc), the pyrazoline was obtained as a yellow oil (3.46 mmol, 957 mg, 89%).

$^{1}$H-NMR (400 MHz, $CDCl_3$), δ/ppm: 7.32-7.25 (m, 2H, H-3'), 7.13 (dt, J=7.9, 1.1 Hz, 2H, H-2'), 6.97 (tt, J=7.3, 1.1 Hz, 1H, H-4'), 4.94 (dd, J=13.6, 6.6 Hz, 1H, H-5), 4.34 (qd, J=7.1, 0.7 Hz, 2H, H-2"), 3.74 (s, 3H, H-2'''), 3.55 (dd, J=18.1, 13.5 Hz, 1H, (H-4)'), 3.32 (dd, J=18.2, 6.6 Hz, 1H, (H-4)"), 1.38 (t, J=7.1 Hz, 3H, H-3").

$^{13}$C-NMR (101 MHz, $CDCl_3$), δ/ppm: 170.8, 162.2, 142.5, 138.6, 129.4, 121.9, 114.0, 62.3, 61.6, 53.1, 37.4, 14.5.

HRMS (APCI+), m/z: calculated for $[C_{14}H_{16}N_2O_4+H]^+$ 277.1183, found 277.1192.

Example 13: 3-Ethyl 5,5-dimethyl 1-phenyl-4,5-dihydro-1H-pyrazole-3,5-dicarboxylate

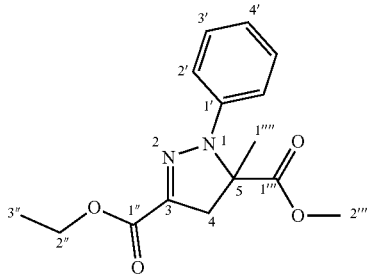

Synthesis according to synthetic method variant A using ethyl 2-(2-phenylhydrazono)acetate (3 mmol, 577 mg, 1 eq.) and methyl methacrylate (8.1 mmol, 811 mg, 2.7 eq.). After flash column chromatography on silica with cyclohexane/ethyl acetate (0%→3% EtOAc), the pyrazoline was obtained as a yellow oil (2.44 mmol, 709 mg, 81%).

$^{1}$H-NMR (400 MHz, $CD_2Cl_2$), δ/ppm: 7.31-7.25 (m, 2H, H-3'), 7.10-7.06 (m, 2H, H-2'), 6.98 (tt, J=7.3, 1.1 Hz, 1H, H-4'), 4.30 (q, J=7.1 Hz, 2H, H-2"), 3.76 (s, 3H, H-2'''), 3.54 (d, J=17.8 Hz, 1H, (H-4)'), 3.18 (d, J=17.8 Hz, 1H, (H-4)'''), 1.64 (s, 3H, H-1''''), 1.35 (t, J=7.1 Hz, 3H, H-3").

$^{13}$C-NMR (101 MHz, $CD_2Cl_2$), δ/ppm: 173.2, 162.5, 141.9, 137.5, 129.5, 122.3, 115.8, 70.8, 61.5, 53.4, 47.4, 21.6, 14.5.

HRMS (ESI+), m/z: calculated for $[C_{15}H_{18}N_2O_4+H]^+$ 291.1339, found 291.1344.

Example 14: 3-Ethyl 5-methyl 5-(2-methoxy-2-oxoethyl)-1-phenyl-4,5-dihydro-1H-pyrazole-3,5-dicarboxylate

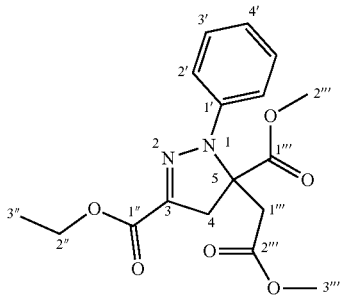

Synthesis according to synthetic method variant A using ethyl 2-(2-phenylhydrazono)acetate (3 mmol, 577 mg, 1 eq.) and dimethyl itaconate (8.1 mmol, 1281 mg, 2.7 eq.). After flash column chromatography on silica with cyclohexane/ethyl acetate (0%→8% EtOAc), the pyrazoline was obtained as a yellow oil (2.73 mmol, 950 mg, 91%).

$^{1}$H-NMR (400 MHz, $CDCl_3$), δ/ppm: 7.26-7.18 (m, 2H, H-3'), 7.12-7.07 (m, 2H, H-2'), 7.01-6.95 (m, 1H, H-4'), 4.30 (q, J=7.1 Hz, 2H, H-2"), 3.72 (d, J=18.4 Hz, 1H, (H-1'''')'), 3.70 (s, 3H, H-3''''), 3.65 (d, J=18.4 Hz, 1H, (H-1'''')"), 3.59 (s, 3H, H-2'''), 3.25 (d, J=16.6 Hz, 1H, (H-4)'), 2.87 (d, J=16.6 Hz, 1H, (H-4)"), 1.33 (t, J=7.1 Hz, 3H, H-3").

$^{13}$C-NMR (101 MHz, $CDCl_3$), δ/ppm: 171.4, 169.7, 162.0, 141.5, 138.9, 129.2, 123.1, 116.9, 71.3, 61.3, 53.3, 51.9, 44.7, 37.8, 14.3.

HRMS (ESI+), m/z: calculated for $[C_{17}H_{20}N_2O_6+H]^+$ 349.1394, found 349.1395.

Example 15: Ethyl 5-cyano-1-phenyl-4,5-dihydro-1H-pyrazole-3-carboxylate

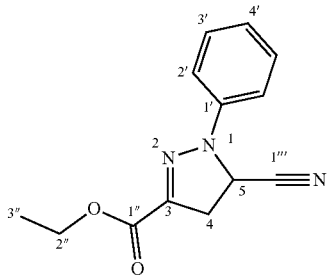

Synthesis according to synthetic method variant A using ethyl 2-(2-phenylhydrazono)acetate (3 mmol, 577 mg, 1 eq.) and acrylonitrile (8.1 mmol, 430 mg, 2.7 eq.). After flash column chromatography on silica with cyclohexane/ethyl acetate (0%→3% EtOAc), the pyrazoline was obtained as a yellow solid (2.68 mmol, 653 mg, 90%).

$^{1}$H-NMR (400 MHz, $CDCl_3$), δ/ppm: 7.39-7.33 (m, 2H, H-3'), 7.24 (dt, J=8.8, 1.0 Hz, 2H, H-2'), 7.10-7.04 (m, 1H, H-4'), 5.07 (ddd, J=10.6, 8.2, 0.6 Hz, 1H, H-5), 4.35 (q, J=7.1 Hz, 2H, H-2"), 3.61-3.50 (m, 2H, H-4), 1.38 (td, J=7.1, 0.7 Hz, 3H, H-3").

$^{13}$C-NMR (101 MHz, $CDCl_3$), δ/ppm: 161.3, 141.5, 140.0, 129.6, 123.2, 116.2, 115.0, 61.9, 50.4, 37.9, 14.3.

HRMS (ESI+), m/z: calculated for $[C_{13}H_{13}N_3O_2+Na]^+$ 266.0900, found 266.0896.

Example 16: Ethyl 5-(dimethylcarbamoyl)-1-phenyl-4,5-dihydro-1H-pyrazole-3-carboxylate

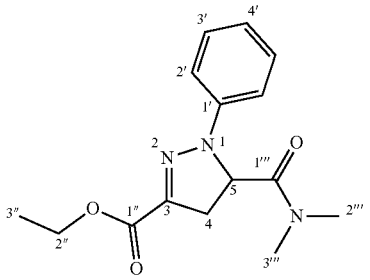

Synthesis according to synthetic method variant A using ethyl 2-(2-phenylhydrazono)acetate (3 mmol, 577 mg, 1 eq.) and N,N-dimethylacrylamide (8.1 mmol, 803 mg, 2.7 eq.). After flash column chromatography on silica with cyclohexane/ethyl acetate (0%→300 EtOAc), the pyrazoline was obtained as a yellow solid (1.73 mmol, 501 mg, 58%).

$^1$H-NMR (400 MHz, $CDCl_3$), δ/ppm: 7.29-7.22 (in, 2H, H-3'), 7.08-7.03 (in, 2H, H-2'), 6.96-6.90 (in, 1H, H-4'), 5.13 (dd, J=14.0, 7.9 Hz, 1H, H-5), 4.32 (qd, J=7.1, 1.7 Hz, 2H, H-2"), 3.54 (dd, J=17.8, 14.0 Hz, 1H, (H-4)'), 3.12 (dd, J=17.9, 7.9 Hz, 1H, (H-4)"), 3.06 (s, 3H, H-2'"), 2.97 (s, 3H, H-3'"), 1.35 (t, J=7.1 Hz, 3H, H-3").

$^{13}$C-NMR (101 MHz, $CDCl_3$), δ/ppm: 168.9, 162.3, 142.6, 137.6, 129.3, 121.7, 114.0, 61.9, 61.3, 36.9, 36.9, 36.4, 14.4.

HRMS (APCI+), m/z: calculated for $[C_{15}Ha\ N_3O_3+H]^+$ 290.1499, found 290.1491.

Example 17: 3-Ethyl 4,5-dimethyl 1-phenyl-4,5-dihydro-1H-pyrazole-3,4,5-tricarboxylate

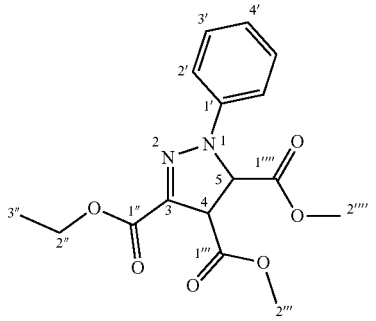

Synthesis according to synthetic method variant A using ethyl 2-(2-phenylhydrazono)acetate (3 mmol, 577 mg, 1 eq.) and dimethyl maleate (8.1 mmol, 1167 mg, 2.7 eq.). After flash column chromatography on silica with cyclohexane/ethyl acetate (0%→12% EtOAc), the product was obtained as an orange oil (2.00 mmol, 669 mg, 66%) in a 1.9:1 mixture of the 4,5-cis- and the 4,5-trans-substituted pyrazoline (determined by means of $^1$H NMR).

Analytical data for 3-ethyl 4,5-dimethyl 4,5-cis-1-phenyl-4,5-dihydro-1H-pyrazole-3,4,5-tricarboxylate:

$^1$H-NMR (400 MHz, $CD_3CN$), δ/ppm: 7.37-7.29 (m, 2H, H-3'), 7.06 (dt, J=7.8, 1.1 Hz, 2H, H-2'), 7.02 (tt, J=7.2, 1.1 Hz, 1H, H-4'), 5.41 (d, J=13.8 Hz, 1H, H-5), 4.70 (d, J=13.8 Hz, 1H, H-4), 4.26 (dddd, J=17.9, 10.8, 7.1, 3.7 Hz, 2H, H-2"), 3.71 (s, 3H, H-2""), 3.66 (s, 3H, H-2'"), 1.29 (t, J=7.1 Hz, 3H, H-3").

$^{13}$C-NMR (101 MHz, $CD_3CN$), δ/ppm: 169.6, 168.5, 161.9, 143.0, 137.7, 130.3, 123.0, 115.0, 66.2, 62.2, 54.7, 53.6, 14.4.

HRMS (ESI+), m/z: calculated for $[C_{16}H_{18}N_2O_6+H]^+$ 335.1238, found 335.1241.

Example 18: 3-Ethyl 4,5-dimethyl 4,5-trans-1-phenyl-4,5-dihydro-1H-pyrazole-3,4,5-tricarboxylate

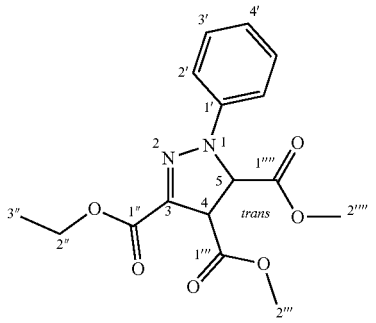

Synthesis according to synthetic method variant A using ethyl 2-(2-phenylhydrazono)acetate (3 mmol, 577 mg, 1 eq.) and dimethyl fumarate (8.1 mmol, 1167 mg, 2.7 eq.). After flash column chromatography on silica with cyclohexane/ethyl acetate (0%→10% EtOAc), the pyrazoline was obtained as a yellow oil (2.10 mmol, 701 mg, 70%).

$^1$H-NMR (400 MHz, $CDCl_3$), δ/ppm: 7.33-7.28 (m, 2H, H-3'), 7.18-7.13 (m, 2H, H-2'), 7.04-6.98 (m, 1H, H-4'), 5.17 (d, J=5.8 Hz, 1H, H-5), 4.39 (d, J=5.8 Hz, 1H, H-4), 4.44-4.25 (m, 2H, H-2"), 3.79 (s, 3H, H-2'"), 3.76 (s, 3H, H-2""), 1.36 (t, J=7.1 Hz, 3H, H-3").

$^{13}$C-NMR (101 MHz, $CDCl_3$), δ/ppm: 169.1, 169.0, 161.4, 141.8, 135.6, 129.4, 122.5, 114.5, 66.5, 61.7, 54.3, 53.4, 14.4.

HRMS (ESI+), m/z: calculated for $[C_{16}H_{18}N_2O_6+Na]^+$ 357.1057, found 357.1057.

Example 19: Ethyl 3a,8b-cis-1-phenyl-1,3a,4,8b-tetrahydroindeno[1,2-c]pyrazole-3-carboxylate

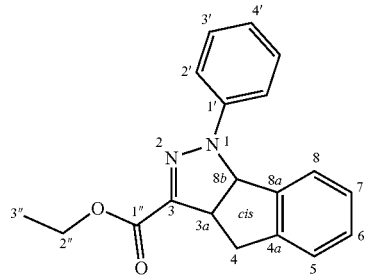

Synthesis according to synthetic method variant A using ethyl 2-(2-phenylhydrazono)acetate (3 mmol, 577 mg, 1 eq.) and indene (8.1 mmol, 941 mg, 2.7 eq.). After flash column chromatography on silica with cyclohexane/ethyl acetate (0%→3% EtOAc), the pyrazoline was obtained as a pale yellow solid (1.60 mmol, 491 mg, 52%).

$^1$H-NMR (400 MHz, $CD_2Cl_2$), δ/ppm: 7.45-7.35 (m, 5H, H-2', H-3', H-8), 7.32-7.23 (m, 2H, H-6, H-7), 7.14-7.08 (m, 1H, H-5), 7.02 (tt, J=7.0, 1.5 Hz, 1H, H-4'), 6.12 (d, J=10.6 Hz, 1H, H-8b), 4.39-4.25 (m, 3H, H-3a, H-2"), 3.53-3.41 (m, 2H, H-4), 1.36 (t, J=7.1 Hz, 3H, H-3").

$^{13}$C-NMR (101 MHz, $CD_2Cl_2$), δ/ppm: 162.9, 143.0, 142.7, 142.0, 140.2, 129.7, 129.2, 127.5, 125.7, 125.4, 121.9, 115.5, 70.1, 61.2, 48.9, 36.4, 14.6.

HRMS (ESI+), m/z: calculated for $[C_{19}H_{18}N_2O_2+H]^+$ 307.1441, found 307.1434.

Example 20: Ethyl 4,5-trans-5-(4-methoxyphenyl)-4-methyl-1-phenyl-4,5-dihydro-1H-pyrazole-3-carboxylate

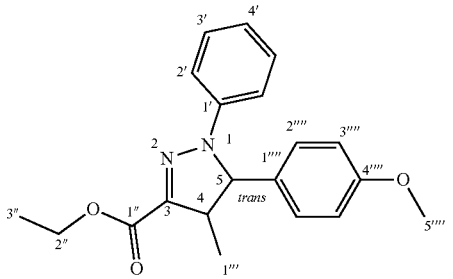

Synthesis according to synthetic method variant A using ethyl 2-(2-phenylhydrazono)acetate (3 mmol, 577 mg, 1 eq.) and trans-anethole (8.1 mmol, 1200 mg, 2.7 eq.). After flash column chromatography on silica with cyclohexane/ethyl acetate (0%→5% EtOAc), the pyrazoline was obtained as a yellow oil (0.43 mmol, 165 mg, 16%).

$^1$H-NMR (400 MHz, $CDCl_3$), δ/ppm: 7.22-7.16 (m, 2H, H-3'), 7.15-7.09 (m, 4H, H-2', H-2''''), 6.90-6.81 (m, 3H, H-4', H-3''''), 4.86 (d, J=5.8 Hz, 1H, H-5), 4.34 (qd, J=7.1, 2.8 Hz, 2H, H-2''), 3.77 (s, 3H, H-5''''), 3.27 (qd, J=7.1, 5.7 Hz, 1H, H-4), 1.44 (d, J=7.1 Hz, 3H, H-1'''), 1.38 (t, J=7.1 Hz, 3H, H-3'').

$^{13}$C-NMR (101 MHz, $CDCl_3$), δ/ppm: 162.7, 159.4, 142.6, 142.3, 132.6, 129.0, 126.7, 121.3, 114.7, 73.2, 61.1, 55.4, 50.3, 19.2, 14.4.

HRMS (APCI+), m/z: calculated for $[C_{20}H_{22}N_2O_3+H]^+$ 339.1703, found 339.1695.

Example 21: Ethyl 4,5-trans-1,4,5-triphenyl-4,5-dihydro-1H-pyrazole-3-carboxylate (21)

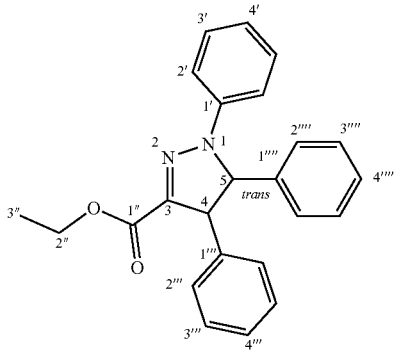

Synthesis according to synthetic method variant A using ethyl 2-(2-phenylhydrazono)acetate (3.9 mmol, 750 mg, 1 eq.) and trans-stilbene (10.5 mmol, 1893 mg, 2.7 eq.). After flash column chromatography on silica with cyclohexane/ethyl acetate (0%→3% EtOAc), the pyrazoline was obtained as an orange solid (0.37 mmol, 137 mg, 9%).

$^1$H-NMR (400 MHz, $CDCl_3$), δ/ppm: 7.40-7.14 (m, 14H, H-2', H-3', H-2''', H-3''', H-4''', H-2'''', H-3'''', H-4''''), 6.91 (tt, J=7.0, 1.5 Hz, 1H, H-4'), 5.29 (d, J=5.2 Hz, 1H, H-5), 4.32 (d, J=5.2 Hz, 1H, H-4), 4.28-4.10 (m, 2H, H-2''), 1.21 (t, J=7.1 Hz, 3H, H-3'').

$^{13}$C-NMR (101 MHz, $CDCl_3$), δ/ppm: 162.3, 142.2, 141.0, 140.7, 140.3, 129.6, 129.3, 129.2, 128.3, 127.8, 127.3, 125.4, 121.6, 114.8, 74.9, 61.1, 61.0, 14.2.

HRMS (APCI+), m/z: calculated for $[C_{24}H_{22}N_2O_2+H]^+$ 371.1754, found 371.1760.

Example 22: Ethyl 3a,7a-cis-1-phenyl-3a,4,5,6,7,7a-hexahydro-1H-4,7-methanoindazole-3-carboxylate

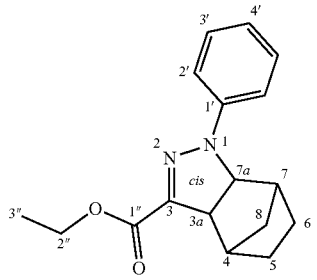

Synthesis according to synthetic method variant A using ethyl 2-(2-phenylhydrazono)acetate (3.9 mmol, 750 mg, 1 eq.) and norbornene (10.5 mmol, 998 mg, 2.7 eq.). An amount of charge of 5.4 F (2032 C) was applied. After flash column chromatography on silica with cyclohexane/ethyl acetate (0%→3% EtOAc), the pyrazoline was obtained as a yellow solid (3.55 mmol, 1010 mg, 91%).

$^1$H-NMR (400 MHz, $CDCl_3$), δ/ppm: 7.32-7.27 (m, 2H, H-3'), 7.23-7.18 (m, 2H, H-2'), 6.93 (tt, J=7.3, 1.2 Hz, 1H, H-4'), 4.39-4.26 (m, 2H, H-2''), 4.23 (d, J=10.0 Hz, 1H, H-7a), 3.42 (d, J=9.9 Hz, 1H, H-3a), 2.82-2.77 (m, 1H, H-7), 2.71-2.66 (m, 1H, H-4), 1.67-1.54 (m, 2H, (H-5)', (H-6)'), 1.46-1.29 (m, 3H, (H-5)'', (H-6)'', (H-8)'), 1.37 (t, J=7.1 Hz, 3H, H-3''), 1.27-1.18 (m, 1H, (H-8)'').

$^{13}$C-NMR (101 MHz, $CDCl_3$), δ/ppm: 163.1, 142.4, 141.1, 129.2, 121.0, 114.0, 69.2, 61.0, 54.3, 41.6, 40.9, 33.2, 27.7, 24.7, 14.5.

HRMS (ESI+), m/z: calculated for $[C_{17}H_{20}N_2O_2+H]^+$ 285.1598, found 285.1599.

Example 23: Ethyl 3a,9a-cis-5,8-bisacetoxy-1-phenyl-3a,4,9,9a-tetrahydro-1H-4,9-methanobenzo[f]indazole-3-carboxylate

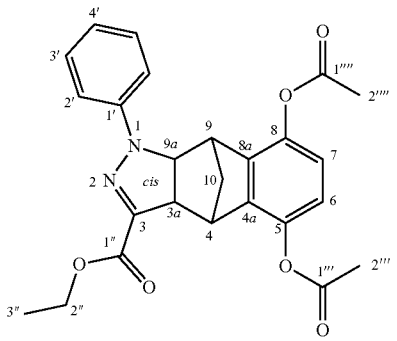

Synthesis according to synthetic method variant A using ethyl 2-(2-phenylhydrazono)acetate (3 mmol, 577 mg, 1 eq.) and 5,8-bisacetoxybenzo[e]norbornene (8.1 mmol, 2092 mg, 2.7 eq.). After flash column chromatography on silica with cyclohexane/ethyl acetate (0%→5% EtOAc), the pyrazoline was obtained as a yellow solid (2.43 mmol, 1089 mg, 81%).

$^{1}$H-NMR (400 MHz, $CDCl_3$), δ/ppm: 7.32 (m, 4H, H-2', H-3'), 6.98 (m, 1H, H-4'), 6.89 (d, J=8.8 Hz, 1H, H-6), 6.86 (d, J=8.8 Hz, 1H, H-7), 4.80 (d, J=9.9 Hz, 1H, H-9a), 4.45-4.26 (m, 2H, H-2"), 3.88 (d, J=9.9 Hz, 1H, H-3a), 3.84 (br s, 1H, H-4), 3.83 (br s, 1H, H-9), 2.42 (s, 3H, H-2'''), 2.38 (s, 3H, H-2''''), 1.83 (s, 2H, H-10), 1.41 (t, J=7.1 Hz, 3H, H-3").

$^{13}$C-NMR (101 MHz, $CDCl_3$), δ/ppm: 169.6, 169.2, 162.7, 142.8, 142.6, 142.0, 141.0, 138.9, 137.8, 129.3, 121.6, 121.5, 120.8, 114.4, 68.6, 61.1, 54.1, 47.3, 46.2, 43.5, 20.9, 20.9, 14.6.

HRMS (APCI+), m/z: calculated for $[C_{25}H_{24}N_2O_6+H]^+$ 449.1707, found 449.1696.

Example 24: Ethyl 3a,9a-cis-1-phenyl-3a,4,5,6,7,8,9,9a-octahydro-1H-cycloocta[c]pyrazole-3-carboxylate

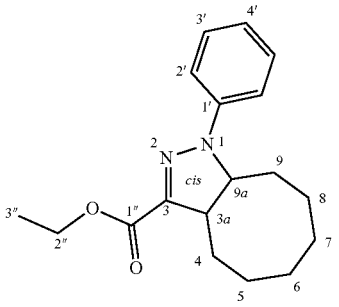

Synthesis according to synthetic method variant A using ethyl 2-(2-phenylhydrazono)acetate (3 mmol, 577 mg, 1 eq.) and cis-cyclooctene (8.1 mmol, 893 mg, 2.7 eq.). After flash column chromatography on silica with cyclohexane/ethyl acetate (0%→3% EtOAc), the pyrazoline was obtained as a yellow oil (1.02 mmol, 306 mg, 34%).

$^{1}$H-NMR (400 MHz, $CDCl_3$), δ/ppm: 7.34-7.27 (m, 2H, H-3'), 7.16-7.11 (m, 2H, H-2'), 6.95 (tt, J=7.3, 1.1 Hz, 1H, H-4'), 4.44-4.25 (m, 3H, H-9a, H-2"), 3.46 (ddd, J=12.6, 11.0, 1.6 Hz, 1H, H-3a), 2.37-2.26 (m, 1H, (H-4)'), 1.92-1.40 (m, 11H, (H-4)", H-5, H-6, H-7, H-8, H-9), 1.37 (t, J=7.1 Hz, 3H, H-3").

$^{13}$C-NMR (101 MHz, $CDCl_3$), δ/ppm: 163.2, 142.7, 142.2, 129.1, 121.6, 115.8, 65.6, 61.0, 48.5, 29.3, 27.8, 25.7, 25.5, 24.5, 23.5, 14.5.

HRMS (ESI+), m/z: calculated for $[C_{18}H_{24}N_2O_2+H]^+$ 301.1911, found 301.1910.

Example 25: Ethyl 3a,7a-cis-1-phenyl-6,6,7a-trimethyl-3a,4,5,6,7,7a-hexahydro-1H-5,7-methanoindazole-3-carboxylate

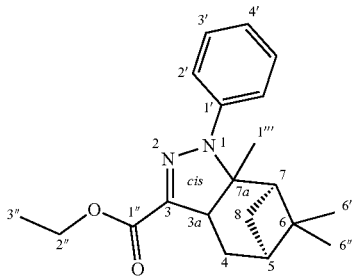

Synthesis according to synthetic method variant A using ethyl 2-(2-phenylhydrazono)acetate (3 mmol, 577 mg, 1 eq.) and (−)-α-pinene (8.1 mmol, 1103 mg, 2.7 eq.). After flash column chromatography on silica with cyclohexane/ethyl acetate (0%→3% EtOAc) and purification by preparative HPLC (water (+1% by volume formic acid)/acetonitrile 70%→100% MeCN), the pyrazoline was obtained as a yellow solid (0.11 mmol, 36 mg, 4%).

$^{1}$H-NMR (400 MHz, $CDCl_3$), δ/ppm: 7.28-7.23 (m, 4H, H-2', H-3'), 7.03-6.97 (m, 1H, H-4'), 4.42-4.27 (m, 2H, H-2"), 3.39 (dd, J=10.7, 5.0 Hz, 1H, H-3a), 2.57 (dd, J=6.2, 4.6 Hz, 1H, H-7), 2.46 (dddd, J=13.8, 10.8, 3.1, 2.1 Hz, 1H, (H-4)'), 2.25 (dddd, J=10.6, 6.3, 6.3, 2.1 Hz, 1H, (H-8)'), 1.96 (dddd, J=7.8, 3.1, 3.1, 3.0 Hz, 1H, H-5), 1.75 (ddd, J=13.8, 5.0, 3.0 Hz, 1H, (H-4)"), 1.40 (s, 3H, H-1'''), 1.38 (t, J=7.1 Hz, 3H, H-3"), 1.32 (s, 3H, H-6'), 1.04 (s, 3H, H-6"), 0.96 (dd, J=9.4, 4.8 Hz, 1H, (H-8)").

$^{13}$C-NMR (101 MHz, $CDCl_3$), δ/ppm: 163.4, 142.3, 141.9, 128.9, 122.8, 118.7, 76.3, 60.9, 49.7, 46.3, 38.5, 38.1, 33.4, 28.5, 27.9, 26.1, 23.7, 14.6.

HRMS (APCI+), m/z: calculated for $[C_{20}H_{26}N_2O_2+H]^+$ 327.2067, found 327.2069.

Example 26: Ethyl (1R,5S)-6,6-dimethyl-2'-phenyl-1',2'-dihydrospiro[bicyclo[3.1.1]heptane-2,3'-pyrazole]-5'-carboxylate

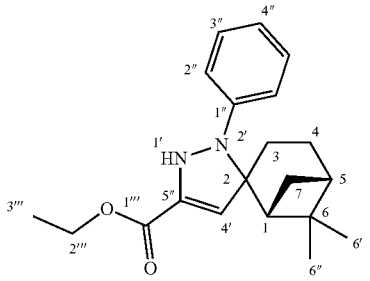

Synthesis according to synthetic method variant A using ethyl 2-(2-phenylhydrazono)acetate (3 mmol, 577 mg, 1 eq.) and (−)-ß-pinene (8.1 mmol, 1103 mg, 2.7 eq.). After flash column chromatography on silica with cyclohexane/ethyl acetate (0%→3% EtOAc) and purification by preparative HPLC (water/acetonitrile 70%→100% MeCN), the pyrazoline was obtained as a yellow solid (0.21 mmol, 68 mg, 7%).

$^{1}$H-NMR (400 MHz, $CDCl_3$), δ/ppm: 8.41 (s, 1H, H-1'), 7.33-7.24 (m, 2H, H-3"), 7.15-7.10 (m, 2H, H-2"), 6.96 (tt, J=7.4, 1.2 Hz, 1H, H-4"), 5.46-5.41 (m, 1H, H-4'), 4.31 (q, J=7.1 Hz, 2H, H-2'''), 3.50 (dq, J=16.5, 2.4 Hz, 1H, (H-3)'), 3.27 (dq, J=16.4, 1.9 Hz, 1H, (H-3)"), 2.38 (dt, J=8.8, 5.6 Hz, 1H, (H-7)'), 2.31 (dp, J=18.0, 3.0 Hz, 1H, (H-4)'), 2.23 (dp, J=17.9, 2.6 Hz, 1H, (H-4)"), 2.11 (ttd, J=5.6, 2.7, 1.2 Hz, 1H, H-5), 2.04 (td, J=5.6, 1.6 Hz, 1H, H-1), 1.38 (t, J=7.1 Hz, 3H, 3'''), 1.27 (s, 3H, H-6'), 1.13 (d, J=8.8 Hz, 1H, (H-7)"), 0.86 (s, 3H, H-6").

$^{13}$C-NMR (101 MHz, $CDCl_3$), δ/ppm: 165.5, 143.3, 142.6, 133.2, 129.4, 122.1, 119.4, 113.9, 61.4, 45.6, 40.7, 38.2, 33.2, 31.8, 31.6, 26.2, 21.1, 14.5.

HRMS (APCI+), m/z: calculated for $[C_{20}H_{26}N_2O_2+H]^+$ 327.2067, found 327.2054.

Example 27: Ethyl 1-phenyl-5-((trimethylsilyl) methyl)-4,5-dihydro-1H-pyrazole-3-carboxylate

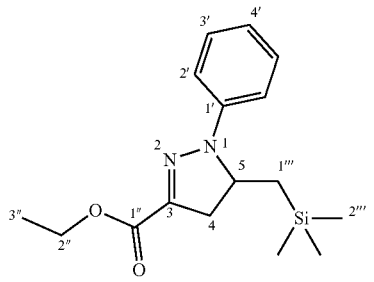

Synthesis according to synthetic method variant A using ethyl 2-(2-phenylhydrazono)acetate (3 mmol, 577 mg, 1 eq.) and allyltrimethylsilane (8.1 mmol, 926 mg, 2.7 eq.). After flash column chromatography on silica with cyclohexane/ethyl acetate (0%→3% EtOAc), the pyrazoline was obtained as a yellow oil (1.03 mmol, 315 mg, 34%).

$^{1}$H-NMR (400 MHz, $CDCl_3$), δ/ppm: 7.29 (tt, J=7.3, 2.0 Hz, 2H, H-3'), 7.18-7.12 (m, 2H, H-2'), 6.94 (tt, J=7.3, 1.2 Hz, 1H, H-4'), 4.60 (dddd, J=11.8, 11.8, 5.2, 1.8 Hz, 1H, H-5), 4.34 (qd, J=7.1, 2.2 Hz, 2H, H-2"), 3.29 (dd, J=17.4, 11.7 Hz, 1H, (H-4)'), 2.78 (dd, J=17.4, 5.1 Hz, 1H, (H-4)"), 1.38 (t, J=7.1 Hz, 3H H-3"), 1.24 (dd, J=14.6, 1.8 Hz, 1H, (H-1'''))', 0.90 (dd, J=14.6, 11.8 Hz, 1H, (H-1'''))"), 0.11 (s, 9H, H-2''').

$^{13}$C-NMR (101 MHz, $CDCl_3$), δ/ppm: 163.4, 141.9, 138.4, 129.3, 121.3, 115.1, 61.2, 58.8, 39.0, 21.2, 14.6, −0.8.

HRMS (ESI+), m/z: calculated for $[C_{16}H_{24}N_2O_2Si+H]^+$ 305.1680, found 305.1684.

Example 28: Ethyl 5-butyl-1-phenyl-4,5-dihydro-1H-pyrazole-3-carboxylate

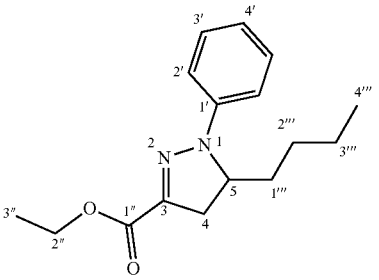

Synthesis according to synthetic method variant A using ethyl 2-(2-phenylhydrazono)acetate (3 mmol, 577 mg, 1 eq.) and 1-hexene (8.1 mmol, 682 mg, 2.7 eq.). After flash column chromatography on silica with cyclohexane/ethyl acetate (0%→3% EtOAc), the pyrazoline was obtained as a yellow oil (0.95 mmol, 261 mg, 32%).

$^{1}$H-NMR (400 MHz, $CDCl_3$), δ/ppm: 7.32-7.27 (m, 2H, H-3'), 7.21-7.17 (m, 2H, H-2'), 6.94 (tt, J=7.3, 1.2 Hz, 1H, H-4'), 4.51 (dddd, J=12.1, 9.3, 5.2, 2.6 Hz, 1H, H-5), 4.34 (q, J=7.1 Hz, 2H, H-2"), 3.28 (dd, J=17.6, 12.2 Hz, 1H, (H-4)'), 2.93 (dd, J=17.7, 5.2 Hz, 1H, (H-4)"), 1.87-1.72 (m, 1H, (H-1'''))'), 1.61-1.46 (m, 1H, (H-1'''))"), 1.38 (t, J=7.1 Hz, 3H, H-3"), 1.35-1.21 (m, 4H, H-2''', H-3'''), 0.99-0.79 (m, 3H, H-4''').

$^{13}$C-NMR (101 MHz, $CDCl_3$), δ/ppm: 163.3, 142.2, 138.5, 129.3, 121.3, 114.8, 61.2, 61.2, 36.8, 31.7, 26.7, 22.6, 14.5, 14.1.

HRMS (APCI+), m/z: calculated for $[C_{16}H_{22}N_2O_2+H]^+$ 275.1754, found 275.1758.

Example 29: Ethyl 5-(4-bromobutyl)-1-phenyl-4,5-dihydro-1H-pyrazole-3-carboxylate

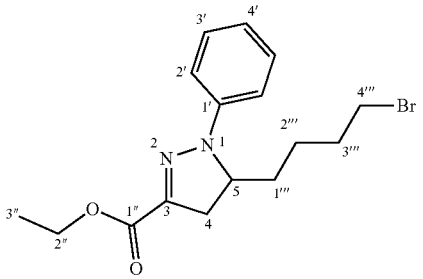

Synthesis according to synthetic method variant A using ethyl 2-(2-phenylhydrazono)acetate (3 mmol, 577 mg, 1 eq.) and 6-bromo-1-hexene (8.1 mmol, 1321 mg, 2.7 eq.). After flash column chromatography on silica with cyclohexane/ethyl acetate (0%→3% EtOAc), the pyrazoline was obtained as a yellow oil (0.99 mmol, 348 mg, 33%).

$^{1}$H-NMR (400 MHz, $CDCl_3$), δ/ppm: 7.33-7.27 (m, 2H, H-3'), 7.20-7.16 (m, 2H, H-2'), 6.94 (tt, J=7.3, 1.1 Hz, 1H, H-4'), 4.53 (dddd, J=11.9, 8.9, 5.2, 2.6 Hz, 1H, H-5), 4.34 (q, J=7.1 Hz, 2H, H-2"), 3.37 (td, J=6.7, 2.4 Hz, 2H, H-4'''), 3.30 (dd, J=17.8, 12.3 Hz, 1H, (H-4)'), 2.94 (dd, J=17.7, 5.2 Hz, 1H, (H-4)"), 1.89-1.72 (m, 3H, (H-1'''))', H-3'''), 1.62-1.51 (m, 1H, (H-1'''))"), 1.46 (dtd, J=12.1, 9.3, 6.1 Hz, 2H, H-2'''), 1.37 (t, J=7.1 Hz, 3H, H-3").

$^{13}$C-NMR (101 MHz, $CDCl_3$), δ/ppm: 163.1, 142.1, 138.6, 129.3, 121.4, 114.8, 61.2, 60.9, 36.8, 33.3, 32.3, 31.0, 23.2, 14.5.

HRMS (ESI+), m/z: calculated for $[C_{16}H_{21}{}^{79}BrN_2O_2+H]^+$ 353.0859, found 353.0864; calculated for $[C_{16}H_{21}{}^{81}BrN_2O_2+H]^+$ 355.0839, found 355.0845.

Example 30: Ethyl 5-cyclohexyl-1-phenyl-4,5-dihydro-1H-pyrazole-3-carboxylate

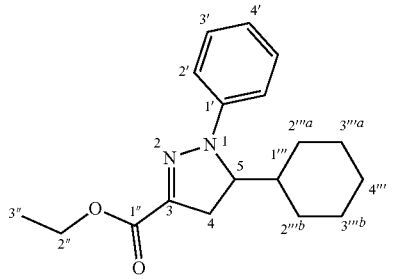

Synthesis according to synthetic method variant A using ethyl 2-(2-phenylhydrazono)acetate (3 mmol, 577 mg, 1 eq.) and vinylcyclohexane (8.1 mmol, 893 mg, 2.7 eq.). After flash column chromatography on silica with cyclohexane/ethyl acetate (0%→3% EtOAc), the pyrazoline was obtained as an orange solid (0.85 mmol, 254 mg, 28%).

$^1$H-NMR (400 MHz, $CDCl_3$), δ/ppm: 7.34-7.24 (m, 2H, H-3'), 7.25-7.17 (m, 2H, H-2'), 6.94 (tt, J=7.2, 1.2 Hz, 1H, H-4'), 4.50 (ddd, J=12.1, 6.7, 3.5 Hz, 1H, H-5), 4.33 (q, J=7.1 Hz, 2H, H-2"), 3.10 (dd, J=18.0, 12.1 Hz, 1H, (H-4)'), 3.05 (dd, J=18.1, 6.6 Hz, 1H, (H-4)"), 2.01 (m, 1H, H-1'''), 1.83-1.75 (m, 1H, (H-3'''$^b$)'), 1.70-1.61 (m, 2H, (H-2'''$^b$)'), (H-3'''$^a$)), 1.60-1.55 (m, 1H, (H-4''')'), 1.37 (t, J=7.1 Hz, 3H, H-3"), 1.43-1.31 (m, 1H, (H-2'''a)'), 1.30-1.18 (m, 1H, (H-3'''$^b$)"), 1.15-1.00 (m, 3H, (H-2'''$^b$)", (H-3'''$^a$)") (H-4''')"), 1.00-0.86 (m, 1H, (2'''$^{aa}$)").

$^{13}$C-NMR (101 MHz, $CDCl_3$), δ/ppm: 163.1, 142.4, 138.7, 129.2, 121.2, 115.1, 65.6, 61.1, 38.3, 32.4, 28.6, 26.4, 26.2, 25.6, 24.7, 14.5.

HRMS (ESI+), m/z: calculated for $[C_{18}H_{24}N_2O_2+H]^+$ 301.1911, found 301.1906.

Example 31: Ethyl 5-(9H-carbazol-9-yl)-1-phenyl-4,5-dihydro-1H-pyrazole-3-carboxylate

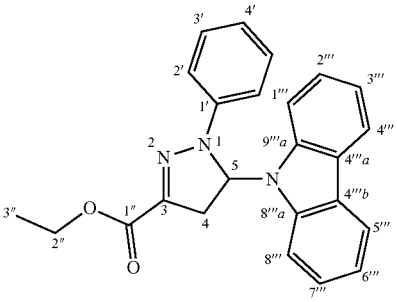

Synthesis according to synthetic method variant A using ethyl 2-(2-phenylhydrazono)acetate (3 mmol, 577 mg, 1 eq.) and N-vinylcarbazole (8.1 mmol, 1565 mg, 2.7 eq.). After flash column chromatography on silica with cyclohexane/ethyl acetate (0%→3% EtOAc), the pyrazoline was obtained as an orange solid (1.68 mmol, 643 mg, 56%).

$^1$H-NMR (400 MHz, DMSO-$d_6$), δ/ppm: 8.18 (d, J=7.6 Hz, 1H, H-4'''), 8.15 (d, J=7.7 Hz, 1H, H-5'''), 8.07 (d, J=8.3 Hz, 1H, H-1'''), 7.66-7.55 (m, 2H, H-5, H-2'''), 7.36 (ddd, J=8.4, 7.2, 1.3 Hz, 1H, H-7'''), 7.34-7.30 (m, 1H, H-3'''), 7.19 (ddd, J=7.9, 7.3, 0.9 Hz, 1H, H-6'''), 7.12-7.03 (m, 2H, H-3'), 7.07-6.99 (m, 2H, H-2'), 6.98 (dd, J=8.3, 0.9 Hz, 1H, H-8'''), 6.78 (tt, J=7.1, 1.3 Hz, 1H, H-4'), 4.34 (q, J=7.1 Hz, 2H, H-2"), 3.85 (dd, J=19.4, 12.9 Hz, 1H, (H-4)'), 3.19 (dd, J=19.4, 5.9 Hz, 1H, (H-4)"), 1.32 (t, J=7.1 Hz, 3H, H-3") 25

$^{13}$C-NMR (101 MHz, DMSO-$d_6$), δ/ppm: 161.6, 141.2, 139.6, 139.5, 136.4, 129.2, 126.5, 126.4, 123.8, 122.5, 121.7, 120.8, 120.6, 120.2, 120.1, 113.9, 109.8, 109.2, 69.5, 60.9, 37.4, 14.2.

HRMS (APCI+), m/z: calculated for $[C_{24}H_{21}N_3O_2+H]^+$ 384.1707, found 384.1703.

Example 32: 1,3,5-Triphenyl-4,5-dihydro-1H-pyrazole

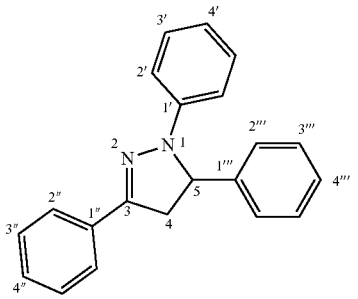

Synthesis according to synthetic method variant B using benzaldehyde phenylhydrazone (3.2 mmol, 625 mg, 1 eq.) and styrene (12.5 mmol, 1302 mg, 3.9 eq.). After reversed-phase flash column chromatography on C-18 silica with acetonitrile/water (65%→72% acetonitrile), the pyrazoline was obtained as a yellow solid (2.36 mmol, 704 mg, 74%).

$^1$H-NMR (400 MHz, $CDCl_3$), δ/ppm: 7.76-7.70 (m, 2H, H-2"), 7.42-7.37 (m, 2H, H-3"), 7.37-7.30 (m, 5H, H-4", H-2''', H-3'''), 7.30-7.24 (m, 1H, H-4'''), 7.23-7.16 (m, 2H, H-3'), 7.11-7.06 (m, 2H, H-2'), 6.79 (tt, J=7.2, 1.2 Hz, 1H, H-4'), 5.28 (dd, J=12.4, 7.3 Hz, 1H, H-5), 3.85 (dd, J=17.1, 12.4 Hz, 1H, (H-4)'), 3.15 (dd, J=17.0, 7.3 Hz, 1H, (H-4)").

$^{13}$C-NMR (101 MHz, $CDCl_3$), δ/ppm: 146.8, 145.0, 142.7, 132.9, 129.3, 129.0, 128.7, 128.7, 127.7, 126.0, 125.9, 119.2, 113.5, 64.6, 43.7.

HRMS (ESI+), m/z: calculated for $[C_{21}H_{18}N_2+H]^+$ 299.1543, found 299.1542.

Upscaling (38 mmol):

Analogously to synthetic method variant B, benzaldehyde phenylhydrazone (38.2 mmol, 7.5 g, 1 eq.) and styrene (149 mmol, 15.52 g, 3.9 eq.) were initially charged in a 300 ml beaker cell with a temperature-controlled jacket and a magnetic stirring bar with stabilization ring. tert-Butyl methyl ether (60 ml) and 1M aqueous sodium iodide solution (240 ml) were added. Galvanostatic electrolysis at 32 mA/cm$^2$ was carried out on a bipolar electrode stack composed of four sheets of isostatic graphite (each 100×50×5 mm, immersion depth 7 cm, active electrode area 105 cm$^2$ in total) at 32° C. and a stirring speed of 750 rpm until an applied amount of charge of 2.6 F was reached (9587 C). The biphasic mixture was transferred to a separating funnel, the phases were separated and the aqueous phase was extracted with ethyl acetate (1×100 ml). The combined organic phases were dried over magnesium sulfate, filtered and freed from solvent under reduced pressure. Unreacted styrene (8.0 g, 76.8 mmol, 2 eq.) was recovered by vacuum distillation. After recrystallization from isopropanol, the pyrazoline was obtained as a yellow solid (26.4 mmol, 7.89 g, 69%). The sodium iodide used was recovered (36.3 g, 242 mmol, quant.) by freeze-drying the aqueous phase separated off. An aliquot (3.0 g, 20 mmol) was reused in the synthesis of pyrazoline 1 (see above).

Example 33: 3-(4-Methylphenyl)-1,5-diphenyl-4,5-dihydro-1H-pyrazole

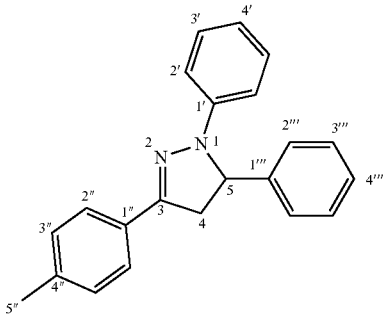

Synthesis according to synthetic method variant B using 4-methylbenzaldehyde phenylhydrazone (3.2 mmol, 673 mg, 1 eq.) and styrene (12.5 mmol, 1302 mg, 3.9 eq.). After reversed-phase flash column chromatography on C-18 silica with acetonitrile/water (50%→80% acetonitrile), the pyrazoline was obtained as a yellow solid (2.15 mmol, 672 mg, 67%).

$^1$H-NMR (400 MHz, DMSO-$d_6$), δ/ppm: 7.66-7.61 (m, 2H, H-2"), 7.36-7.31 (m, 2H, H-3'''), 7.30-7.21 (m, 5H, H-3", H-2''', H-4'''), 7.17-7.11 (m, 2H, H-3'), 7.01-6.96 (m, 2H, H-2'), 6.70 (tt, J=7.2, 1.1 Hz, 1H, H-4'), 5.44 (dd, J=12.2, 6.4 Hz, 1H, H-5), 3.89 (dd, J=17.4, 12.2 Hz, 1H, (H-4)'), 3.07 (dd, J=17.4, 6.4 Hz, 1H, (H-4)"), 2.33 (s, 3H, H-5").

$^{13}$C-NMR (101 MHz, DMSO-$d_6$), δ/ppm: 147.3, 144.4, 142.6, 138.3, 129.5, 129.2, 129.0, 128.8, 127.4, 125.8, 125.7, 118.4, 112.9, 63.1, 43.1, 21.0.

HRMS (ESI+), m/z: calculated for $[C_{22}H_{20}N_2+H]^+$ 313.1699, found 313.1701.

Example 34: 3-(4-tert-Butylphenyl)-1,5-diphenyl-4,5-dihydro-1H-pyrazole

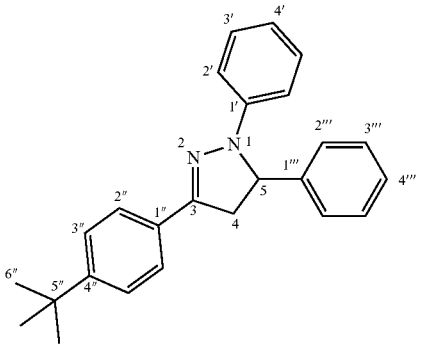

Synthesis according to synthetic method variant B using 4-tert-butylbenzaldehyde phenylhydrazone (3.2 mmol, 808 mg, 1 eq.) and styrene (12.5 mmol, 1302 mg, 3.9 eq.). After reversed-phase flash column chromatography on C-18 silica with acetonitrile/water (75%→85% acetonitrile), the pyrazoline was obtained as a yellow solid (0.80 mmol, 285 mg, 25%).

$^1$H-NMR (400 MHz, $CDCl_3$), δ/ppm: 7.63-7.59 (m, 2H, H-2"), 7.38-7.33 (m, 2H, H-3"), 7.31-7.22 (m, 4H, H-2''', H-3'''), 7.20 (td, J=5.3, 3.0 Hz, 1H, H-4'''), 7.12 (tt, J=7.3, 2.1 Hz, 2H, H-3'), 7.05-6.98 (m, 2H, H-2'), 6.71 (tt, J=7.3, 1.2 Hz, 1H, H-4'), 5.20 (dd, J=12.3, 7.1 Hz, 1H, H-5), 3.78 (dd, J=17.0, 12.3 Hz, 1H, (H-4)'), 3.08 (dd, J=17.0, 7.1 Hz, 1H, (H-4)"), 1.28 (s, 9H, H-6").

$^{13}$C-NMR (101 MHz, $CDCl_3$), δ/ppm: 152.0, 146.9, 145.1, 142.8, 130.1, 129.2, 129.0, 127.6, 126.0, 125.7, 125.6, 119.0, 113.4, 64.5, 43.8, 34.9, 31.4.

HRMS (ESI+), m/z: calculated for $[C_{25}H_{26}N_2+H]^+$ 355.2169, found 355.2175.

Example 35: 3-(4-Phenylphenyl)-1,5-diphenyl-4,5-dihydro-1H-pyrazole

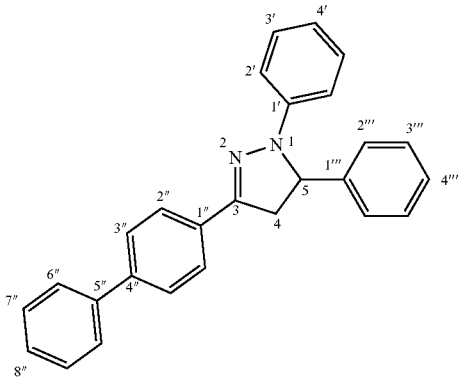

Synthesis according to synthetic method variant B using 4-phenylbenzaldehyde phenylhydrazone (3.2 mmol, 872 mg, 1 eq.) and styrene (12.5 mmol, 1302 mg, 3.9 eq.). After reversed-phase flash column chromatography on C-18 silica with acetonitrile/water (70%→100% acetonitrile), the pyrazoline was obtained as a dark yellow solid (0.65 mmol, 244 mg, 20%).

$^1$H-NMR (400 MHz, DMSO-$d_6$), δ/ppm: 7.86-7.81 (m, 2H, H-2"), 7.76-7.70 (m, 4H, H-3", H-6"), 7.53-7.21 (m, 8H, H-7", H-8", H-2''', H-3''', H-4'''), 7.20-7.12 (m, 2H, H-3'), 7.08-6.97 (m, 2H, H-2'), 6.72 (tt, J=7.3, 1.2 Hz, 1H, H-4'), 5.51 (dd, J=12.2, 6.3 Hz, 1H, H-5), 3.96 (dd, J=17.5, 12.2 Hz, 1H, (H-4)'), 3.15 (dd, J=17.5, 6.3 Hz, 1H, (H-4)").

$^{13}$C-NMR (101 MHz, DMSO-$d_6$), δ/ppm: 146.9, 144.1, 142.6, 140.1, 131.4, 129.0, 128.9, 128.5, 127.4, 126.8, 126.5, 126.3, 125.9, 125.3, 118.7, 113.0, 63.2, 43.0.

HRMS (ESI+), m/z: calculated for $[C_{27}H_{22}N_2+H]^+$ 375.1856, found 375.1848.

Example 36: 3-(Naphth-2-yl)-1,5-diphenyl-4,5-dihydro-1H-pyrazole

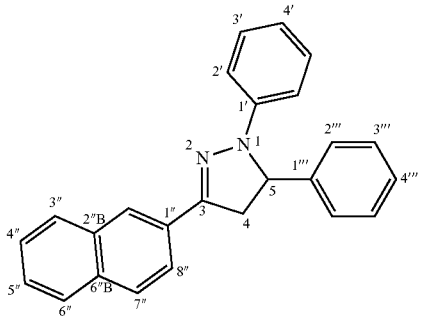

Synthesis according to synthetic method variant B using 2-formylnaphthalene phenylhydrazone (3.2 mmol, 788 mg, 1 eq.) and styrene (12.5 mmol, 1302 mg, 3.9 eq.). After flash column chromatography on silica with cyclohexane/ethyl acetate (0%→3% EtOAc), the pyrazoline was obtained as a yellow solid (0.79 mmol, 275 mg, 25%).

$^{1}$H-NMR (400 MHz, $CDCl_3$), δ/ppm: 8.18 (dd, J=8.6, 1.7 Hz, 1H, H-8"), 7.88-7.77 (m, 4H, H-2", H-3", H-6", H-7"), 7.50-7.45 (m, 2H, H-4", H-5"), 7.37-7.32 (m, 4H, H-2'", H-3'"), 7.30-7.24 (m, 1H, H-4'"), 7.24-7.17 (m, 2H, H-3'), 7.15-7.10 (m, 2H, H-2'), 6.80 (tt, J=7.2, 1.2 Hz, 1H, H-4'), 5.34 (dd, J=12.4, 7.2 Hz, 1H, H-5), 3.97 (dd, J=16.9, 12.4 Hz, 1H, (H-4)'), 3.28 (dd, J=16.9, 7.2 Hz, 1H, (H-4)").

$^{13}$C-NMR (101 MHz, $CDCl_3$), δ/ppm: 146.9, 144.9, 142.7, 133.6, 133.5, 130.6, 129.3, 129.1, 128.3, 128.2, 128.0, 127.7, 126.6, 126.5, 126.0, 125.2, 123.6, 119.3, 113.6, 64.7, 43.7.

HRMS (ESI+), m/z: calculated for $[C_{25}H_{20}N_2+H]^+$ 349.1699, found 349.1707.

Example 37: 3-(4-Fluorophenyl)-1,5-diphenyl-4,5-dihydro-1H-pyrazole

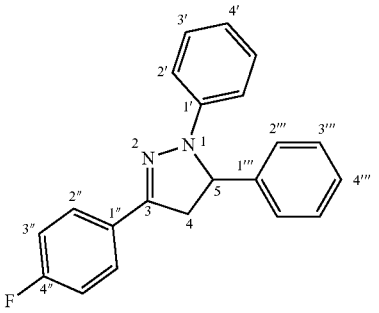

Synthesis according to synthetic method variant B using 4-fluorobenzaldehyde phenylhydrazone (3.2 mmol, 686 mg, 1 eq.) and styrene (12.5 mmol, 1302 mg, 3.9 eq.). After flash column chromatography on silica with cyclohexane/ethyl acetate (0%→2% EtOAc), the pyrazoline was obtained as an orange solid (2.44 mmol, 772 mg, 76%).

$^{1}$H-NMR (400 MHz, $CD_2Cl_2$), δ/ppm: 7.77-7.67 (m, 2H, H-2"), 7.39-7.24 (m, 5H, H-2'", H-3'", H-4'"), 7.19-7.14 (m, 2H, H-3'), 7.13-7.07 (m, 2H, H-3"), 7.07-7.02 (m, 2H, H-2'), 6.76 (tt, J=7.3, 1.2 Hz, 1H, H-4'), 5.31 (dd, J=12.3, 7.3 Hz, 1H, H-5), 3.85 (dd, J=17.1, 12.3 Hz, 1H, (H-4)'), 3.12 (dd, J=17.1, 7.1 Hz, 1H, (H-4)").

$^{13}$C-NMR (101 MHz, $CD_2Cl_2$), δ/ppm: 164.6, 162.1, 146.4, 145.2, 143.0, 129.5, 129.2, 128.0, 127.9, 127.8, 126.3, 119.4, 116.0, 115.8, 113.6, 64.8, 44.0. $^{19}$F-NMR (376 MHz, $CD_3CN$), δ/ppm: −115.4.

HRMS (APCI+), m/z: calculated for $[C_{21}H_{17}FN_2+H]^+$ 317.1449, found 317.1446.

Example 38: 3-(4-Chlorophenyl)-1,5-diphenyl-4,5-dihydro-1H-pyrazole

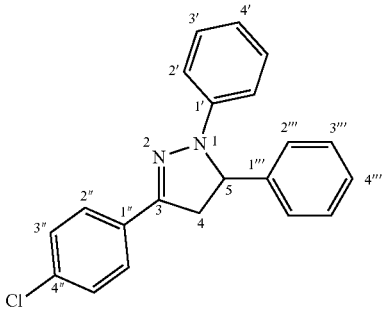

Synthesis according to synthetic method variant B using 4-chlorobenzaldehyde phenylhydrazone (3.2 mmol, 738 mg, 1 eq.) and styrene (12.5 mmol, 1302 mg, 3.9 eq.). After flash column chromatography on silica with cyclohexane/ethyl acetate (0%→3% EtOAc), the pyrazoline was obtained as a colorless solid (2.25 mmol, 749 mg, 70%).

$^{1}$H-NMR (400 MHz, $(CD_3)_2CO$), δ/ppm: 7.82-7.74 (m, 2H, H-2"), 7.47-7.37 (m, 2H, H-3"), 7.39-7.29 (m, 4H, H-2'", H-3'"), 7.32-7.20 (m, 1H, H-4'"), 7.19-7.09 (m, 2H, H-3'), 7.10-7.03 (m, 2H, H-2'), 6.73 (tt, J=7.2, 1.3 Hz, 1H, H-4'), 5.47 (dd, J=12.4, 6.8 Hz, 1H, H-5), 3.96 (dd, J=17.4, 12.4 Hz, 1H, (H-4)'), 3.13 (dd, J=17.4, 6.8 Hz, 1H, (H-4)").

$^{13}$C-NMR (101 MHz, $(CD_3)_2CO$), δ/ppm: 206.3, 146.8, 145.5, 143.7, 134.5, 132.7, 129.9, 129.6, 129.5, 128.4, 128.1, 126.8, 119.8, 114.2, 65.0, 43.9.

HRMS (ESI+), m/z: calculated for $[C_{21}H_{17}{}^{35}ClN_2+H]^+$ 333.1153, found 333.1151; calculated for $[C_{21}H_{17}{}^{37}ClN_2+H]^+$ 335.1131, found 335.1133.

Example 39: 3-(4-Bromophenyl)-1,5-diphenyl-4,5-dihydro-1H-pyrazole

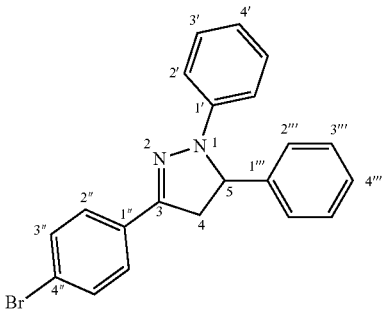

Synthesis according to synthetic method variant B using 4-bromobenzaldehyde phenylhydrazone (3.2 mmol, 880 mg, 1 eq.) and styrene (12.5 mmol, 1302 mg, 3.9 eq.). After flash column chromatography on silica with cyclohexane/ethyl acetate (0%→2% EtOAc), the pyrazoline was obtained as a yellow solid (1.95 mmol, 737 mg, 61%).

$^{1}$H-NMR (400 MHz, DMSO-$d_6$), δ/ppm: 7.73-7.64 (m, 2H, H-2"), 7.64-7.58 (m, 2H, H-3"), 7.38-7.21 (m, 5H, H-2'", H-3'", H-4'"), 7.19-7.10 (m, 2H, H-3'), 7.07-6.96 (m, 2H, H-2'), 6.72 (tt, J=7.3, 1.1 Hz, 1H, H-4'), 5.50 (dd, J=12.3, 6.4 Hz, 1H, H-5), 3.91 (dd, J=17.5, 12.4 Hz, 1H, (H-4)'), 3.10 (dd, J=17.5, 6.4 Hz, 1H, (H-4)").

$^{13}$C-NMR (101 MHz, DMSO-$d_6$), δ/ppm: 146.2, 144.0, 142.4, 131.6, 131.5, 129.0, 128.9, 127.6, 127.5, 125.8, 121.7, 118.8, 113.0, 63.3, 42.7.

HRMS (ESI+), m/z: calculated for $[C_{21}H_{17}{}^{79}BrN_2+H]^+$ 377.0648, found 377.0650; calculated for $[C_{21}H_{17}{}^{81}BrN_2+H]^+$ 379.0630, found 379.0632.

Example 40: 3-(2,6-Dichlorophenyl)-1,5-diphenyl-4,5-dihydro-1H-pyrazole

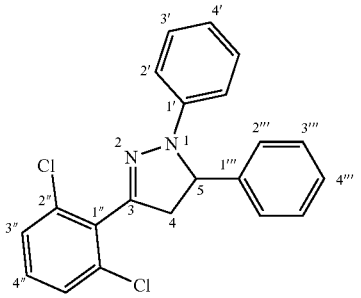

Synthesis according to synthetic method variant B using 2,6-dichlorobenzaldehyde phenylhydrazone (3.2 mmol, 848 mg, 1 eq.) and styrene (12.5 mmol, 1302 mg, 3.9 eq.). After reversed-phase flash column chromatography on C-18 silica with acetonitrile/water (50%→80% acetonitrile), the pyrazoline was obtained as a yellow oil (2.60 mmol, 955 mg, 81%).

$^{1}$H-NMR (400 MHz, DMSO-$d_6$), δ/ppm: 7.60-7.56 (m, 2H, H-3"), 7.48 (dd, J=8.9, 7.2 Hz, 1H, H-4"), 7.42-7.33 (m, 4H, H-2'", H-3'"), 7.30-7.24 (m, 1H, H-4'"), 7.17-7.08 (m, 2H, H-3'), 6.96-6.89 (m, 2H, H-2'), 6.72 (tt, J=7.2, 1.1 Hz, 1H, H-4'), 5.53 (dd, J=12.4, 6.8 Hz, 1H, H-5), 3.85 (dd, J=17.9, 12.4 Hz, 1H, (H-4)'), 2.97 (dd, J=17.9, 6.9 Hz, 1H, (H-4)").

$^{13}$C-NMR (101 MHz, DMSO-$d_6$), δ/ppm: 144.4, 144.3, 142.3, 134.5, 131.5, 131.1, 128.9, 128.9, 128.5, 127.5, 126.1, 119.0, 113.0, 63.3, 45.9.

HRMS (ESI+), m/z: calculated for $[C_{21}H_{16}{}^{35}Cl_2N_2+H]^+$ 367.0763, found 367.0758; calculated for $[C_{21}H_{16}{}^{35}Cl^{37}ClN_2+H]^+$ 369.0738, found 369.0735; calculated for $[C_{21}H_{16}{}^{37}Cl_2N_2+H]^+$ 371.0718, found 371.0725.

Example 41: 1,5-Diphenyl-3-(4-(trifluoromethyl) phenyl)-4,5-dihydro-1H-pyrazole

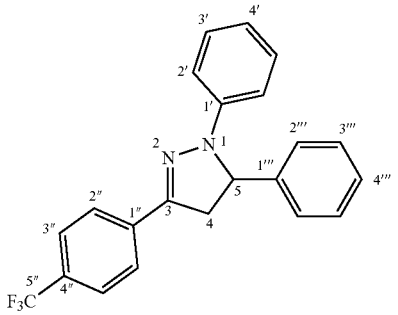

Synthesis according to synthetic method variant B using 4-trifluoromethylbenzaldehyde phenylhydrazone (3.2 mmol, 846 mg, 1 eq.) and styrene (12.5 mmol, 1302 mg, 3.9 eq.). After flash column chromatography on silica with cyclohexane/ethyl acetate (0%→2% EtOAc), the pyrazoline was obtained as a yellow solid (1.21 mmol, 445 mg, 38%).

$^{1}$H-NMR (400 MHz, $CD_2Cl_2$), δ/ppm: 7.88-7.79 (m, 2H, H-2"), 7.68-7.62 (m, 2H, H-3"), 7.39-7.25 (m, 5H, H-2'", H-3'", H-4'"), 7.22-7.14 (m, 2H, H-3'), 7.11-7.05 (m, 2H, H-2'), 6.80 (tt, J=7.2, 1.2 Hz, 1H, H-4'), 5.39 (dd, J=12.5, 6.9 Hz, 1H, H-5), 3.88 (dd, J=17.2, 12.5 Hz, 1H, (H-4)'), 3.16 (dd, J=17.2, 7.0 Hz, 1H, (H-4)").

$^{13}$C-NMR (101 MHz, $CD_2Cl_2$), δ/ppm: 145.6, 144.6, 142.7, 136.8, 123.0 (q, J=32.5 Hz), 129.5, 129.3, 128.8, 126.3, 126.1, 125.8 (q, J=3.9 Hz), 124.7 (q, J=271.9 Hz), 119.9, 113.9, 64.9, 43.5. $^{19}$F-NMR (376 MHz, $CD_2Cl_2$), δ/ppm: −64.0.

HRMS (APCI+), m/z: calculated for $[C_{22}H_{17}F_3N_2+H]^+$ 367.1417, found 367.1411.

Example 42: 3-(4-Cyanophenyl)-1,5-diphenyl-4,5-dihydro-1H-pyrazole

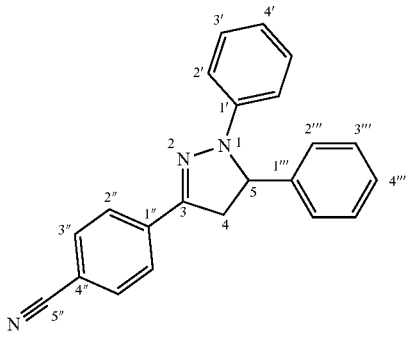

Synthesis according to synthetic method variant B using 4-cyanobenzaldehyde phenylhydrazone (3.2 mmol, 708 mg, 1 eq.) and styrene (12.5 mmol, 1302 mg, 3.9 eq.). After flash column chromatography on silica with cyclohexane/ethyl acetate (0%→2% EtOAc), the pyrazoline was obtained as a bright yellow solid (1.79 mmol, 579 mg, 56%).

$^{1}$H-NMR (400 MHz, DMSO-$d_6$), δ/ppm: 7.89 (d, J=8.6 Hz, 2H, H-2"), 7.85 (d, J=8.6 Hz, 2H, H-3"), 7.34 (dd, J=8.0, 6.8 Hz, 2H, H-3'"), 7.32-7.21 (m, 3H, H-2'", H-4'"), 7.22-

7.13 (m, 2H, H-3'), 7.09-7.01 (m, 2H, H-2'), 6.81-6.72 (m, 1H, H-4'), 5.60 (dd, J=12.5, 6.3 Hz, 1H, H-5), 3.93 (dd, J=17.6, 12.5 Hz, 1H, (H-4)'), 3.15 (dd, J=17.6, 6.3 Hz, 1H, (H-4)").

$^{13}$C-NMR (101 MHz, DMSO-$d_6$), δ/ppm: 145.4, 143.4, 142.1, 136.7, 132.5, 129.1, 129.0, 127.6, 126.1, 125.8, 119.4, 118.9, 113.3, 110.1, 63.5, 42.3.

HRMS (APCI+), m/z: calculated for $[C_{22}H_{17}N_3+H]^+$ 324.1495, found 324.1487.

Example 43: Methyl 4-(1,5-diphenyl-4,5-dihydro-1H-pyrazol-3-yl)benzoate

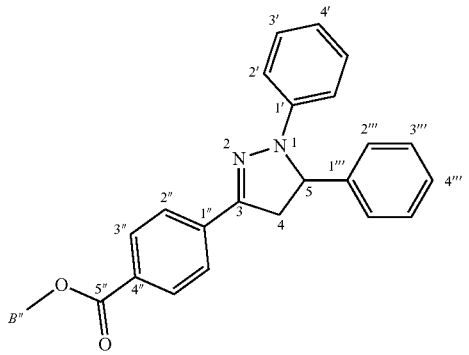

Synthesis according to synthetic method variant B using methyl 4-formylbenzoate phenylhydrazone (3.2 mmol, 814 mg, 1 eq.) and styrene (12.5 mmol, 1302 mg, 3.9 eq.). After flash column chromatography on silica with cyclohexane/ethyl acetate (0%→3% EtOAc), the pyrazoline was obtained as a bright yellow solid (2.32 mmol, 826 mg, 72%).

$^1$H-NMR (400 MHz, DMSO-$d_6$), δ/ppm: 8.02-7.95 (m, 2H, H-3"), 7.89-7.83 (m, 2H, H-2"), 7.39-7.31 (m, 2H, H-3'''), 7.31-7.21 (m, 3H, H-2''', H-4'''), 7.21-7.14 (m, 2H, H-3'), 7.08-7.01 (m, 2H, H-2'), 6.75 (tt, J=7.1, 1.2 Hz, 1H, H-4'), 5.58 (dd, J=12.4, 6.2 Hz, 1H, H-5), 3.95 (dd, J=17.5, 12.5 Hz, 1H, (H-4)'), 3.86 (s, 3H, H-6"), 3.15 (dd, J=17.5, 6.3 Hz, 1H, (H-4)").

$^{13}$C-NMR (101 MHz, DMSO-$d_6$), δ/ppm: 165.9, 146.0, 143.6, 142.2, 136.7, 129.5, 129.1, 128.9, 128.9, 127.5, 125.8, 125.7, 119.2, 113.2, 63.3, 52.2, 42.6.

HRMS (APCI+), m/z: calculated for $[C_{23}H_{20}N_2O_2+H]^+$ 357.1598, found 357.1597.

Example 44: 3-(4-Nitrophenyl)-1,5-diphenyl-4,5-dihydro-1H-pyrazole

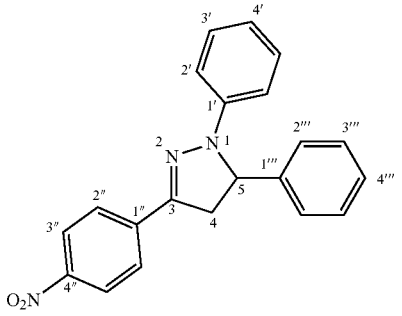

Synthesis according to synthetic method variant B using 4-nitrobenzaldehyde phenylhydrazone (3.2 mmol, 772 mg, 1 eq.) and styrene (12.5 mmol, 1302 mg, 3.9 eq.). After flash column chromatography on silica with cyclohexane/ethyl acetate (0%→5% EtOAc), the pyrazoline was obtained as a red solid (1.70 mmol, 588 mg, 53%). Recrystallization from methanol gave red needles.

$^1$H-NMR (400 MHz, DMSO-$d_6$), δ/ppm: 8.29-8.23 (m, 2H, H-3"), 7.99-7.93 (m, 2H, H-2"), 7.35 (dd, J=8.0, 6.8 Hz, 2H, H-3'''), 7.31-7.23 (m, 3H, H-2''', H-4'''), 7.22-7.16 (m, 2H, H-3'), 7.11-7.05 (m, 2H, H-2'), 6.78 (tt, J=7.2, 1.2 Hz, 1H, H-4'), 5.65 (dd, J=12.6, 6.2 Hz, 1H, H-5), 3.97 (dd, J=17.6, 12.6 Hz, 1H, (H-4)'), 3.19 (dd, J=17.6, 6.2 Hz, 1H, (H-4)").

$^{13}$C-NMR (101 MHz, DMSO-$d_6$), δ/ppm: 146.5, 145.1, 143.2, 142.0, 138.7, 129.1, 129.0, 127.6, 126.3, 125.8, 124.0, 119.7, 113.4, 63.6, 42.3.

HRMS (APCI+), m/z: calculated for $[C_{21}H_{17}N_3O_2+H]^+$ 344.1394, found 344.1388.

Example 45: 2-Phenyl-2,3,3a,4-tetrahydrochromeno[4,3-c]pyrazole (45)

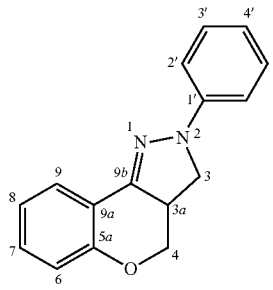

Synthesis according to synthetic method variant B using 2-allyloxybenzaldehyde phenylhydrazone (3.2 mmol, 807 mg, 1 eq.) and styrene (12.5 mmol, 1302 mg, 3.9 eq.). After reversed-phase flash column chromatography on C-18 silica with acetonitrile/water (50%→80% acetonitrile), the pyrazoline was obtained as an orange oil (1.79 mmol, 447 mg, 56%).

$^1$H-NMR (400 MHz, $CD_3CN$), δ/ppm: 7.78 (dd, J=7.7, 1.7 Hz, 1H, H-9), 7.32-7.24 (m, 3H, H-7, H-3'), 7.14-7.09 (m, 2H, H-2'), 7.00 (td, J=7.5, 1.1 Hz, 1H, H-8), 6.93 (dd, J=8.3, 1.1 Hz, 1H, H-3), 6.85 (tt, J=7.3, 1.2 Hz, 1H, H-4'), 4.72 (dd, J=10.3, 5.8 Hz, 1H, (H-4)'), 4.24 (dd, J=10.6, 9.7 Hz, 1H, (H-3)'), 4.11 (dd, J=12.3, 10.3 Hz, 1H, (H-4)"), 3.81 (dddd, J=13.3, 12.4, 10.6, 5.8 Hz, 1H, H-3a), 3.28 (dd, J=13.2, 9.7 Hz, 1H, (H-3)').

$^{13}$C-NMR (101 MHz, $CD_3CN$), δ/ppm: 156.9, 147.8, 147.7, 131.8, 130.1, 125.0, 122.5, 120.3, 118.3, 118.2, 117.6, 114.2, 70.5, 52.3, 43.2.

HRMS (APCI+), m/z: calculated for $[C_{16}H_{14}N_2O+H]^+$ 251.1179, found 251.1178.

Example 46:
3-Methyl-1,5-diphenyl-4,5-dihydro-1H-pyrazole

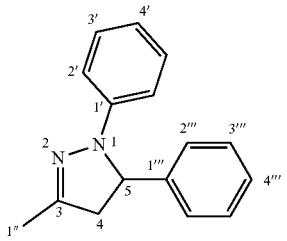

Synthesis according to synthetic method variant B using acetaldehyde phenylhydrazone (3 mmol, 403 mg, 1 eq.) and styrene (8.1 mmol, 844 mg, 2.7 eq.). Electrolysis under an argon atmosphere. After reversed-phase flash column chromatography on C-18 silica with acetonitrile/water (50%→60% acetonitrile), the pyrazoline was obtained as a dark red solid (1.15 mmol, 273 mg, 38%).

$^{1}$H-NMR (400 MHz, $CD_3CN$), δ/ppm: 7.33 (tt, J=6.8, 1.0 Hz, 2H, H-3'''), 7.29-7.20 (m, 3H, H-2''', H-4'''), 7.11-7.04 (m, 2H, H-3'), 6.86-6.79 (m, 2H, H-2'), 6.63 (tt, J=7.2, 1.1 Hz, 1H, H-4'), 5.11 (dd, J=11.9, 7.3 Hz, 1H, H-5), 3.48 (ddd, J=17.7, 11.9, 1.3 Hz, 1H, (H-4)'), 2.63 (ddd, J=17.6, 7.3, 1.2 Hz, 1H, (H-4)''), 2.00 (dd, J=1.2, 1.1 Hz, 3H, H-1'').

$^{13}$C-NMR (101 MHz, $CD_3CN$), δ/ppm: 149.1, 145.6, 143.1, 128.9, 128.7, 127.2, 125.9, 117.8, 112.5, 63.3, 47.3, 15.5.

HRMS (ESI+), m/z: calculated for $[C_{16}H_{16}N_2+H]^+$ 237.1386, found 237.1388.

Examples 47 and 48: 3-Cyclopropyl-1,5-diphenyl-4,5-dihydro-1H-pyrazole (47) and 3-cyclopropyl-1,5-diphenyl-1H-pyrazole (48)

47

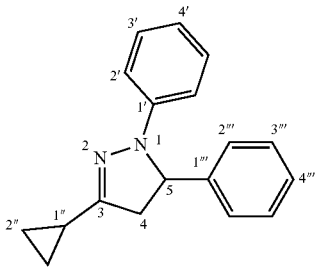

48

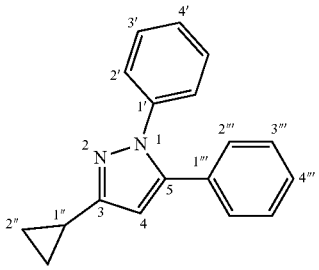

Synthesis according to synthetic method variant A using formylcyclopropane phenylhydrazone (3 mmol, 479 mg, 1 eq.) and styrene (8.1 mmol, 844 mg, 2.7 eq.). An amount of charge of 2 F (579 C) was applied. After flash column chromatography on silica with cyclohexane/ethyl acetate (0%→3% EtOAc) and purification by preparative HPLC (water (+1% by volume formic acid)/acetonitrile 70%→100% MeCN), the pyrazoline 47 was obtained as an orange oil (0.69 mmol, 180 mg, 23%). Pyrazole 48 was obtained as a byproduct as a yellow oil (0.23 mmol, 61 mg, 8%).

Analytical Data for
3-cyclopropyl-1,5-diphenyl-4,5-dihydro-1H-pyrazole
47

$^{1}$H-NMR (400 MHz, $CDCl_3$), δ/ppm: 7.36-7.29 (m, 2H, H-3'''), 7.28-7.21 (m, 3H, H-2''', H-4'''), 7.12-7.06 (m, 2H, H-3'), 6.89-6.84 (m, 2H, H-2'), 6.66 (tt, J=7.3, 1.1 Hz, 1H, H-4'), 5.06 (dd, J=11.7, 7.3 Hz, 1H, H-5), 3.31 (ddd, J=17.4, 11.7, 0.6 Hz, 1H, (H-4)'), 2.51 (dd, J=17.3, 7.3 Hz, 1H, (H-4)''), 1.82 (tt, J=8.4, 5.1 Hz, 1H, H-1''), 0.86-0.81 (m, 2H, (H-2'')'), 0.81-0.68 (m, 2H, (H-2'')').

$^{13}$C-NMR (101 MHz, $CDCl_3$), δ/ppm: 155.0, 146.9, 144.1, 129.9, 129.7, 128.3, 126.9, 119.0, 118.3, 113.8, 64.6, 44.4, 12.0, 6.3, 6.1.

HRMS (APCI+), m/z: calculated for $[C_{18}H_{18}N_2+H]^+$ 263.1543, found 263.1540.

Analytical Data for
3-cyclopropyl-1,5-diphenyl-1H-ptrazole 48

$^{1}$H-NMR (400 MHz, $CD_3CN$), δ/ppm: 7.31-7.20 (m, 6H, H-3', H-4', H-3''', H-4'''), 7.19-7.11 (m, 4H, H-2', H-2'''), 6.20 (d, J=1.3 Hz, 1H, H-4), 1.96-1.86 (m, 1H, H-1''), 0.93-0.85 (m, 2H, (H-2'')'), 0.76-0.68 (m, 2H, (H-2'')').

$^{13}$C-NMR (101 MHz, $CD_3CN$), δ/ppm: 156.6, 144.5, 141.3, 131.8, 129.8, 129.6, 129.4, 129.1, 128.1, 126.1, 118.3, 105.3, 9.8, 8.6.

HRMS (APCI+), m/z: calculated for $[C_{18}H_{16}N_2+H]^+$ 261.1386, found 261.1387.

Examples 49 and 50: 3-((1R,5S)-6,6-Dimethylbicyclo[3.1.1]hept-2-en-2-yl)-1,5-diphenyl-4,5-dihydro-1H-pyrazole (49) and (4R,6R)-5,5-dimethyl-1-phenyl-4,5,6,7-tetrahydro-1H-4,6-methanoindazole (50)

49

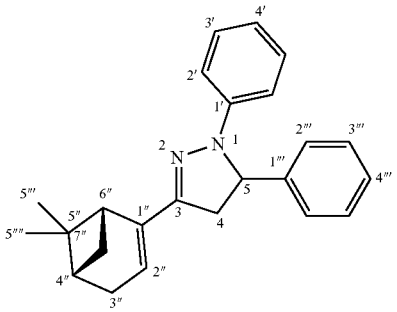

50

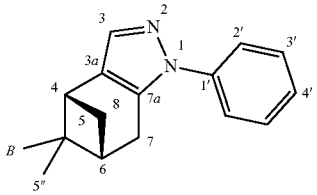

Synthesis according to synthetic method variant B using 2-allyloxybenzaldehyde phenylhydrazone (3.2 mmol, 769 mg, 1 eq.) and styrene (12.5 mmol, 1302 mg, 3.9 eq.). Electrolysis at 25° C. After flash column chromatography on silica with cyclohexane/ethyl acetate (0%→2% EtOAc), pyrazoline 49 was obtained as an orange solid (0.77 mmol, 264 mg, 24%). Pyrazoline 50 was obtained as a byproduct as a dark yellow solid (0.54 mmol, 129 mg, 17%).

Analytical Data for 3-((1R,5S)-6,6-dimethylbicyclo[3.1.1]hept-2-en-2-yl)-1,5-diphenyl-4,5-dihydro-1H-pyrazole 49

$^1$H-NMR (400 MHz, $CDCl_3$), δ/ppm: 7.36-7.21 (m, 5H, H-2''', H-3''', H-4'''), 7.14 (ddd, J=9.2, 7.2, 2.0 Hz, 2H, H-3'), 7.01-6.95 (m, 2H, H-2'), 6.74 (tt, J=7.2, 1.2 Hz, 1H, H-4'), 5.65 (qt, J=3.5, 1.4 Hz, 1H, H-2''), 5.12 (ddd, J=12.1, 7.8 Hz, 1H, H-5), 3.61 (ddd, J=16.5, 12.2, 3.9 Hz, 1H, (H-4)'), 3.20 (qd, J=6.0, 1.5 Hz, 1H, H-4''), 2.90 (ddd, J=16.7, 7.4, 4.8 Hz, 1H, (H-4)''), 2.52 (dtd, J=8.6, 5.7, 2.8 Hz, 1H, (H-3'')'), 2.44 (ddd, J=19.1, 3.3, 2.4 Hz, 1H, (H-7'')'), 2.38 (dt, J=19.2, 3.1 Hz, 1H, (H-7'')''), 2.16 (dddt, J=5.8, 4.3, 2.9, 1.5 Hz, 1H, H-6''), 1.40 (d, J=4.3 Hz, 3H, H-5'''), 1.22 (dd, J=8.9, 7.6 Hz, 1H, (H-3'')''), 0.85 (d, J=4.1 Hz, 3H, H-5''''). Inseparable mixture of 5R/S-diastereomers.

$^{13}$C-NMR (101 MHz, $CDCl_3$), δ/ppm: 148.4, 145.2, 143.0, 142.3, 129.2, 128.9, 127.5, 126.0, 124.7, 118.8, 113.4, 64.5, 42.9, 42.0, 40.8, 37.9, 32.4, 31.5, 26.4, 21.1. Inseparable mixture of 5R/S-diastereomers.

HRMS (APCI+), m/z: calculated for $[C_{24}H_{26}N_2+H]$ 343.2169, found 343.2155.

Analytical Data for (4R,6R)-5,5-dimethyl-1-phenyl-4,5,6,7-tetrahydro-1H-4,6-methanoindazole 50

$^1$H-NMR (400 MHz, $CDCl_3$), δ/ppm: 7.62-7.56 (m, 2H, H-2'), 7.40-7.33 (m, 2H, H-3'), 7.32 (d, J=0.6 Hz, 1H, H-4), 7.20 (tq, J=7.7, 1.0 Hz, 1H, H-4'), 3.03 (dd, J=16.4, 3.1 Hz, 1H, (H-8)'), 2.92 (dd, J=16.4, 2.7 Hz, 1H, (H-8)''), 2.70 (t, J=5.4 Hz, 1H, H-4), 2.62 (dt, J=9.3, 5.7 Hz, 1H, (H-7)'), 2.28 (tt, J=5.8, 2.9 Hz, 1H, H-6), 1.33 (s, 3H, H-5'), 1.29 (d, J=9.3 Hz, 1H, (H-7)''), 0.62 (s, 3H, H-5'').

$^{13}$C-NMR (101 MHz, $CDCl_3$), δ/ppm: 140.6, 136.4, 136.3, 129.2, 129.0, 126.2, 121.1, 41.4, 41.3, 39.3, 33.8, 29.1, 26.4, 21.3.

HRMS (APCI+), m/z: calculated for $[C_{16}H_{18}N_2+H]^+$ 239.1543, found 239.1545.

Example 51: Ethyl 1-(4-methylphenyl)-5-phenyl-4,5-dihydro-1H-pyrazole-3-carboxylate

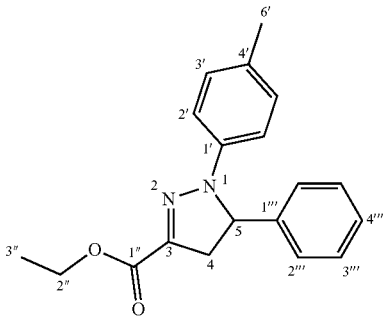

Synthesis according to synthetic method variant A using ethyl 2-(2-(4-methylphenyl)hydrazono)acetate (3 mmol, 619 mg, 1 eq.) and styrene (8.1 mmol, 844 mg, 2.7 eq.). After flash column chromatography on silica with cyclohexane/ethyl acetate (0%→300 EtOAc), the pyrazoline was obtained as a yellow solid (1.69 mmol, 522 mg, 56%).

$^1$H-NMR (400 MHz, $CDCl_3$), δ/ppm: 7.35-7.30 (in, 2H, H-3'''), 7.31-7.19 (in, 3H, H-2''', H-4'''), 7.02 (d, J=8.8 Hz, 2H, H-3'), 6.98 (d, J=8.9 Hz, 2H, H-2'), 5.40 (dd, J=13.3, 7.2 Hz, 1H, H-5), 4.34 (q, J=7.1 Hz, 2H, H-2''), 3.71 (dd, J=17.9, 13.3 Hz, 1H, (H-4)'), 3.04 (dd, J=17.9, 7.2 Hz, 1H, (H-4)''), 2.23 (s, 3H, H-5'), 1.38 (t, J=7.1 Hz, 3H, H-3'').

$^{13}$C-NMR (101 MHz, $CDCl_3$), δ/ppm: 162.9, 141.4, 140.4, 137.5, 130.7, 129.6, 129.3, 127.9, 125.7, 114.7, 0.65.6, 61.2, 42.2, 20.7, 14.5.

HRMS (APCI+), m/z: calculated for $[C_{19}H_{20}N_2O_2+H]^+$ 309.1598, found 309.1595.

Example 52: Ethyl 1-(4-fluorophenyl)-5-phenyl-4,5-dihydro-1H-pyrazole-3-carboxylate

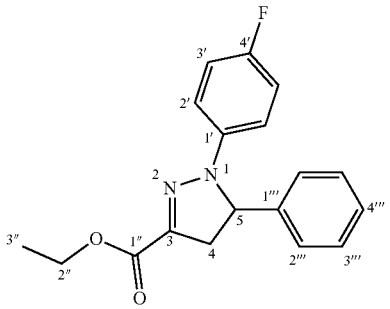

Synthesis according to synthetic method variant A using ethyl 2-(2-(4-fluorophenyl)hydrazono)acetate (3 mmol, 631 mg, 1 eq.) and styrene (8.1 mmol, 844 mg, 2.7 eq.). After flash column chromatography on silica with cyclohexane/ethyl acetate (0%→3% EtOAc), the pyrazoline was obtained as a yellow solid (2.58 mmol, 793 mg, 86%).

$^1$H-NMR (400 MHz, $CDCl_3$), δ/ppm: 7.36-7.30 (m, 2H, H-3'''), 7.30-7.24 (m, 1H, H-4'''), 7.24-7.19 (m, 2H, H-2'''), 7.07-7.00 (m, 2H, H-2'), 6.91-6.83 (m, 2H, H-3'), 5.36 (dd, J=13.2, 7.4 Hz, 1H, H-5), 4.33 (q, J=7.1 Hz, 2H, H-2''), 3.72 (dd, J=18.0, 13.2 Hz, 1H, (H-4)'), 3.05 (dd, J=18.0, 7.4 Hz, 1H, (H-4)''), 1.37 (t, J=7.1 Hz, 3H, H-3'').

$^{13}$C-NMR (101 MHz, $CDCl_3$), δ/ppm: 162.7, 159.2, 156.8, 141.0, 139.1, 139.1, 138.3, 129.4, 128.1, 125.8, 115.9, 115.8, 115.8, 115.5, 65.9, 61.3, 42.5, 14.4. $^{19}$F-NMR (376 MHz, $CDCl_3$), δ/ppm: −124.08 (tt, J=8.7, 4.7 Hz).

HRMS (ESI+), m/z: calculated for $[C_{18}H_{17}FN_2O_2+Na]^+$ 335.1166, found 335.1168.

Example 53: Ethyl 1-(4-chlorophenyl)-5-phenyl-4,5-dihydro-1H-pyrazole-3-carboxylate

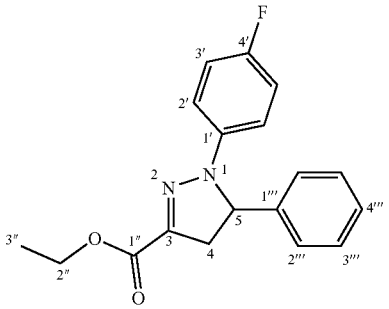

Synthesis according to synthetic method variant A using ethyl 2-(2-(4-chlorophenyl)hydrazono)acetate (3 mmol, 680 mg, 1 eq.) and styrene (8.1 mmol, 844 mg, 2.7 eq.). After flash column chromatography on silica with cyclohexane/ethyl acetate (0%→3% EtOAc), the pyrazoline was obtained as a yellow solid (2.65 mmol, 872 mg, 88%).

$^1$H-NMR (400 MHz, $CDCl_3$), δ/ppm: 7.34-7.28 (m, 2H, H-3'''), 7.30-7.20 (m, 1H, H-4'''), 7.19-7.15 (m, 2H, H-2'''), 7.12-7.06 (m, 2H, H-3'), 7.02-6.97 (m, 2H, H-2'), 5.35 (dd, J=13.2, 7.0 Hz, 1H, H-5), 4.31 (q, J=7.1 Hz, 2H, H-2''), 3.70 (dd, J=18.1, 13.2 Hz, 1H, (H-4)'), 3.03 (dd, J=18.1, 7.0 Hz, 1H, (H-4)''), 1.34 (t, J=7.1 Hz, 3H, H-3'').

$^{13}$C-NMR (101 MHz, $CDCl_3$), δ/ppm: 162.6, 141.3, 140.8, 139.0, 129.5, 129.0, 128.2, 126.3, 125.7, 115.8, 65.5, 61.5, 42.5, 14.5.

HRMS (APCI+), m/z: calculated for $[C_{18}H_{17}{}^{35}ClN_2O_2+H]^+$ 329.1051, found 329.1044; calculated for $[C_1H_{17}{}^{37}ClN_2O_2+H]^+$ 331.1028, found 331.1027.

Example 54: Ethyl 1-(4-bromophenyl)-5-phenyl-4,5-dihydro-1H-pyrazole-3-carboxylate

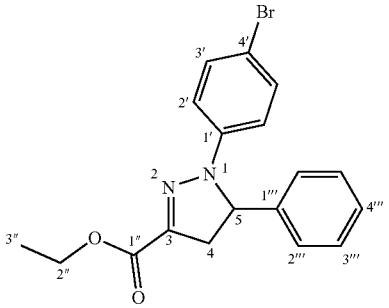

Synthesis according to synthetic method variant A using ethyl 2-(2-(4-bromophenyl)hydrazono)acetate (3 mmol, 813 mg, 1 eq.) and styrene (8.1 mmol, 844 mg, 2.7 eq.). After flash column chromatography on silica with cyclohexane/ethyl acetate (0%→3% EtOAc), the pyrazoline was obtained as an orange solid (2.80 mmol, 1044 mg, 93%).

$^1$H-NMR (400 MHz, $CDCl_3$), δ/ppm: 7.36-7.31 (m, 2H, H-3'''), 7.30-7.23 (m, 3H, H-3', H-4'''), 7.22-7.17 (m, 2H, H-2'''), 6.99-6.94 (m, 2H, H-2'), 5.37 (dd, J=13.2, 7.0 Hz, 1H, H-5), 4.34 (q, J=7.1 Hz, 2H, H-2''), 3.72 (dd, J=18.2, 13.2 Hz, 1H, (H-4)'), 3.05 (dd, J=18.1, 7.0 Hz, 1H, (H-4)''), 1.37 (t, J=7.1 Hz, 3H, H-3'').

$^{13}$C-NMR (101 MHz, $CDCl_3$), δ/ppm: 162.6, 141.7, 140.8, 139.1, 131.9, 129.5, 128.3, 125.7, 116.2, 113.8, 65.4, 61.5, 42.6, 14.5.

HRMS (ESI+), m/z: calculated for $[C_{18}H_{17}{}^{79}BrN_2O_2+H]^+$ 373.0547, found 373.0546; calculated for $[C_{18}H_{17}{}^{81}BrN_2O_2+H]^+$ 375.0526, found 375.0530.

Example 55: Ethyl 1-(2,4-dichlorophenyl)-5-phenyl-4,5-dihydro-1H-pyrazole-3-carboxylate

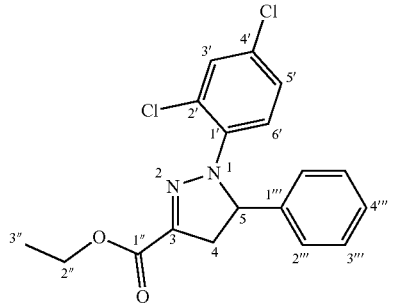

Synthesis according to synthetic method variant A using ethyl 2-(2-(2,4-dichlorophenyl)hydrazono)acetate (3 mmol, 783 mg, 1 eq.) and styrene (8.1 mmol, 844 mg, 2.7 eq.). After flash column chromatography on silica with cyclohexane/ethyl acetate (0%→3% EtOAc), the pyrazoline was obtained as a yellow solid (2.51 mmol, 913 mg, 84%).

$^1$H-NMR (400 MHz, $CDCl_3$), δ/ppm: 7.31 (d, J=8.8 Hz, 1H, H-6'), 7.29-7.16 (m, 4H, H-3', H-3''' H-4'''), 7.16 (dd, J=7.7, 1.9 Hz, 2H, H-2'''), 7.07 (dd, J=8.7, 2.4 Hz, 1H, H-5'), 5.90 (dd, J=12.5, 6.0 Hz, 1H, H-5), 4.41 (qd, J=7.1, 1.4 Hz, 2H, H-2''), 3.73 (dd, J=18.0, 12.6 Hz, 1H, (H-4)'), 3.35 (dd, J=18.0, 6.0 Hz, 1H, (H-4)''), 1.42 (t, J=7.1 Hz, 3H, H-3'').

$^{13}$C-NMR (101 MHz, $CDCl_3$), δ/ppm: 162.5, 141.6, 139.7, 139.4, 130.5, 130.0, 128.9, 128.5, 127.4, 126.7, 126.5, 126.2, 67.8, 61.5, 41.4, 14.5.

HRMS (APCI+), m/z: calculated for $[C_{18}H_{16}{}^{37}Cl_2N_2O_2+H]^+$ 363.0662, found 363.0658; calculated for $[C_{18}H_{16}{}^{35}C^{37}ClN_2O_2+H]^+$ 365.0635, found 365.0634; calculated for $[C_{18}H_{16}{}^{37}Cl_2N_2O_2+H]^+$ 367.0614, found 367.0613.

Example 56: Ethyl 1-(perfluorophenyl)-5-phenyl-4,5-dihydro-1H-pyrazole-3-carboxylate

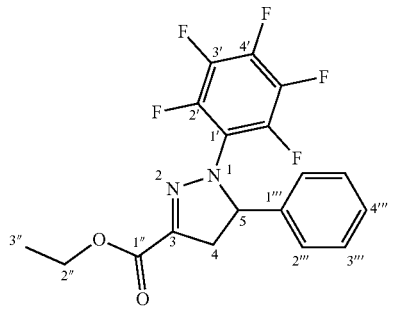

Synthesis according to synthetic method variant A using ethyl 2-(2-perfluorophenyl)hydrazono)acetate (3 mmol, 847 mg, 1 eq.) and styrene (8.1 mmol, 844 mg, 2.7 eq.). After flash column chromatography on silica with cyclohexane/ethyl acetate (0%→3% EtOAc), the pyrazoline was obtained as a brown oil (0.75 mmol, 288 mg, 25%).

$^{1}$H-NMR (400 MHz, $CDCl_3$), δ/ppm: 7.31-7.21 (m, 5H, H-2''', H-3''', H-4'''), 5.42 (dd, J=12.5, 9.5 Hz, 1H, H-5), 4.35 (q, J=7.1 Hz, 2H, H-2''), 3.65 (dd, J=18.1, 12.5 Hz, 1H, (H-4)'), 3.23 (dd, J=18.1, 9.5 Hz, 1H, (H-4)''), 1.35 (t, J=7.1 Hz, 3H, H-3'').

$^{13}$C-NMR (101 MHz, $CDCl_3$), δ/ppm: 162.2, 144.5, 142.5, 142.0, 139.1, 136.6, 129.2, 129.0, 128.8, 128.5, 126.8, 125.8, 118.3, 69.3, 61.8, 41.7, 14.4. $^{19}$F-NMR (376 MHz, $CDCl_3$), δ/ppm: −147.66--148.00 (m, F-3'), −158.85 (t, J=21.7 Hz, F-4'), −163.46--163.63 (m, F-2').

HRMS (APCI+), m/z: calculated for $[C_{18}H_{13}F_5N_2O_2+H]^+$ 385.0970, found 385.0967.

Example 57: Ethyl 1-(4-cyanophenyl)-5-phenyl-4,5-dihydro-1H-pyrazole-3-carboxylate (57)

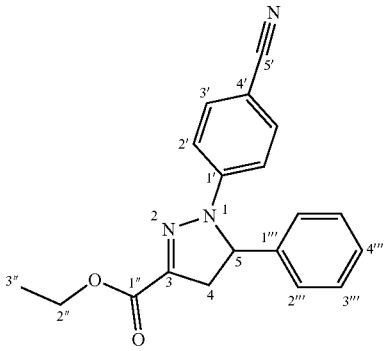

Synthesis according to synthetic method variant A using ethyl 2-(2-(4-cyanophenyl)hydrazono)acetate (3 mmol, 652 mg, 1 eq.) and styrene (8.1 mmol, 844 mg, 2.7 eq.). After flash column chromatography on silica with cyclohexane/ethyl acetate (0%→3% EtOAc), the pyrazoline was obtained as a yellow solid (2.71 mmol, 866 mg, 90%).

$^{1}$H-NMR (400 MHz, $CDCl_3$), δ/ppm: 7.46-7.41 (m, 2H, H-3'), 7.38-7.33 (m, 2H, H-3'''), 7.33-7.28 (m, 1H, H-4'''), 7.20-7.16 (m, 2H, H-2'''), 7.14-7.09 (m, 2H, H-2'), 5.43 (dd, J=13.0, 6.4 Hz, 1H, H-5), 4.35 (q, J=7.1 Hz, 2H, H-2''), 3.77 (dd, J=18.4, 13.0 Hz, 1H, (H-4)'), 3.11 (dd, J=18.4, 6.4 Hz, 1H, (H-4)''), 1.38 (t, J=7.1 Hz, 3H, H-3'').

$^{13}$C-NMR (101 MHz, $CDCl_3$), δ/ppm: 162.2, 145.7, 141.7, 140.1, 133.4, 129.7, 128.6, 125.5, 119.6, 114.5, 103.5, 64.9, 61.8, 42.8, 14.4.

HRMS (ESI+), m/z: calculated for $[C_9H_{17}N_3O_2+H]^+$ 320.1394, found 320.1393.

Example 58: 4-(3,5-Diphenyl-4,5-dihydro-1H-pyrazol-1-yl)benzenesulfonic acid

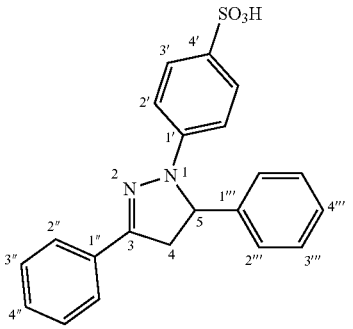

Synthesis according to synthetic method variant B using 4-(2-(2-ethoxy-2-oxoethylidene)hydrazinyl)benzenesulfonic acid (3.2 mmol, 884 mg, 1 eq.) and styrene (12.5 mmol, 1302 mg, 3.9 eq.). After reversed-phase flash column chromatography on C-18 silica with water/acetonitrile (50%→80% MeCN), traces of the pyrazoline were obtained.

HRMS (ESI−), m/z: calculated for $[C_{21}H_{18}N_2O_3S-H]^-$ 377.0965, found 377.0953.

Example 59: Ethyl 1-(2,4-dinitrophenyl)-5-phenyl-4,5-dihydro-1H-pyrazole-3-carboxylate

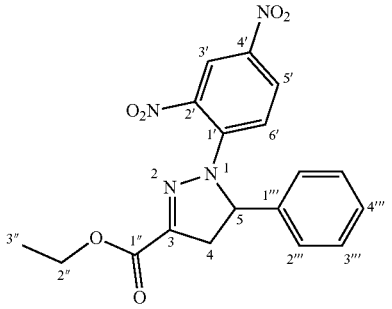

Synthesis according to synthetic method variant A using ethyl 2-(2-(2,4-dinitrophenyl)hydrazono)acetate (2 mmol, 564 mg, 1 eq.) and styrene (5.4 mmol, 562 mg, 2.7 eq.). Dichloromethane was used as organic solvent. The electrolysis was carried out at 35° C. After flash column chromatography on silica with cyclohexane/ethyl acetate (0%→3% EtOAc), the pyrazoline was obtained as an orange solid (0.57 mmol, 221 mg, 29%).

$^{1}$H-NMR (400 MHz, $CDCl_3$), δ/ppm: 8.46 (d, J=2.6 Hz, 1H, H-3'), 8.13 (dd, J=9.3, 2.6 Hz, 1H, H-5'), 7.37-7.28 (m, 3H, H-3''', H-4'''), 7.22-7.15 (m, 3H, H-6', H-2'''), 5.58 (dd, J=12.3, 7.4 Hz, 1H, H-5), 4.35 (qd, J=7.2, 1.0 Hz, 2H, H-2''), 3.81 (dd, J=18.7, 12.3 Hz, 1H, (H-4)'), 3.20 (dd, J=18.7, 7.5 Hz, 1H, (H-4)''), 1.38 (t, J=7.1 Hz, 3H, H-3'').

$^{13}$C-NMR (101 MHz, $CDCl_3$), δ/ppm: 161.4, 145.9, 140.3, 140.2, 138.6, 138.3, 129.9, 129.2, 127.2, 126.3, 122.2, 118.5, 66.2, 62.3, 43.2, 14.3.

HRMS (APCI+), m/z: calculated for $[C_{18}H_{16}N_4O_6+NH_4]^+$402.1408, found 402.1406.

Example 60: Ethyl 1-(4-methoxyphenyl)-5-phenyl-4,5-dihydro-1H-pyrazole-3-carboxylate

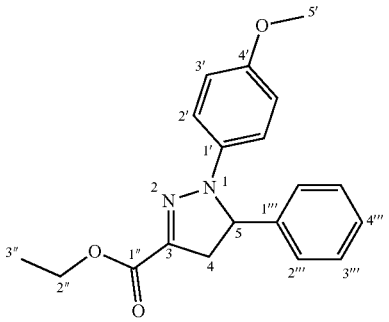

Synthesis according to synthetic method variant A using ethyl 2-(2-(4-methoxyphenyl)hydrazono)acetate (3 mmol, 667 mg, 1 eq.) and styrene (8.1 mmol, 844 mg, 2.7 eq.). After flash column chromatography on silica with cyclohexane/ethyl acetate (0%→3% EtOAc), the pyrazoline was obtained as a yellow solid (1.58 mmol, 511 mg, 53%).

$^1$H-NMR (400 MHz, $CDCl_3$), δ/ppm: 7.35-7.30 (m, 2H, H-3'''), 7.31-7.19 (m, 3H, H-2''', H-4'''), 7.06-7.01 (m, 2H, H-2'), 6.77-6.71 (m, 2H, H-3'), 5.36 (dd, J=13.3, 7.6 Hz, 1H, H-5), 4.33 (q, J=7.1 Hz, 2H, H-2''), 3.71 (s, 3H, H-5'), 3.70 (dd, J=17.9, 13.4 Hz, 1H, (H-4)'), 3.03 (dd, J=17.9, 7.6 Hz, 1H, (H-4)'), 1.36 (t, J=7.1 Hz, 3H, H-3'').

$^{13}$C-NMR (101 MHz, $CDCl_3$), δ/ppm: 162.9, 154.7, 141.4, 137.1, 136.7, 129.3, 128.0, 125.9, 116.1, 114.4, 66.2, 61.2, 55.6, 42.3, 14.5.

HRMS (APCI+), m/z: calculated for $[C_{19}H_{20}N_2O_3+H]^+$ 325.1547, found 325.1542.

Example 61: Ethyl 1-(4-trifluoromethoxyphenyl)-5-phenyl-4,5-dihydro-1H-pyrazole-3-carboxylate

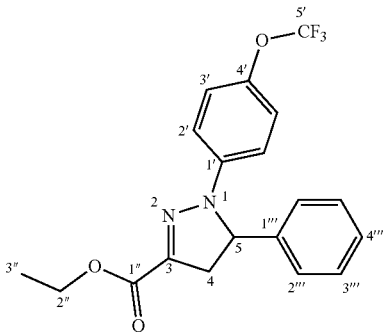

Synthesis according to synthetic method variant A using ethyl 2-(2-(4-trifluoromethoxyphenyl)hydrazono)acetate (3 mmol, 829 mg, 1 eq.) and styrene (8.1 mmol, 844 mg, 2.7 eq.). After flash column chromatography on silica with cyclohexane/ethyl acetate (0%→3% EtOAc), the pyrazoline was obtained as an orange solid (0.98 mmol, 371 mg, 33%).

$^1$H-NMR (400 MHz, $CDCl_3$), δ/ppm: 7.38-7.32 (m, 2H, H-3'''), 7.31-7.26 (m, 1H, H-4'''), 7.24-7.20 (m, 2H, H-2'''), 7.10-7.06 (m, 2H, H-3'), 7.04-7.00 (m, 2H, H-2'), 5.37 (dd, J=13.2, 7.2 Hz, 1H, H-5), 4.34 (q, J=7.1 Hz, 2H, H-2''), 3.74 (dd, J=18.1, 13.2 Hz, 1H, (H-4)'), 3.06 (dd, J=18.1, 7.2 Hz, 1H, (H-4)''), 1.37 (t, J=7.1 Hz, 3H, H-3'').

$^{13}$C-NMR (101 MHz, $CDCl_3$), δ/ppm: 162.6, 143.3, 141.5, 140.8, 139.3, 129.5, 128.3, 125.7, 122.0, 121.9, 119.4, 115.3, 65.6, 61.4, 42.7, 14.4. $^{19}$F-NMR (376 MHz, $CDCl_3$), δ/ppm: −59.4.

HRMS (ESI+), m/z: calculated for $[C_{19}H_{17}F_3N_2O_3+H]^+$ 379.1264, found 379.1264.

Example 62: 1-Methyl-3,5-diphenyl-4,5-dihydro-1H-pyrazole

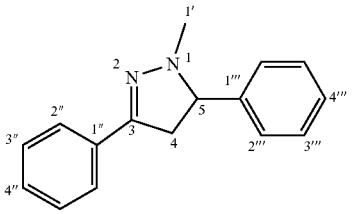

Synthesis according to synthetic method variant B using benzaldehyde methylhydrazone (3.2 mmol, 429 mg, 1 eq.) and styrene (12.5 mmol, 1302 mg, 3.9 eq.). After flash column chromatography on silica with cyclohexane/ethyl acetate (0%→2% EtOAc), the pyrazoline was obtained as a yellow oil (0.76 mmol, 179 mg, 24%).

$^1$H-NMR (400 MHz, $CDCl_3$), δ/ppm: 7.69-7.64 (m, 2H, H-2''), 7.51-7.47 (m, 2H, H-2'''), 7.44-7.30 (m, 6H, H-3'', H-4'', H-3''', H-4'''), 4.13 (dd, J=14.4, 10.0 Hz, 1H, H-5), 3.49 (dd, J=16.1, 10.0 Hz, 1H, (H-4)'), 3.01 (dd, J=16.1, 14.4 Hz, 1H, H—(H-4)''), 2.86 (s, 3H, H-1').

$^{13}$C-NMR (101 MHz, $CDCl_3$), δ/ppm: 149.8, 140.5, 133.0, 128.8, 128.7, 128.6, 127.9, 127.6, 125.9, 73.7, 43.4, 41.7.

HRMS (APCI+), m/z: calculated for $[C_{16}H_{16}N_2+H]^+$ 237.1386, found 237.1386.

Example 63: Alternative Synthetic Routes from 2,5-dichlorophenylhydrazine hydrochloride via (Z)-ethyl glyoxylate 2,5-dichlorophenylhydrazone or (E)-ethyl glyoxylate 2,5-dichlorophenylhydrazone to give mefenpyr-diethyl (a) (Z)-Ethyl glyoxylate 2,5-dichlorophenylhydrazone (2)

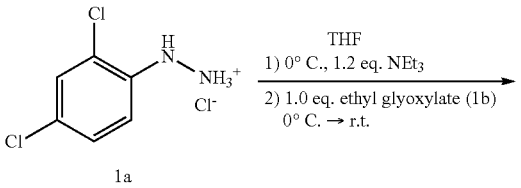

-continued

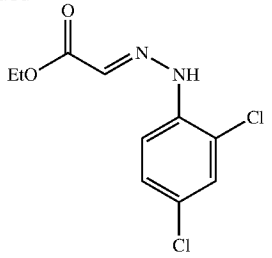

2

In a 250 ml round bottom flask, 2,5-dichlorophenylhydrazine hydrochloride (la, 46.8 mmol, 10.0 g, 1.0 eq.) was dissolved in THF (75 ml) and cooled to 0° C. Triethylamine (56.2 mmol, 5.68 g, 1.2 eq.) was added dropwise, the mixture was stirred for 15 min and filtered, and the residue was washed with THF (25 ml). To the filtrate was added dropwise ethyl glyoxylate (1b, 46.8 mol, 4.78 g, 1.0 eq.) in toluene (1:1 w/w) at 0° C. The mixture was then stirred for 5 hours, over the course of which the mixture reached room temperature. The solvent was removed under reduced pressure and the residue recrystallized from cyclohexane/ethyl acetate (2:1 v/v) to give the product as a pale yellow solid (2, 37.6 mmol, 9.82 g, 80%).

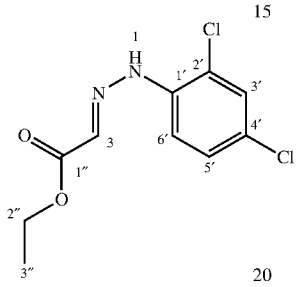

$^1$H NMR (400 MHz, $CDCl_3$), δ/ppm: 8.68 (s, 1H, H-1), 7.57 (d, J=8.9 Hz, 1H, H-3'), 7.30-7.22 (m, 2H, H-3, 6'), 7.20 (dd, J=8.9, 2.4 Hz, 1H, H-5'), 4.31 (q, J=7.1 Hz, 2H, H-2"), 1.35 (t, J=7.1 Hz, 3H, H-3"). $^{13}$C NMR (101 MHz, $CDCl_3$), δ/ppm: 163.6, 137.6, 129.1, 128.9, 128.3, 126.9, 118.5, 116.4, 61.3, 14.3.

HRMS (ESI+), m/z: calculated for $C_{10}H_{10}{}^{35}Cl_2N_2O_2+H^+$ 261.0192 $[M+H]^+$, found 261.0192; calculated for $C_{10}H_{10}{}^{35}Cl^{37}ClN_2O_2+H^+$ 263.0164 $[M+H]^+$, found 263.0164; calculated for $C_{10}H_{10}{}^{37}Cl_2N_2O_2+H^+$ 265.0138 $[M+H]^+$, found 265.0137.

LC-MS analysis: Water+0.1% by volume formic acid/MeCN (50→100% MeCN over 10 min, 10 min at 100% MeCN)

$R_t$ = 9.910 min (b) (E)-Ethyl glyoxylate 2,5-dichlorophenylhydrazone (3)

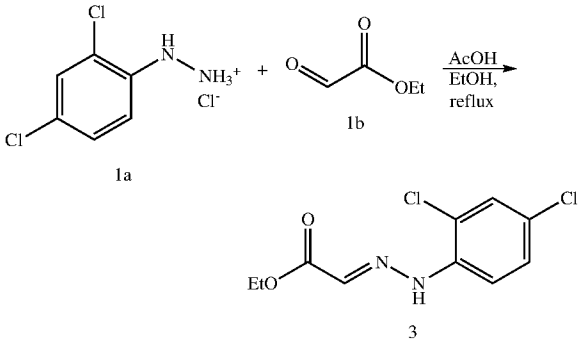

In a 2 l round bottom flask, ethyl glyoxylate (1b, 0.79 mol, 80.7 g, 1.05 eq.) was dissolved in toluene (1:1 w/w) and 2,5-dichlorophenylhydrazine hydrochloride (la, 0.75 mol, 160.1 g, 1.0 eq.) was dissolved in ethanol (750 ml). Glacial acetic acid (0.75 mol, 45.0 g, 1.0 eq.) was added and the mixture was heated overnight under reflux. After crystallization of the product at −30° C., the product was filtered off and the residue was washed with water. The product was obtained without further purification as orange needles (3, 0.67 mol, 174.5 g, 89%).

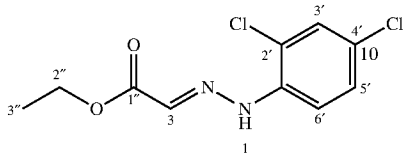

$^1$H NMR (400 MHz, $CDCl_3$), δ/ppm: 12.58 (s, 1H, H-1), 7.54 (d, J=8.9 Hz, 1H, H-6'), 7.33 (d, J=2.3 Hz, 1H, H-3'), 7.22 (dd, J=8.9, 2.3 Hz, 1H, H-5'), 6.75 (s, 1H, H-3), 4.29 (q, J=7.1 Hz, 2H, H-2"), 1.36 (t, J=7.1 Hz, 3H, H-3").

$^{13}$C NMR (101 MHz, $CDCl_3$), δ/ppm: 163.5, 138.5, 129.1, 128.2, 127.0, 121.6, 119.6, 115.4, 61.0, 14.3.

LC-MS analysis: Water+0.1% by volume formic acid/MeCN (50→100% MeCN over 10 min, 10 min at 100% MeCN) $R_t$=14.049 min (c) (Z)-Ethyl glyoxylate 2,5-dichlorophenylhydrazone to mefenpyr-diethyl (4)

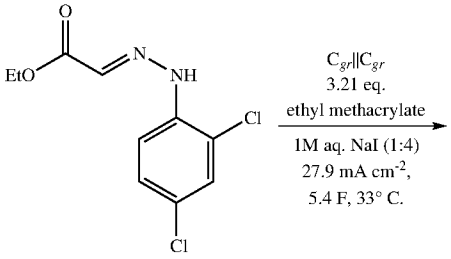

2

-continued

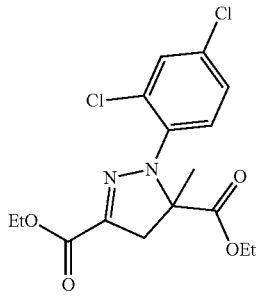

4

In a 50 ml jacketed beaker cell, (Z)-ethyl glyoxylate 2,5-dichlorophenylhydrazone (2, 19.1 mmol, 5.0 g, 1.0 eq.) and ethyl methacrylate (61.5 mmol, 7.02 g, 3.21 eq.) were dispersed in 1M aqueous sodium iodide (20 ml). As anode and cathode, isostatic graphite plates (size: 60×20×3 mm) with an immersion depth of 2.7 cm and a relevant anode area of 5.4 $cm^2$ were used. Constant current electrolysis was carried out at 33° C. and 1000 rpm at a current density of 27.9 mA $cm^{-2}$ until an amount of charge of 5.4 F had been applied. The biphasic mixture was transferred to a separating funnel for separation. The aqueous layer was additionally extracted with ethyl acetate (1×30 ml), the combined organic fractions were dried over anhydrous magnesium sulfate and filtered, and the solvent was removed under reduced pressure to give the crude product. After flash column chromatography on silica with cyclohexane/EtOAc (0%→4% EtOAc), mefenpyr-diethyl was obtained as an orange oil (4, 16.4 mmol, 6.13 g, 86%).

$^1$H NMR (400 MHz, CDCl3), δ/ppm: 7.41 (d, J=2.1 Hz, 1H, H-3'), 7.25-7.19 (m, 2H, H-5', H-6'), 4.33 (qd, J=7.2, 1.7 Hz, 2H, H-2''), 4.19 (q, J=7.2 Hz, 2H, H-2'''), 3.73 (d, J=17.7 Hz, 1H, (H-4)'), 3.12 (d, J=17.7 Hz, 1H, (H-4)''), 1.46 (s, 3H, H-1''''), 1.35 (t, J=7.1 Hz, 3H, H-3''), 1.24 (t, J=7.1 Hz, 3H, H-3''').

$^{13}$C NMR (101 MHz, CDCl3), δ/ppm: 171.5, 162.3, 140.1, 138.0, 133.6, 133.4, 130.5, 130.2, 127.5, 73.6, 62.3, 61.5, 45.1, 22.1, 14.5, 14.1.

HRMS (ESI+), m/z: calculated for $C_{16}H_{18}{}^{35}Cl_2N_2O_4+H^+$ 373.0716 $[M+H]^+$, found 373.0718; calculated for $C_{16}H_{18}{}^{35}Cl^{37}ClN_2O_4+H^+$ 375.0690 $[M+H]^+$, found 375.0692; calculated for $C_{16}H_{18}{}^{37}Cl_2N_2O_4+H^+$ 377.0669 $[M+H]^+$, found 377.0674.

(d) (E)-Ethyl glyoxylate 2,5-dichlorophenylhydrazone to mefenpyr-diethyl (4)

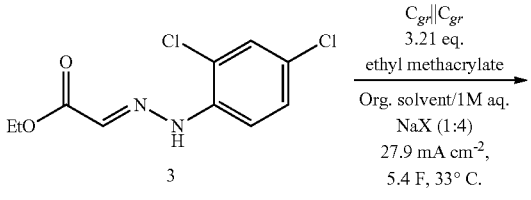

3

-continued

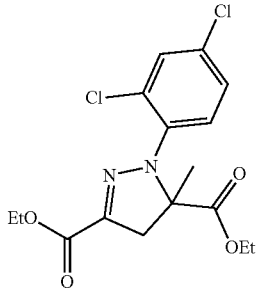

4

In 5 ml PTFE cells, the hydrazone 3 and ethyl methacrylate were dissolved in an organic solvent and aqueous sodium halide solution was added. As anode and cathode, isostatic graphite plates (size: 70×10×3 mm) with an immersion depth of 1.7 cm and a relevant anode area of 1.7 $cm^2$ were used. The mixture was subjected to galvanostatic electrolysis with vigorous stirring (magnetic stirrer set at approximately 1000 rpm) at 33° C. until an amount of charge of 5.4F had been applied. The mixture was transferred to a separating funnel and the cell rinsed with ethyl acetate. As internal standard, 1 ml of a solution of 1,3,5-trimethoxybenzene (3.000 g/100 ml ethyl acetate) was added. The mixture was briefly shaken and the layers were separated. The organic fraction was dried over anhydrous magnesium sulfate and filtered. An aliquot was filtered through silica gel and analysed by GC to quantify the amount of pyrazoline.

Due to poor conversion and yield when using the (E)-hydrazone 3 under the conditions optimized for the (Z)-hydrazone 2, a second screening was carried out. Firstly, the solvent and the halide source were investigated. This resulted in tert-butyl methyl ether and sodium iodide as preferred conditions (Table 1).

TABLE 1

Solvent screening for the conversion of (E)-ethyl glyoxylate 2,5-dichlorophenylhydrazone

| Org. solvent | NaX (X = Halogen) | Yield 4 (GC)[a] |
|---|---|---|
| $CH_2Cl_2$ | NaCl | 4% |
| $CH_2Cl_2$ | NaBr | n/d |
| PhCl | NaI | 15% |
| No org. solvent | NaI | 25% |
| MeO$^t$Bu | NaI | 60% |
| PhMe | NaI | 28% |

5 ml PTFE beaker cuvette, 1 ml of org. solvent, 4 ml of 1M aq. NaX, 3.52 mmol of hydrazone 3, 3.21 eq. of ethyl methacrylate, 33° C., isostatic graphite electrodes, 27.9 mA cm$^{-2}$, 5.4 F.

[a]determined after external calibration with 1,3,5-trimethoxybenzene as internal standard.

Preferred conditions for the (E)-hydrazone are as follows:

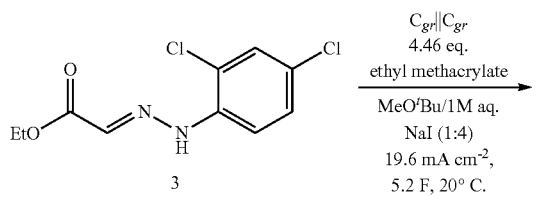

3

-continued

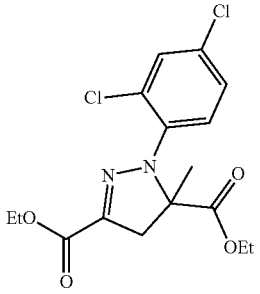

4

5 ml PTFE beaker cuvette, 1 ml of MeO$^t$Bu, 4 ml of 1M aq. NaI, 0.60 mmol of hydrazone 3.

Alternatively, the (E)-hydrazone can preferably be converted in a mixture of ethanol and acetonitrile (in particular 1:1 vol/vol), the yield being up to 73% (optimized conditions: 3.79 eq. of methacrylate, 2.79 eq. of NaI, 5 mA/cm2, 4.0F, rt):

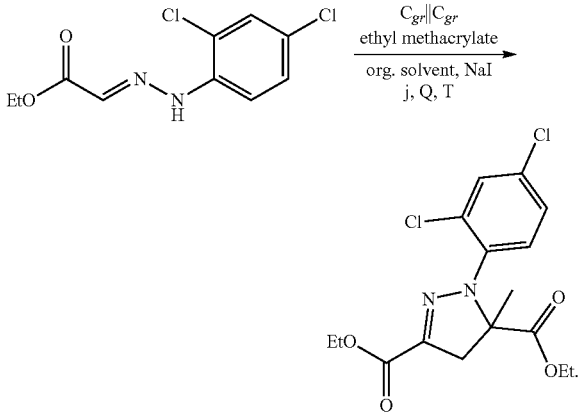

What is claimed is:

1. A process for preparing compounds of general formula (I)

I

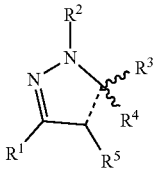

in which ⋰ is a single or double bond;

$R^1$ is alkyl, —C(O)O-alkyl, cycloalkyl, aryl, or heterocyclyl, in each case substituted or unsubstituted;

$R^2$ is alkyl, —C(O)O-alkyl, cycloalkyl, aryl, or heterocyclyl, in each case substituted or unsubstituted;

$R^3$ is alkyl, —C(O)O-alkyl, —C(O)O-aryl, —C(O)N-(alkyl)$_2$, —CN, —P(O)(O-alkyl)$_2$, cycloalkyl, aryl, or heterocyclyl, in each case substituted or unsubstituted, or H;

$R^4$ is present if ⋰ is a single bond and $R^4$ is alkyl, —C(O)O-alkyl, C(O)O-aryl, cycloalkyl, aryl, or heterocyclyl, in each case substituted or unsubstituted, or H;

or $R^3$ and $R^4$ together with the carbon atom in the compounds of the formula (I) linking $R^3$ and $R^4$ form a substituted or unsubstituted cycloalkyl or heterocyclyl;

$R^5$ is alkyl, —C(O)O-alkyl, cycloalkyl, aryl, or a heterocyclyl, in each case substituted or unsubstituted, or H;

or $R^4$ and $R^5$ together with the carbon atoms in the compounds of the formula (I) linking $R^4$ and $R^5$ with each other form a cycloalkyl or heterocyclyl, in each case substituted or unsubstituted;

or $R^1$ and $R^5$ together with the carbon atoms in the compounds of the formula (I) linking $R^1$ and $R^5$ form a cycloalkyl or heterocyclyl, in each case substituted or unsubstituted;

characterized in that compounds of general formula (II)

II

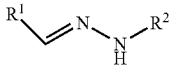

where $R^1$ and $R^2$ have the same definition as in the general formula (I) are reacted in an electrochemical reaction in the presence of an iodide source with a compound of formula (III) or (IV)

III

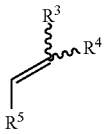

IV

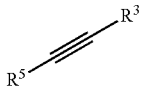

where $R^3$, $R^4$ and $R^5$ have the same definition as in the general formula (I).

2. The process according to claim 1, wherein $R^1$ is unsubstituted or substituted $C_1$-$C_6$-alkyl, unsubstituted or substituted —C(O)O($C_{1-8}$-alkyl), unsubstituted or substituted $C_3$-$C_{12}$-cycloalkyl, unsubstituted or substituted phenyl, unsubstituted or substituted naphthyl; and/or $R^2$ is unsubstituted or substituted $C_1$-$C_6$-alkyl, unsubstituted or substituted —C(O)O($C_{1-8}$-alkyl), unsubstituted or substituted $C_3$-$C_{12}$-cycloalkyl, unsubstituted or substituted phenyl; and/or $R^3$ is H, unsubstituted or substituted $C_1$-$C_6$-alkyl, unsubstituted or substituted —C(O)O($C_{1-8}$-alkyl), unsubstituted or substituted —C(O)O-phenyl, unsubstituted or substituted —C(O)O-benzyl, unsubstituted or substituted $C_3$-$C_{12}$-cycloalkyl, unsubstituted or substituted phenyl, unsubstituted or substituted naphthyl; and/or $R^4$ is present if ⋰ is a single bond and $R^4$ is H, unsubstituted or substituted $C_1$-$C_6$-alkyl, unsubstituted or substituted C(O)O($C_{1-8}$-alkyl), unsubstituted or substituted C(O)O-phenyl, unsubstituted or substituted —C(O)O-benzyl, unsubstituted or substituted $C_3$-$C_{12}$-cycloalkyl, unsubstituted or substituted phenyl; or $R^3$ and $R^4$ together with the carbon atom in the compounds of the formula (I) linking $R^3$ and $R^4$ form an unsubstituted or substituted $C_3$-$C_{12}$-cycloalkyl; and/or $R^5$ is H, unsubstituted or substituted $C_1$-$C_6$-alkyl, unsubstituted or substituted C(O)O($C_{1-8}$-alkyl), unsubstituted or substituted $C_3$-$C_{12}$-cycloalkyl, substituted or unsubstituted phenyl; or $R^4$ and $R^5$ together with the carbon atoms linking $R^4$ and $R^5$ with each other in the compounds of the formula (I) form an unsubstituted or substituted $C_3$-$C_{12}$-cycloalkyl or heterocyclyl; or $R^1$ and $R^5$ together with the carbon atoms in the compounds of formula (I) linking $R^1$ and $R^5$, form an unsubstituted or substituted $C_3$-$C_{12}$-cycloalkyl or heterocyclyl.

3. The process according to claim 1, wherein the iodide source is sodium iodide, lithium iodide, potassium iodide or mixtures thereof.

4. The process according to claim 1, wherein the reaction is carried out in the presence of the iodide source in an aqueous solution.

5. The process according to claim 4, wherein the iodide source is used at a concentration of 0.2 to 2.0 M, based on the aqueous solution.

6. The process according to claim 5, wherein the iodide source is used at a concentration of 0.5 to 1.4 M, based on the aqueous solution.

7. The process according to claim 1, wherein the reaction is carried out in the presence of the iodide source in a biphasic mixture of an aqueous solution and an organic solvent.

8. The process according to claim 7, wherein the organic solvent is selected from ethyl acetate, tert-butyl methyl ether, dichloromethane, chlorobenzene, 1,2-dichloroethane and mixtures thereof.

9. The process according to claim 1, wherein the compound (III) or (IV) is used in amounts between 1.0 and 6.0 equivalents, based on the amount of substance of the compounds of the formula (II) used.

10. The process according to claim 9, wherein the compound (III) or (IV) is used in amounts between 2.0 and 5.0 equivalents, based on the amount of substance of the compounds of the formula (II) used.

11. The process according to claim 1, wherein the reaction is carried out in an undivided electrolytic cell.

12. The process according to claim 1, wherein graphite electrodes are used as anode and cathode in the reaction.

13. The process according to claim 12, wherein isostatic graphite is used.

14. The process according to claim 1, wherein the process is carried out at a current density of 20 to 50 $mA/cm^2$.

15. The process according to claim 14, wherein the process is carried out at a current density of 30 to 40 $mA/cm^2$.

16. The process according to claim 1, wherein the process is carried out until an applied amount of charge of 1 to 10F.

17. The process according to claim 16, wherein the process is carried out until an applied amount of charge of 2 to 6F.

18. The process according to claim 1, wherein the reaction is carried out at a temperature of 10 to 50° C.

19. The process according to claim 7, wherein the aqueous phase is subsequently separated off and subsequently freeze-dried to recover the iodide source.

20. The process according to claim 1, wherein ⋰ is a single bond, and compounds of the general formula (II) are reacted with compounds of the general formula (III).

21. The process according to claim 1, wherein the compound (I) is diethyl 1-(2,4-dichlorophenyl)-5-methyl-4,5-dihydro-1H-pyrazole-3,5-dicarboxylate, the compound (II) is ethyl 2-(2-(2,4-dichlorophenyl)hydrazono)acetate; and the compound (III) is ethyl methacrylate.

* * * * *